US008411022B2

(12) United States Patent
Brown Elliott et al.

(10) Patent No.: US 8,411,022 B2
(45) **Date of Patent: *Apr. 2, 2013**

(54) MULTIPRIMARY COLOR DISPLAY WITH DYNAMIC GAMUT MAPPING

(75) Inventors: Candice Hellen Brown Elliott, Santa Rosa, CA (US); Thomas Lloyd Credelle, Morgan Hill, CA (US); Anthony Botzas, San Jose, CA (US); Michael Francis Higgins, Duncan Mills, CA (US)

(73) Assignee: Samsung Display Co., Ltd. (KR)

( * ) Notice: Subject to any disclaimer, the term of this patent is extended or adjusted under 35 U.S.C. 154(b) by 373 days.

This patent is subject to a terminal disclaimer.

(21) Appl. No.: 12/504,603

(22) Filed: Jul. 16, 2009

(65) Prior Publication Data

US 2009/0278867 A1 Nov. 12, 2009

Related U.S. Application Data

(63) Continuation of application No. 11/750,895, filed on May 18, 2007, now Pat. No. 7,592,996.

(60) Provisional application No. 60/803,855, filed on Jun. 2, 2006, provisional application No. 60/827,710, filed on Sep. 30, 2006, provisional application No. 60/828,594, filed on Oct. 6, 2006, provisional application No. 60/891,668, filed on Feb. 26, 2007.

(51) Int. Cl.
*G09G 3/36* (2006.01)

(52) U.S. Cl. ..... 345/102; 345/690; 345/88; 348/672; 362/97.1

(58) Field of Classification Search ..... 345/76, 345/77, 82–84, 87, 102, 204, 690, 88; 382/168–172; 362/97.1–97.3; 348/672

See application file for complete search history.

(56) References Cited

U.S. PATENT DOCUMENTS

| | | | | |
|---|---|---|---|---|
| 6,111,559 | A * | 8/2000 | Motomura et al. | 345/102 |
| 6,453,067 | B1 * | 9/2002 | Morgan et al. | 382/162 |
| 6,762,742 | B2 | 7/2004 | Moon et al. | |
| 7,136,044 | B2 * | 11/2006 | Sasaki | 345/102 |
| 7,289,100 | B2 * | 10/2007 | Sohn et al. | 345/102 |
| 7,352,352 | B2 * | 4/2008 | Oh et al. | 345/102 |
| 7,522,135 | B2 * | 4/2009 | Baik | 345/88 |
| 7,592,996 | B2 * | 9/2009 | Brown Elliott et al. | 345/102 |

(Continued)

FOREIGN PATENT DOCUMENTS

| | | |
|---|---|---|
| TW | 558899 | 10/2003 |
| TW | 200540793 A | 12/2005 |

(Continued)

OTHER PUBLICATIONS

European Search Report, EP6770785.1-2205, Nov. 4, 2009, 9 pages.

*Primary Examiner* — Lun-Yi Lao
*Assistant Examiner* — Kelly B Hegarty
(74) *Attorney, Agent, or Firm* — Innovation Counsel LLP

(57) ABSTRACT

The embodiments disclosed herein comprise a plurality of modules and means to provide effect dynamic gamut mapping and backlight control. In one embodiment, a display system comprises: a transmissive display, said display comprising a plurality of colored subpixels wherein one such colored subpixel is substantially wide spectrum bandpass; a transmissive display controller, said display controller providing signals to said transmissive display to set the amount of transmissivity of each said colored subpixel; a backlight, said backlight providing illumination to said transmissive display; a backlight controller, said controller providing signals to said backlight to modulate the amount of illumination provided by said backlight to said transmissive display; peak surveying module for surveying image data and extracting the image gamut hull for providing intermediate backlight data signals to said backlight controller to match said image gamut hull; and a means for normalizing display image data signals according to said intermediate backlight data signals and providing said normalized image data as intermediate display data.

19 Claims, 47 Drawing Sheets

U.S. PATENT DOCUMENTS

| | | | | |
|---|---|---|---|---|
| 7,595,784 | B2 * | 9/2009 | Yamamoto et al. | 345/102 |
| 7,612,758 | B2 * | 11/2009 | Yang | 345/102 |
| 7,656,375 | B2 * | 2/2010 | Lo et al. | 345/88 |
| 7,705,810 | B2 * | 4/2010 | Choi et al. | 345/77 |
| 2002/0050987 | A1 * | 5/2002 | Sakashita | 345/204 |
| 2002/0063670 | A1 * | 5/2002 | Yoshinaga et al. | 345/87 |
| 2002/0093521 | A1 * | 7/2002 | Daly et al. | 345/698 |
| 2004/0046725 | A1 | 3/2004 | Lee | |
| 2004/0155854 | A1 * | 8/2004 | Ma et al. | 345/102 |
| 2004/0246275 | A1 * | 12/2004 | Yoshihara et al. | 345/690 |
| 2004/0263528 | A1 | 12/2004 | Murdoch et al. | |
| 2004/0264212 | A1 * | 12/2004 | Chung et al. | 362/561 |
| 2005/0104837 | A1 * | 5/2005 | Baik et al. | 345/99 |
| 2005/0104838 | A1 | 5/2005 | Sasaki | |
| 2005/0140612 | A1 * | 6/2005 | Baek | 345/83 |
| 2005/0140616 | A1 | 6/2005 | Sohn | |
| 2005/0140640 | A1 * | 6/2005 | Oh et al. | 345/102 |
| 2005/0184952 | A1 * | 8/2005 | Konno et al. | 345/102 |
| 2005/0225562 | A1 * | 10/2005 | Higgins et al. | 345/604 |
| 2006/0146351 | A1 * | 7/2006 | Lo et al. | 358/1.9 |
| 2007/0222743 | A1 * | 9/2007 | Hirakata | 345/102 |
| 2008/0284759 | A1 * | 11/2008 | Park | 345/204 |
| 2009/0015602 | A1 * | 1/2009 | Rumreich et al. | 345/690 |

FOREIGN PATENT DOCUMENTS

| | | | |
|---|---|---|---|
| TW | 200615664 | A | 5/2006 |

* cited by examiner

MULTIPRIMARY COLOR DISPLAY WITH DYNAMIC GAMUT MAPPING

CROSS REFERENCE TO RELATED APPLICATIONS

This is a continuation application of U.S. patent application Ser. No. 11/750,895, filed on May 18, 2007, which application claims the benefit of U.S. Provisional Application 60/803,855 entitled "Color Imaging Backlight for Color Display Systems and Methods of Operation" filed on Jun. 2, 2006; U.S. Provisional Application 60/827,710 entitled "Systems and Methods for Reducing Desaturation of Images Rendered on High Brightness Displays" filed on Sep. 30, 2006; U.S. Provisional Application 60/828,594 entitled "Display Systems and Methods Having Dynamic Virtual Primaries" filed on Oct. 6, 2006; and U.S. Provisional Application 60/891,668 entitled "High Dynamic Contrast Display System Having Multiple Segmented Backlight" filed on Feb. 26, 2007, which are hereby incorporated by reference herein.

BACKGROUND

Novel sub-pixel arrangements are disclosed for improving the cost/performance curves for image display devices in the following commonly owned United States Patents and Patent Applications including: (1) U.S. Pat. No. 6,903,754 ("the '754 patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. polarity inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) United States Patent Publication No. 2004/0246381 ("the '381 application") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) United States Patent Publication No. 2004/0246278 ("the '278 application") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) U.S. Pat. No. 7,187,353 ("the '353 patent") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) United States Patent Publication No. 2005/0212741 ("the '741 application") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '381, '278, '404, '277 and '741 published applications and the '353 patent are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and Patent Applications: (1) U.S. Pat. No. 7,123,277 ("the '277 patent") having application Ser. No. 10/051,612 and entitled "CONVERSION OF A SUB-PIXEL FORMAT DATA TO ANOTHER SUB-PIXEL DATA FORMAT," filed Jan. 16, 2002; (2) United States Patent Publication No. 2003/0103058 ("the '058 application") having application Ser. No. 10/150,355 entitled "METHODS AND SYSTEMS FOR SUB-PIXEL RENDERING WITH GAMMA ADJUSTMENT," filed May 17, 2002; (3) U.S. Pat. No. 7,184,066 ("the '066 patent") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) U.S. Pat. No. 7,167,186 ("the '186 patent") having application Ser. No. 10/379,765 and entitled "SYSTEMS AND METHODS FOR MOTION ADAPTIVE FILTERING," filed Mar. 4, 2003, (6) U.S. Pat. No. 6,917,368

("the '368 patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '058, '302, and '297 applications and the '277, '066, '186 and '368 patents are hereby incorporated by reference herein in its entirety.

Improvements in gamut conversion and mapping are disclosed in commonly owned United States Patents and co-pending United States patent applications: (1) U.S. Pat. No. 6,980,219 ("the '219 patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; and (4) U.S. Pat. No. 7,176,935 ("the '935 patent") having application Ser. No. 10/690,716 and entitled "GAMUT CONVERSION SYSTEM AND METHODS" filed Oct. 21, 2003. Each of the aforementioned '341, and '352 applications and the '219 and '935 patents is hereby incorporated by reference herein in its entirety.

Additional advantages have been described in (1) U.S. Pat. No. 7,084,923 ("the '923 patent") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) United States Patent Publication No. 2005/0225563 ("the '563 application") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

Additional improvements to, and embodiments of, display systems and methods of operation thereof are described in: (1) Patent Cooperation Treaty (PCT) Application No. PCT/US 06/12768, entitled "EFFICIENT MEMORY STRUCTURE FOR DISPLAY SYSTEM WITH NOVEL SUBPIXEL STRUCTURES" filed Apr. 4, 2006, and published in the United States as United States Patent Application Publication 2008/0170083; (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006, and published in the United States as United States Patent Application Publication 2008/0150958; (3) U.S. patent application Ser. No. 11/278,675, entitled "SYSTEMS AND METHODS FOR IMPLEMENTING IMPROVED GAMUT MAPPING ALGORITHMS" filed Apr. 4, 2006, and published as United States Patent Application Publication 2006/0244686 ("the '686 application"); (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006, and published in the United States as United States Patent Application Publication 2008/0186325; and (5) Patent Cooperation Treaty (PCT) Application No. PCT/US 06/19657, entitled "MULTIPRIMARY COLOR SUBPIXEL RENDERING WITH METAMERIC FILTERING" filed on May 19, 2006 and published in the United States as United States Patent Application Publication 2009/0058873 (referred to below as the "Metamer Filtering application".) Each of these co-owned applications is also herein incorporated by reference in their entirety.

Additional improvements to, and embodiments of, display systems and methods of operation thereof are described in: (1) Patent Cooperation Treaty (PCT) Application No. PCT/US 06/40272, entitled "IMPROVED GAMUT MAPPING AND SUBPIXEL RENDERING SYSTEMS AND METHODS" filed Oct. 13, 2006, and published in the United States as United States Patent Application Publication 2009/0122073; (2) Patent Cooperation Treaty (PCT) Application No. PCT/US 06/40269, entitled "IMPROVED MEMORY STRUCTURES FOR IMAGE PROCESSING" filed Oct. 13, 2006, and published in the United States as United States Patent Application Publication 2010/0026704; (3) Patent Cooperation Treaty (PCT) Application No. PCT/US07/68885, entitled "nHIGH DYNAMIC CONTRAST SYSTEM HAVING MULTIPLE SEGMENTED BACKLIGHT" filed May 14, 2007, and published in the United States as United States Patent Application Publication 2009/0174638; (4) Patent Cooperation Treaty (PCT) Application No. PCT/US2007/079408, entitled "SYSTEMS AND METHODS FOR REDUCING DESATURATION OF IMAGES RENDERED ON HIGH BRIGHTNESS DISPLAYS" filed on Sep. 25, 2007 and published in the United States as United States Patent Application Publication 2010/0026705; (5) Patent Cooperation Treaty (PCT) Application No. PCT/US08/53450, entitled "SUBPIXEL LAYOUTS AND SUBPIXEL RENDERING METHODS FOR DIRECTIONAL DISPLAYS AND SYSTEMS" filed on Feb. 8, 2008 and published in the United States as United States Patent Application Publication 2010/0118045. Each of these co-owned applications is also herein incorporated by reference in their entirety.

DETAILED DESCRIPTION

Improved Color Gamut Mapping Systems and Methods

In the following discussion, improved color gamut mapping systems and methods will be discussed. Such a discussion may proceed by first considering the nature of color gamuts in general, and more particularly, as they pertain to subpixelated multiprimary displays.

Figure 1A:
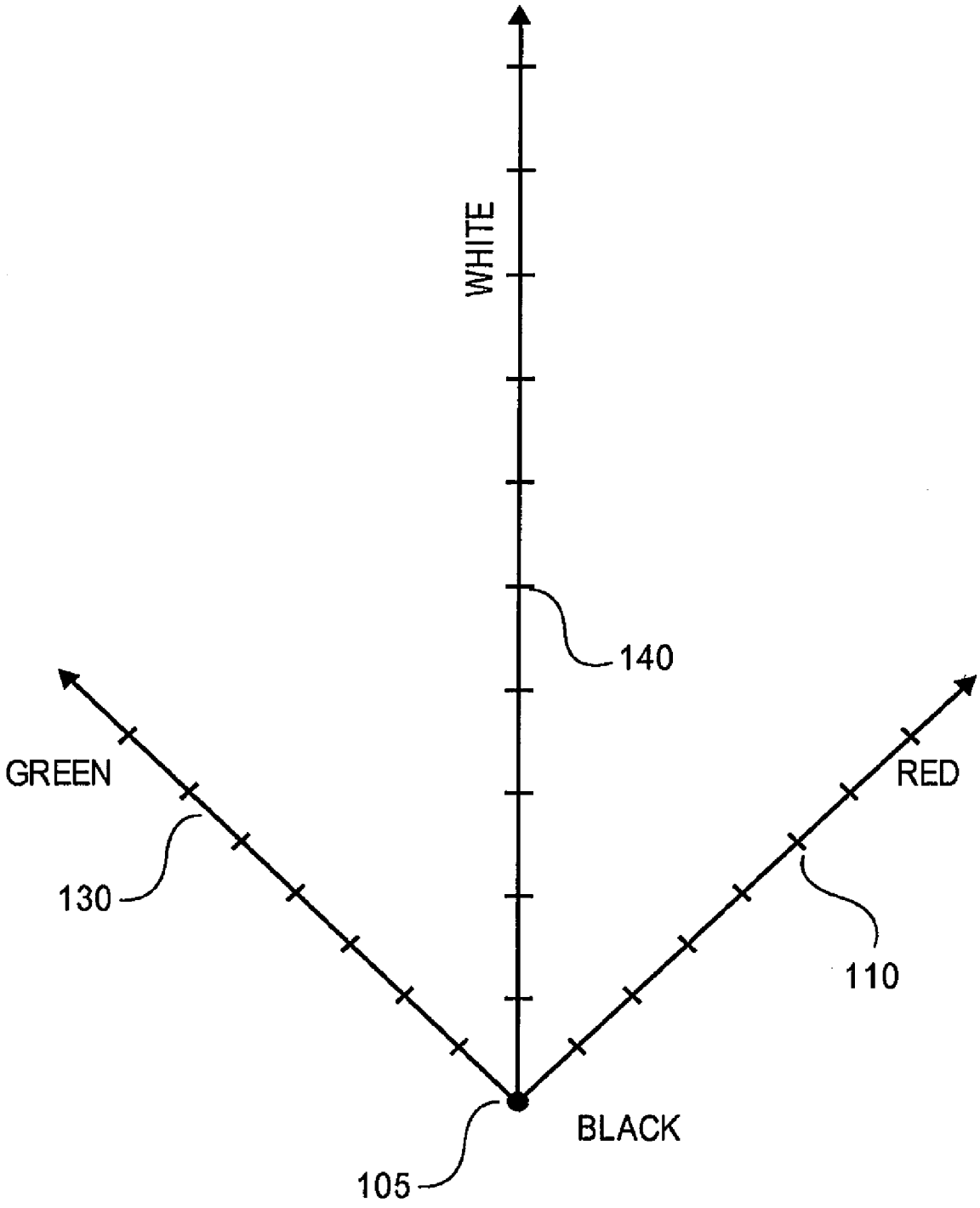
FIG. 1A is a diagram of a color vector space.

For a general consideration of gamuts, FIG. 1A shows a color space diagram consisting of three vector scales, red 110, green 130, and white 140, originating at black 105. This can be viewed as the result of a two primary display comprising of at least red and green primary pixels or subpixels. It may also be viewed as a projection of a three primary display consisting of red, green, and blue primary pixels or subpixels in which the color space is projected onto the red/green color plane, the blue color vector projection lying coincidentally with the white color vector projection. It may yet also be viewed as the result of a three primary display consisting of red, green, and white primary pixels or subpixels. Additionally, it may be viewed as the result of a four primary display consisting of red, green, blue, and white primary pixels or subpixels in which the color space is projected onto the red/green color plane, the blue color vector projection lying coincidentally with the white color vector projection.

It will be appreciated that although the techniques described herein work well with displays comprising colored subpixels in which at least one of the colored subpixels is substantially white or grey which are wide spectrum bandpass; but the techniques herein would work on displays wherein at least one of the colored subpixels is substantially a wide spectrum bandpass—e.g. grey, cyan, yellow, magenta or the like.

Figure 1B:
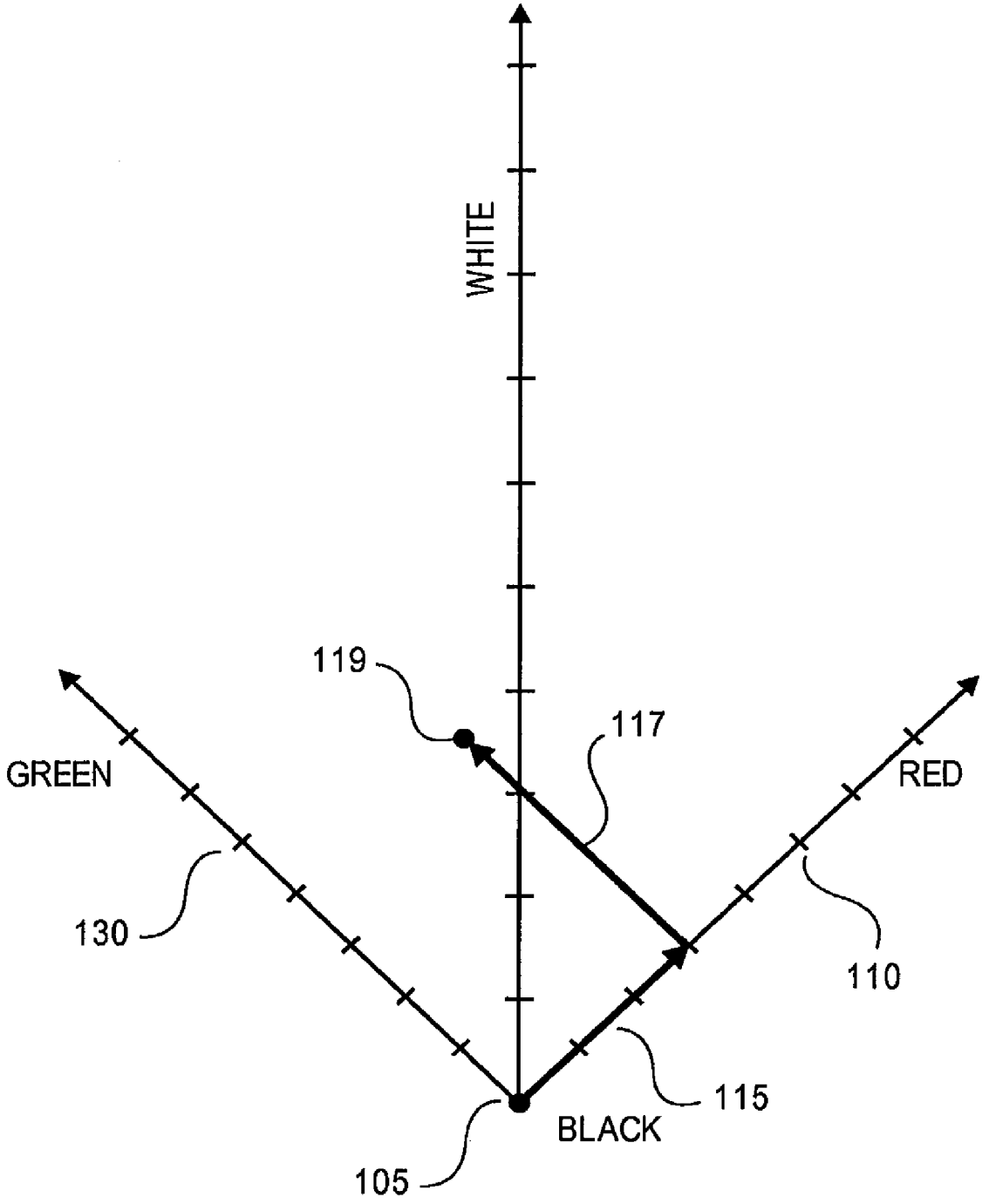
FIG. 1B shows the diagram of FIG. 1A and the vector addition of two color vectors reproducing a given color.

FIG. 1B shows how two primary vectors, red 115 and green 117 may by vector addition result in a unique color point 119. It will be understood by those in skilled in the art that a three color vector addition of red, green, and blue will also result in a unique color point in a three dimensional color space that may be projected onto the red/green color plane of FIG. 1B. Conversely, to reach a given point 119 there will be one and only one set of vectors red 115 and green 117 that may by vector addition reach the point 119 since the red 115 and green 117 vectors are orthogonal to each other. In the example given in FIG. 1B, the red vector 115 is three units of red energy along the red axis 110, while the green vector 117 is four units of green energy along the green axis 130. Thus the resulting color point 119 can be said to have a red/green color space coordinate of (3,4).

Figure 1C:
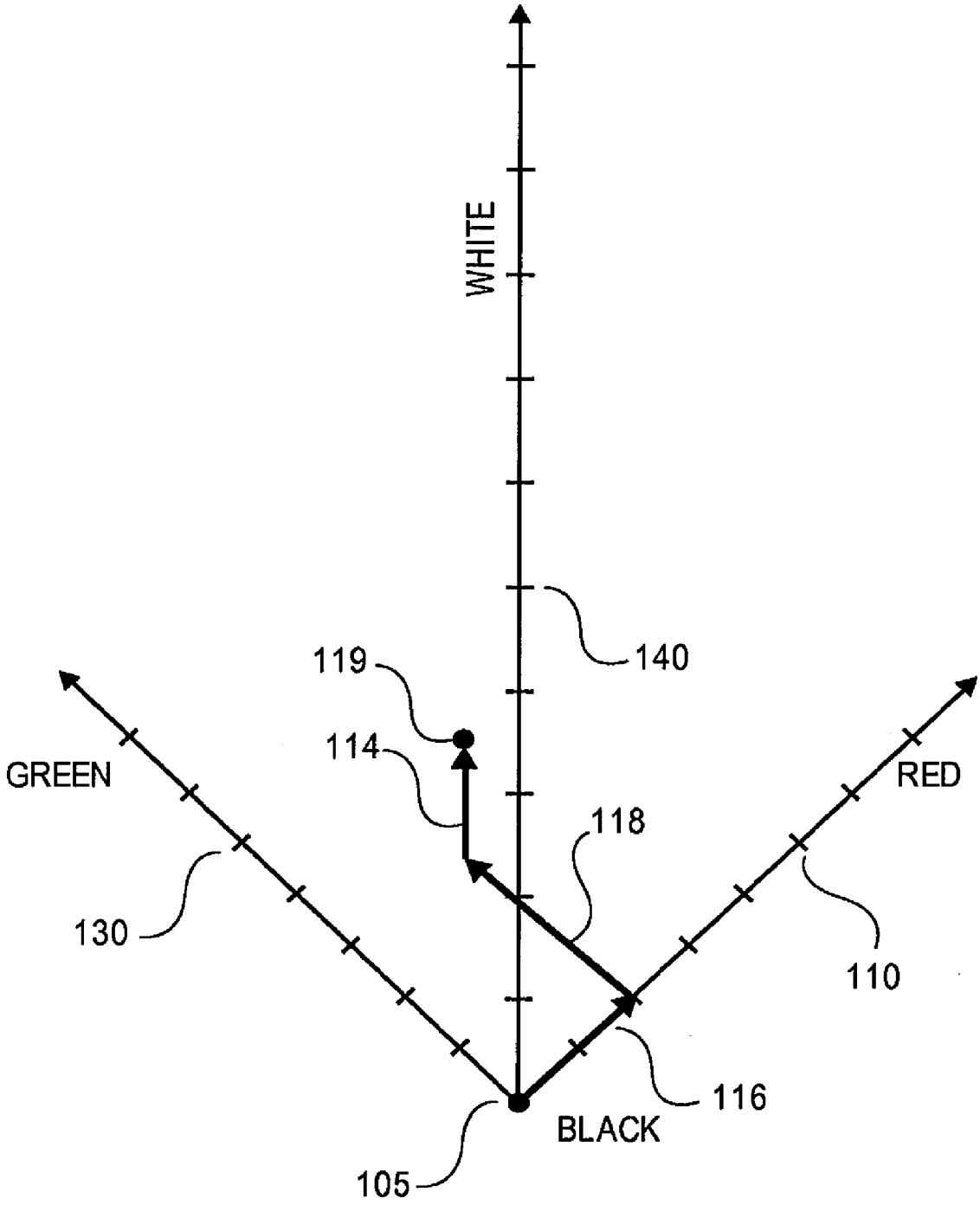
FIG. 1C shows the diagram of FIG. 1A and the vector addition of three color vectors reproducing the same said color in FIG. 1B.

FIG. 1C shows how three primary vectors, red 116, green 118, and white 114 may by vector addition result in a unique color point 119. In the example given in FIG. 1C, the red vector 116 is two units of red energy along the red axis 110, the green vector 118 is three units of green energy along the green axis 130, while the white vector is one unit of white along the white axis. However, the white vector may be decomposed into red and green vector components of one unit of energy each. The resulting color point 119 can be said to have a red/green color space coordinate of (3,4). Note that to reach a given color point 119, many possible combinations of red 116, green 118, and white 114 vectors may be used. Each of these combinations of color vectors is called a metamer for that given color point. It will be understood by those in skilled in the art that a four color vector addition of red, green, blue, and white will also result in a unique color point in a three dimensional color space that may be projected onto the red/green color plane of FIG. 1C, that the concepts explained herein may be extended to include such "RGBW" systems. Methods of finding such RGBW metamers and their uses in color and subpixel rendering are explained in US2004/0051724; US2005/0276502; US2006/0244686 and WO2006/127555 and are included herein by reference.

Figure 2:
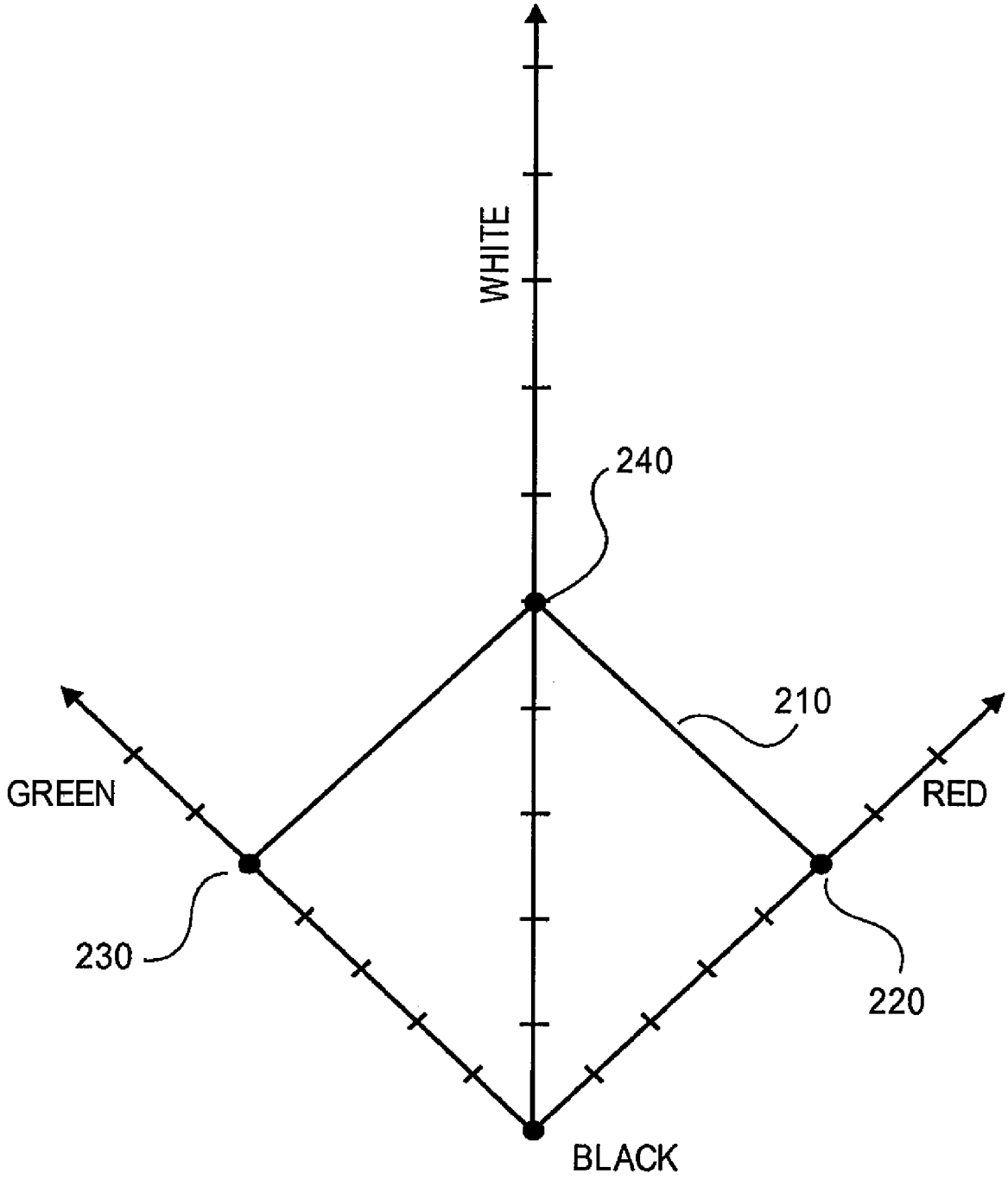
FIG. 2 shows the diagram of FIG. 1A and the color gamut hull formed by the vector addition of two color vectors with equal maximum value.

FIG. 2 may show the resulting color/brightness gamut 210 of a red/green color display with color primary vectors that may reach five units maximum. It may also be viewed as the resulting color/brightness gamut 210 of a red/green/blue color display projected onto the red/green color plane with the blue color vector projected coincidentally onto the white axis. The maximum saturated red color 220 forms one corner while the maximum green saturated color 230 forms another corner of the color gamut. When all of the colored primaries, the red, green, blue (not shown for clarity) primaries, are turned on to their maximum value of five units the result is the maximum desaturated color, white, results with a value of five units 240. The choice of units is arbitrary. The use of five units here is only for explanatory convenience. This red, green, and blue color space is the basis for the, well known in the art, RGB color space.

Figure 3A:
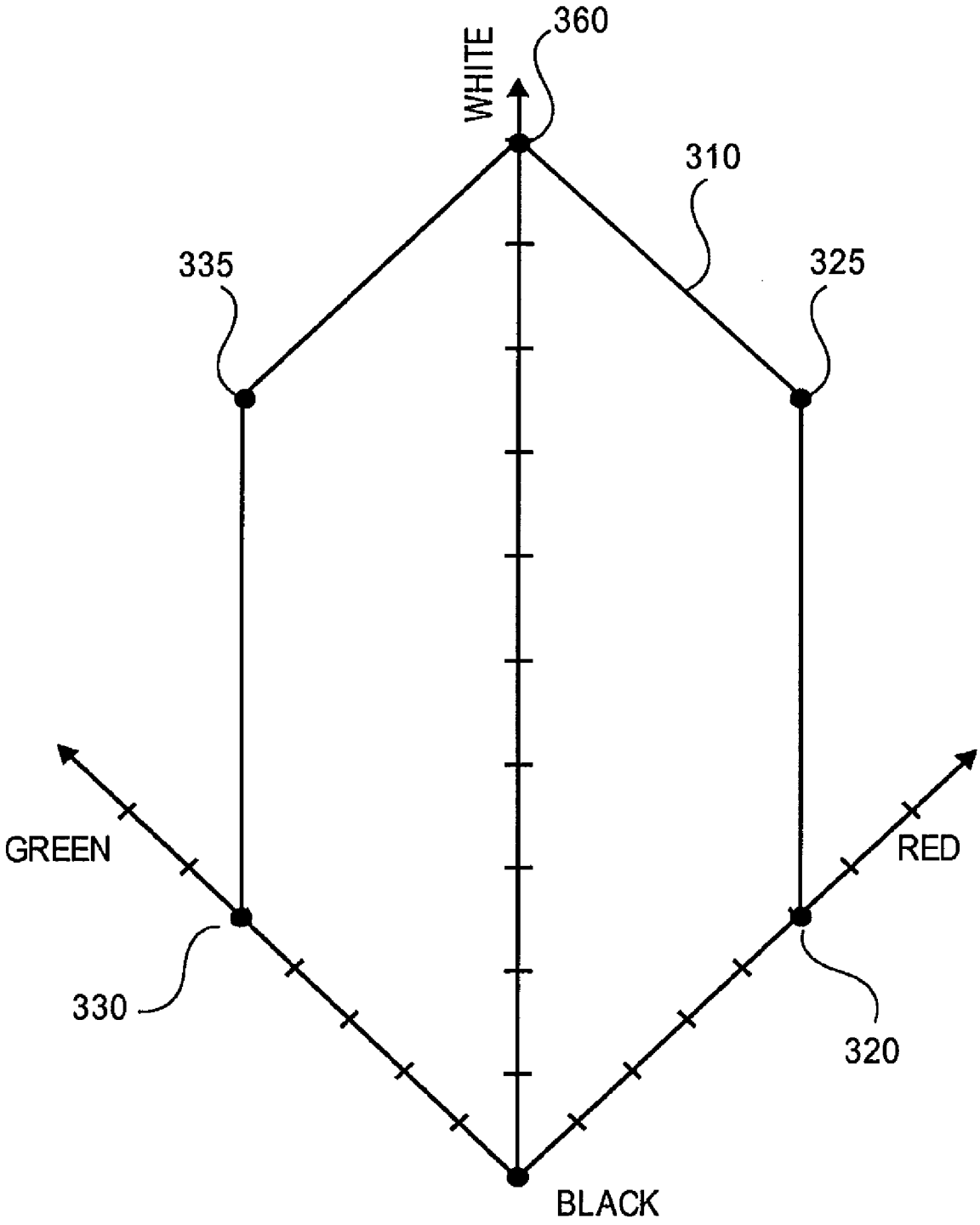
FIG. 3A shows the diagram of FIG. 1A and the color gamut hull formed by the vector addition of three color vectors with equal maximum value.

FIG. 3A may show the resulting color/brightness gamut 310 of a red/green/white display with color primary vectors that may reach five units maximum. It may also be viewed as the resulting color/brightness gamut 310 of a red/green/blue/white color display projected onto the red/green color plane with the blue color vector projected coincidentally onto the white axis. The maximum saturated red color 320 forms one corner while the maximum green saturated color 330 forms another corner of the color gamut. When all of the colored primaries, the red, green, blue (not shown for clarity) and white primaries, are turned on to their maximum value of five units the result is the maximum desaturated color, white, results with a value of ten units 360. The color gamut 310 has additional corners that result from the vector addition of red and white primaries 325 as well as the vector addition of green and white 335. The space inside of the color gamut 310 may be formed from a number of metameric vector combinations of red, green, and white (or red, green, blue, and white for an RGBW system) values.

Figure 3B:
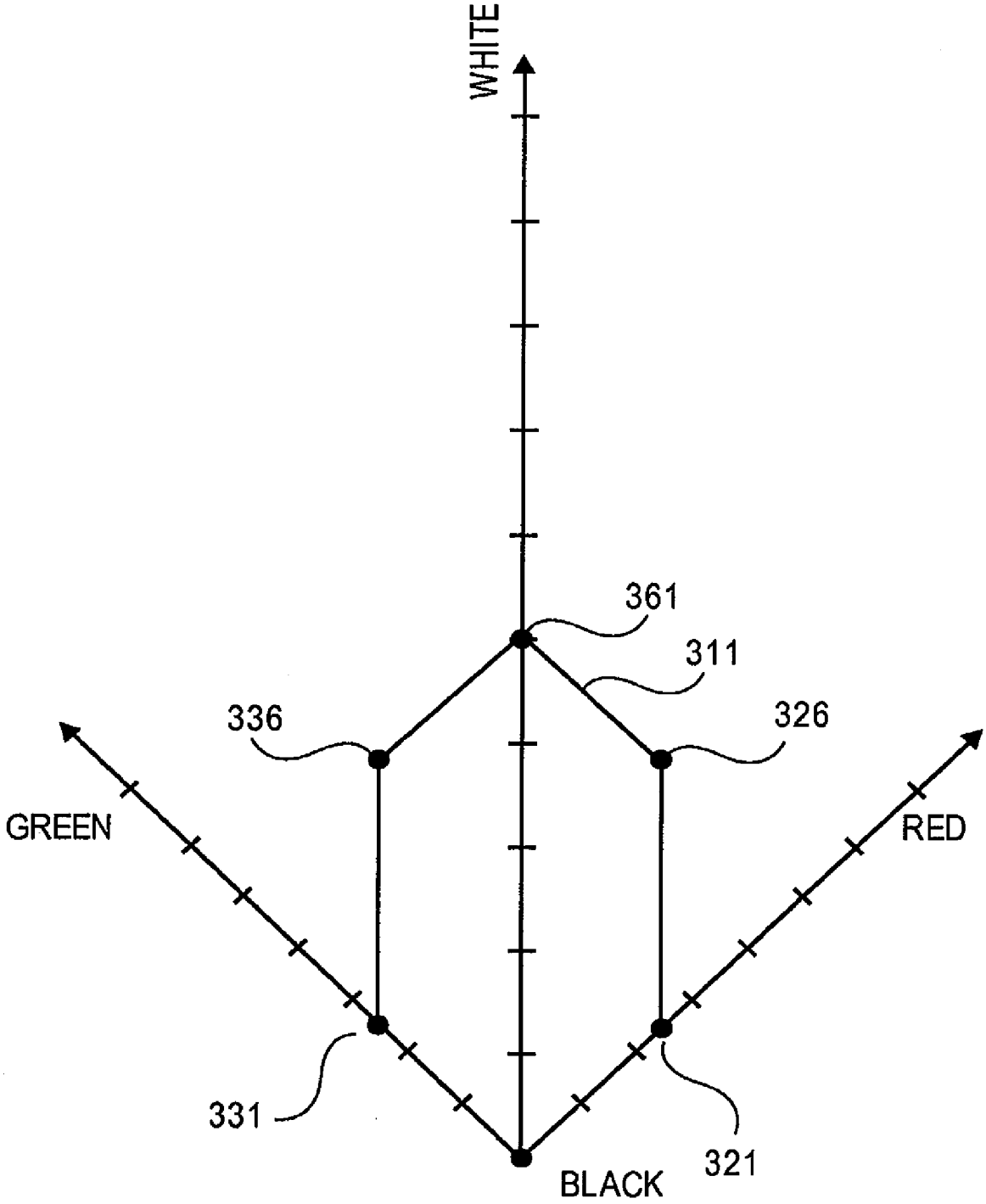
FIG. 3B shows the diagram of FIG. 1A and the color gamut hull formed by the vector addition of three color vectors with half of the value of those shown in FIG. 3A.

Note that the maximum value of the color gamut 310, of the red/green/blue/white display, at ten units of white, is twice that of the red/green/blue display of FIG. 2 at only five units. Thus, for a given specified maximum white brightness required for a given display the backlight energy may be reduced to half that for an RGBW compared to an RGB display. FIG. 3B shows the resulting color/brightness gamut 311 of such an RGBW display that has the backlight reduced by half, resulting in the primaries each having half their previous values. The maximum saturated red 321 and green 331 are two and half (2.5) units. The additional corners that result from the vector addition of red and white primaries 326 as well as the vector addition of green and white 336 are each reduced in half. The maximum white point 361 value is reduced in half at five units.

Figure 3C:
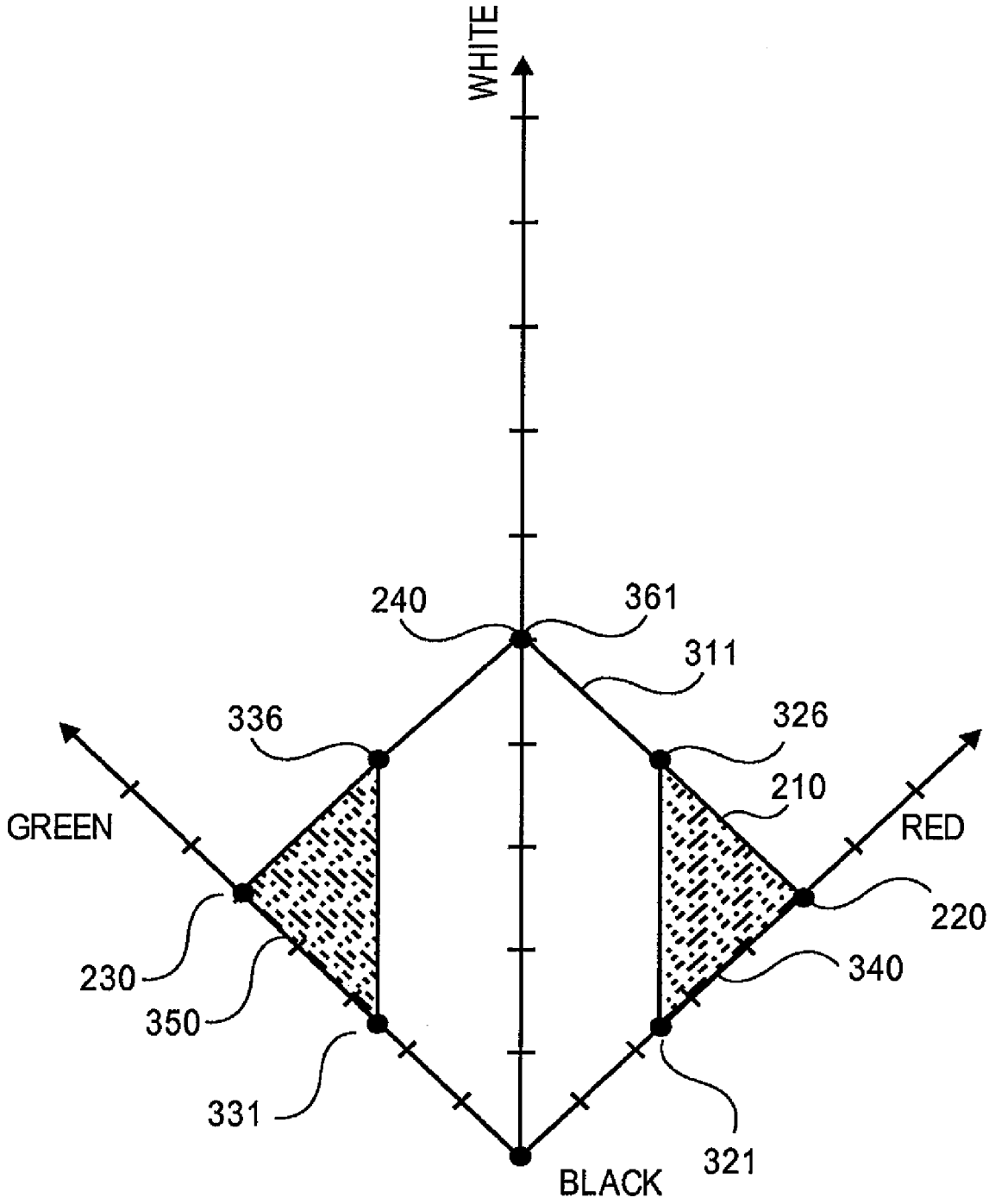
FIG. 3C shows the diagram of FIG. 1A and the half sized gamut hull of FIG. 3B overlaid onto the color gamut hull of FIG. 2.

FIG. 3C shows the color gamut 311 of the reduced brightness RGBW of FIG. 3B superimposed on the RGB color/brightness gamut 210 of FIG. 2. Note that the maximum RGBW value 361 is the same as the maximum RGB value 240 are the same. Thus for monochromatic (black & white) images the reduced RGBW gamut 311 allows for faithful color and brightness reproduction. However, note that there are some colors 340 & 350 that are in the color/brightness gamut 210 of the RGB display that may not be reproduced in the RGBW color/brightness gamut 311. These missing colors 340 & 350 are the bright saturated colors. Methods of gamut mapping these missing "Out-Of-Gamut" (OOG) colors 340 & 350 to the available RGBW gamut 311 are disclosed in co-owned applications US2005/0083341; US2005/0225561; US2005/0225562 and US2006/0244686 and incorporated herein by reference. The present invention is a method of adjusting the backlight, and in some embodiments, in conjunction with gamut mapping to recover some or all of these otherwise missing OOG colors 340 & 350.

Figure 4A:
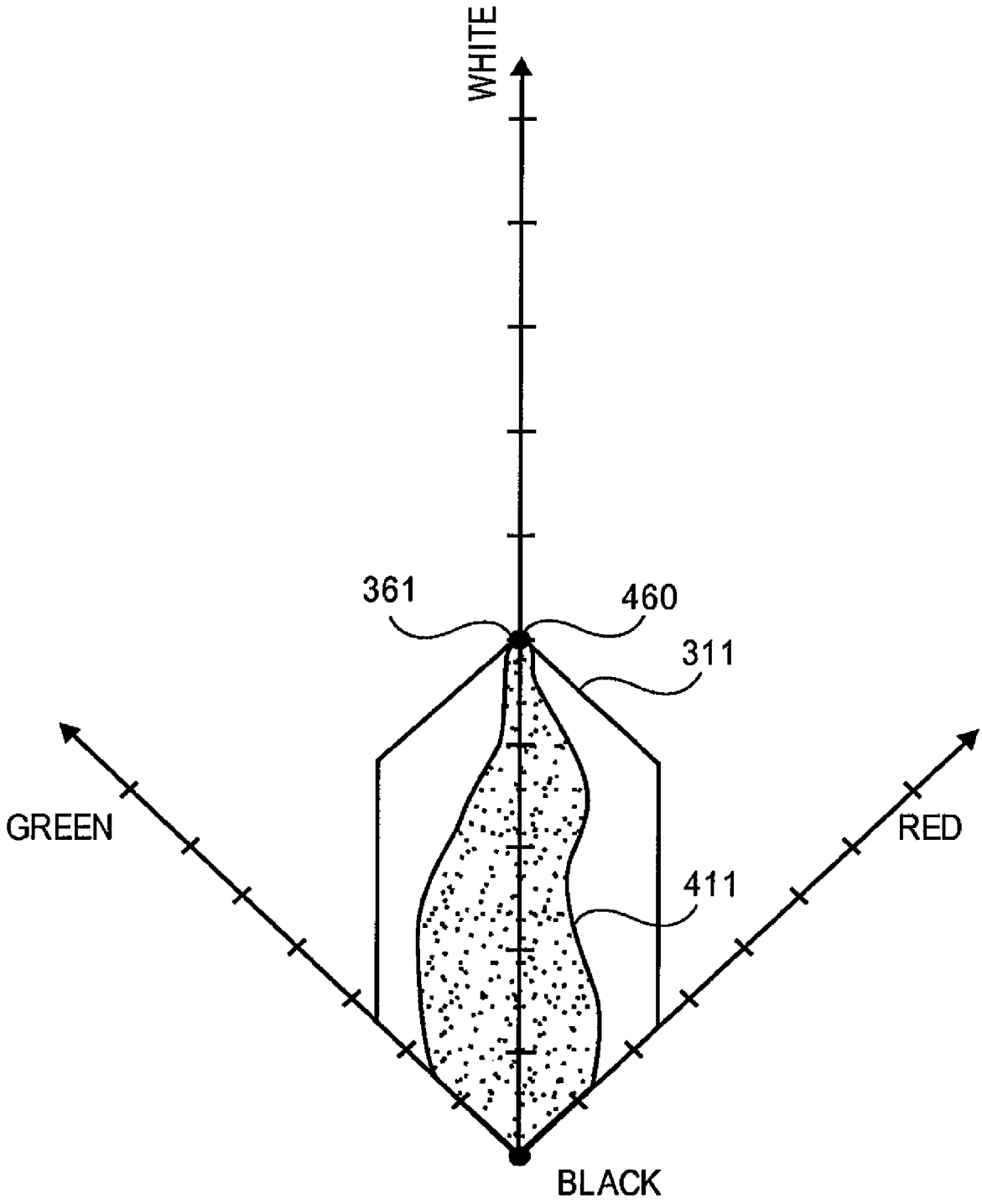
FIG. 4A shows the color brightness gamut of a representative image that has full brightness white colors but no bright saturated colors, fitting inside of the half sized gamut hull of FIG. 3B.

FIG. 4A shows the RGBW display color/brightness gamut hull or shape 311 fully enclosing a representative image color/brightness gamut hull or shape 411. The brightest white 460 of the image is identical to the brightest white 361 of the RGBW gamut. Since all of the colors used in the image fall within the color/brightness gamut 311 of the RGBW display with its half power backlight, no OOG mapping or backlight adjustment would be needed. In contrast, examining FIG. 4B, while the brightest white 461 is within gamut, portions 440 & 450 of the color/brightness gamut hull or shape 411 of another representative image exceeds the RGBW color/brightness gamut 311. However, if the brightness of the backlight is adjusted, increased, the RGBW display color/brightness gamut 410 may be increased sufficiently to contain all of the representative image color/gamut 411.

Figure 4B:
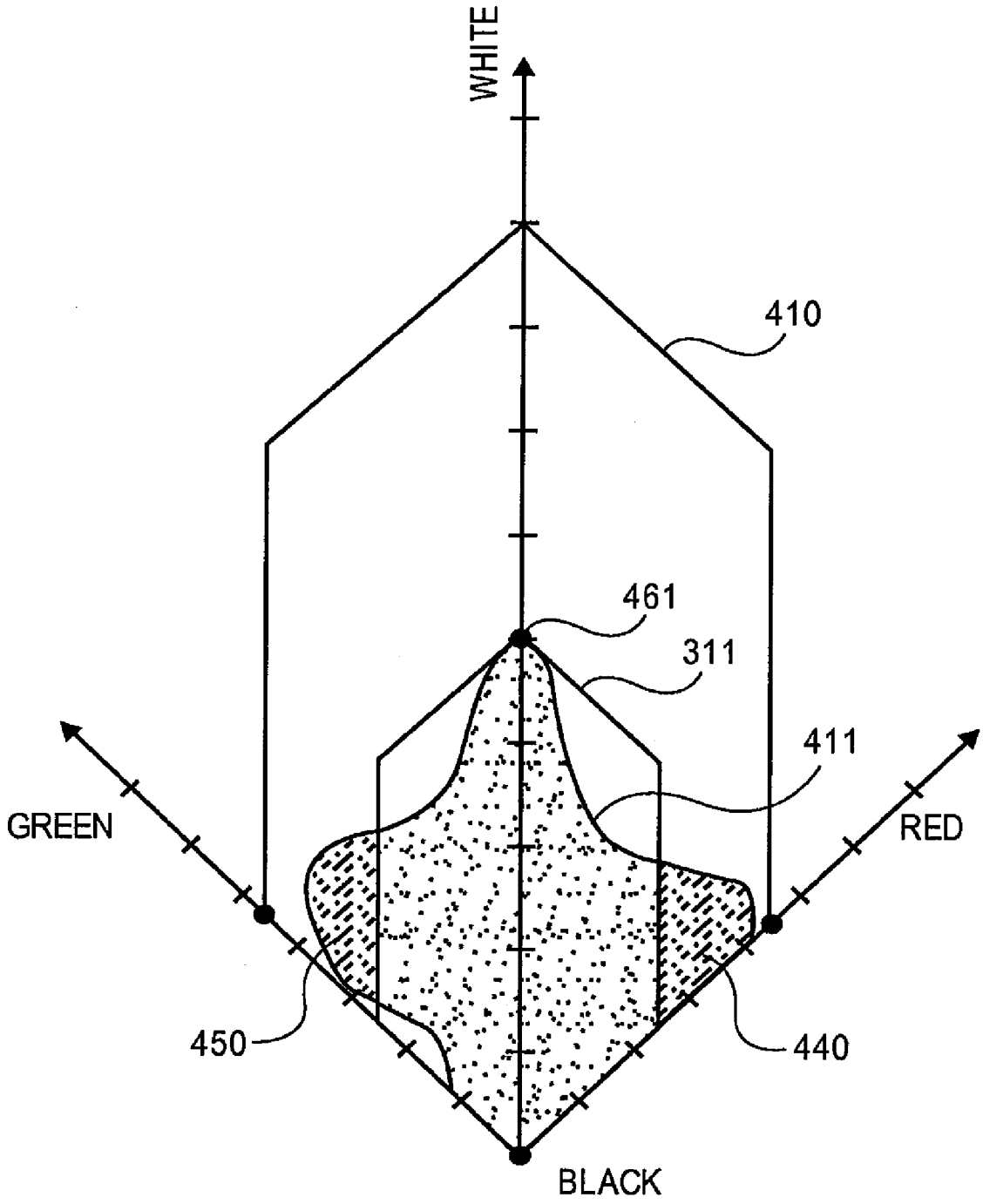
FIG. 4B shows the color brightness gamut of a representative image that has full brightness white colors and bright saturated colors, not fitting inside the half sized gamut hull of FIG. 3B until the hull is expanded by increasing the brightness of the display backlight.
Figure 4C:
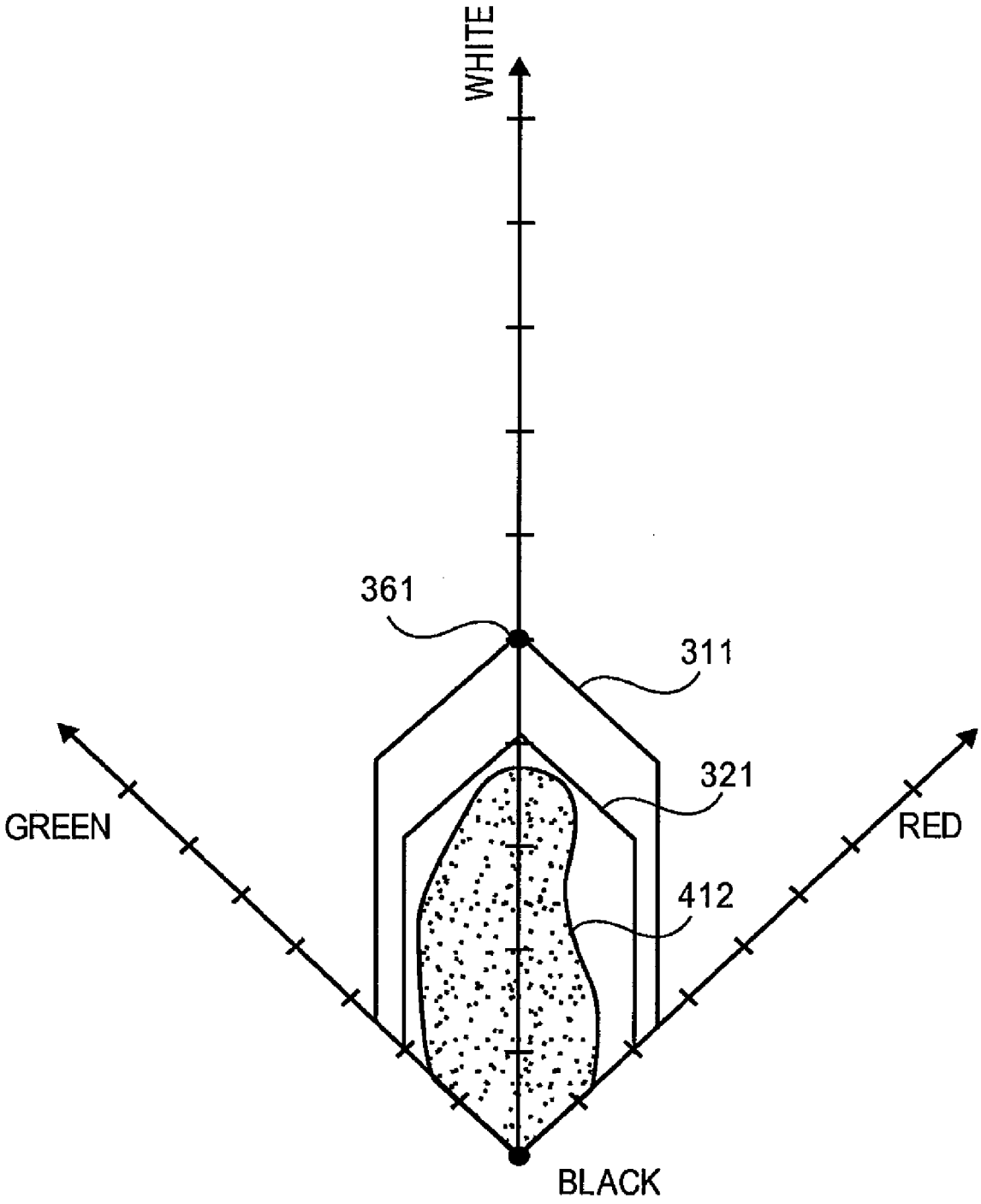
FIG. 4C shows the color brightness gamut of a representative image that has low brightness white colors and no bright saturated colors, allowing a smaller gamut hull and decreased brightness of the display backlight to accommodate the image.

FIG. 4C shows another situation where the input image is dark and has a gamut 412 that lies completely inside the RGBW gamut 311. In this case the backlight brightness can be reduced lower than half way. This would result in a smaller gamut 412 that still encloses all the colors in the image gamut. This can be used to further reduce backlight power requirements when dark images are displayed.

Figure 5:
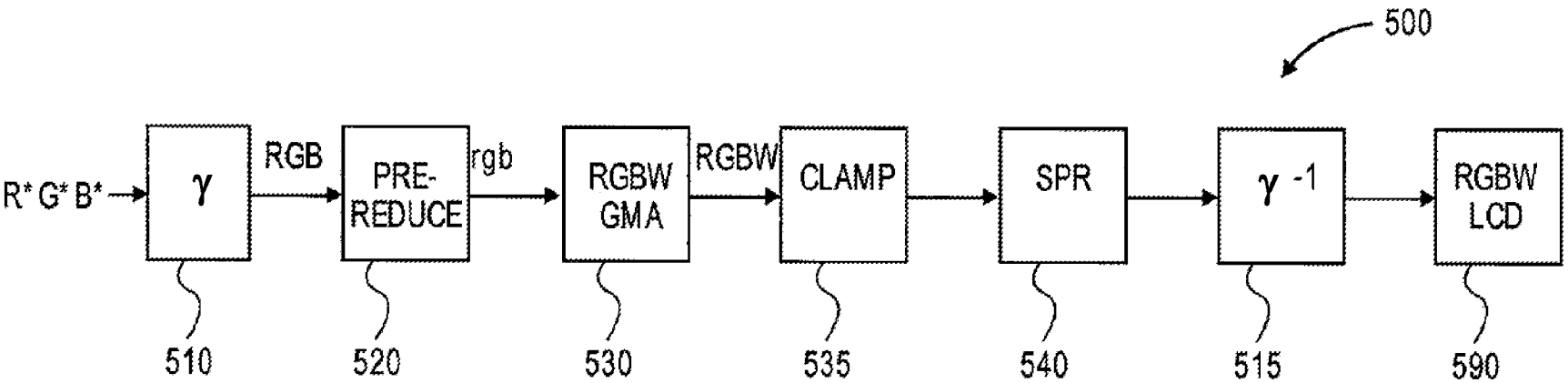
FIG. 5 shows a block diagram of an exemplary subpixel rendered RGBW display system.

FIG. 5 is a block diagram of one embodiment of an image processing pipeline. Perceptually quantized R*G*B* data of a given binary bit depth is linearized by the Gamma function 510, usually a Look-Up Table (LUT) to be a greater binary bit depth linearly encoded RGB signal. Because of the need to map colors from the RGB color space to the differently shaped RGBW color/brightness gamut, the RGB color data values are adjusted in a PreReduce function 520 as further discussed below. The adjusted RGB color data is converted to RGBW color data in the RGBW GMA 530 function block. Depending on the adjustments made in the PreReduce function 520, the resulting RGBW color data may include OOG colors. These possible OOG colors may be clamped to the RGBW color/brightness gamut hull in the Clamp function 535. The clamping operation may be 'clamp-to-luminance', 'clamp-to-black', or 'clamp-diagonal', as is described in WO2007047537 and herein incorporated by reference. The clamped RGBW data is subpixel rendered by the SPR function 540. Because the target LCD 590 may have a non-linearly quantized electro-optical transfer function, the linear subpixel rendered data is non-linearly quantized to match the LCD by the Inverse Gamma function 515. This function may or may not be the inverse of the input Gamma function 510.

First Embodiment

The present application will herein disclose various embodiments of systems and methods—for merely a few examples—in regards to FIGS. 6A through 6E, 8A through 8E, 9A through 9B, 11, 28 through 30 as block diagrams of systems. Other Figures detail methods and their operations. Many of these embodiments comprises a plurality of modules and means to provide effect dynamic gamut mapping and backlight control. It will be appreciated that many of these modules and means are optional and that some of the features that these embodiments might share comprise a display system which itself comprises: a transmissive display, said display comprising a plurality of colored subpixels wherein one such colored subpixel is substantially wide spectrum bandpass; a transmissive display controller, said display controller providing signals to said transmissive display to set the amount of transmissivity of each said colored subpixel; a backlight, said backlight providing illumination to said transmissive display; a backlight controller, said controller providing signals to said backlight to modulate the amount of illumination provided by said backlight to said transmissive display; peak surveying module for surveying image data and extracting the image gamut hull for providing intermediate backlight data signals to said backlight controller to match said image gamut hull; and a means for normalizing display image data signals according to said intermediate backlight data signals and providing said normalized image data as intermediate display data. As should be appreciated, in many of the embodiments disclosed herein, there are signal paths that supply signals to the backlight and a display. In the discussion below, intermediate signals are produced by any of the intervening blocks and/or processing methods that are between the input image signal and the final signals that are sent directly to the backlight and display themselves.

Pre-Reduction Algorithms

One possible side effect of RGB to RGBW GMAs may be to reduce the total number of color states that a display system can produce. It may be possible that as many as half of the total number of input colors are mapped onto other colors. This might tend to happen to colors that are both high-brightness and high saturation at the same time, a combination that does not typically occur in natural and unmodified images. However, it might be desirable to have a mode where the total number of colors output by our GMA matches the number of colors that arrive. As noted above, Pre-reduction is one way to accomplish this.

In the case where the RGB gamut is essentially scaled until the input RGB white point is mapped onto the RGBW white point. The high brightness+high saturation colors in the shaded areas become out-of-gamut and may be mapped to allowed RGBW values using clamp-to-black, clamp-to-luma, clamp-diagonal or other algorithms. By a pre-reduction of the input values, eventually the entire RGB gamut may fit inside the RGBW gamut. In such a case, it may obviate the step of OOG mappings. Although the resulting images may not be as bright as before, there are actually more total output states used. Not all possible W values may be used, but all possible RGB output values may be, which may not be the case when some colors are OOG.

In the case of some layouts, pre-reducing the input values by one half may make the RGB gamut fit inside the RGBW gamut. Reducing by other desired amounts may be desirable for layouts when the brightness of the W sub-pixel may not exactly equal the brightness of the other 3 sub-pixels. Also, pre-reducing by desired amounts smaller than one half may increase the total number of output states somewhat, even though some colors will still go OOG. Even in displays with the W sub-pixel brightness equal to the other three primaries, this procedure may increase the brightness of the image and be desirable.

In one embodiment, the input RGB values may be pre-reduced until no OOG values result. Then the normal RGBW GMA may be used to convert to RGBW. Finally, the W values may be scaled up by an amount that makes the largest W value (usually from bright saturated colors near white) hit the maximum value. In one case, the input RGB values have been pre-reduced by half, and then the resulting W values have been scaled up by a factor of 2. This may result in a maximum brightness of about 75% of the maximum possible. Other combinations may produce brighter maximum values, for example reducing the input by a percentage smaller than one half. However, these combinations may produce more OOG colors and decrease the total number of output states.

A Pre-reduction module may be implemented between an input gamma module and GMA module. In such an embodiment, a percentage may be stored as a fixed point binary number in a Pre-reduce register. The pre-reduce register may be 8 bits big and may store a number between 0 and 255, representing a fixed point number between 0 and approximately 0.996. Each of the input RGB values after input gamma may be multiplied by the pre-reduce value, then divided by 256 in right shift modules (e.g. >>8).

In another embodiment, instead of using a multiplier, the input values may be shifted right by different amounts, and the results are added together in different combinations to produce 100% of the input (no reduction), 75% (25% reduction), 62.5%, 50% 37.5% 25% and 12.5%. Instead of storing a fixed point binary number in the pre-reduce register, an index may be stored that selects one of the pre-calculated percentages using a MUX. This set of percentages is only one example. By adding more shifters, adders, and a wider multiplexor, any number of selectable reduction percentages can be produced.

Saturation-Based Pre-Reduction

As another alternate embodiment of pre-reduction, the input RGB values may not be reduced by a fixed amount, but instead by an amount that is a function of saturation. A function which has values near 1.0 when saturation is near zero may have the advantage of mapping the input RGB white value approximately to the output RGBW white value. This may be advantageous over the pre-reduction algorithms above where the maximum possible white value may not be achieved. In another embodiment, the maximum value may be less than 1.0 to reduce simultaneous luminance contrast error. The functions of saturation may decrease to some percentage (Pmax) when saturation is at a maximum. If this Pmax value is larger than the ratio of the brightness of W to the sum of the brightness of the R+G+B subpixels in the display, then there may be some OOG colors. Thus, a gamut clamping module as described above may still be desirable.

One possible curve for this saturation function is a Gaussian, but this may be computationally difficult to implement in hardware. A straight line may be adequate, and a piecewise linear function may also produce pleasing images. The values from this function are multiplied by the input RGB values. Thus, multiplying by 1.0 causes no reduction of the input values with low saturation and multiplying by Pmax or other fractions less than one will result in decreasing input values that have high saturation. All these multiplications by fractional values may be implemented in hardware by multiplying by fixed point binary numbers followed by appropriate right shifts. Other means of implementing multiplication by shifts and adds are also included as part of the scope of the present invention.

Saturation may be considered the perpendicular distance away from the line of grays, typically scaled to range from 0 to 1.0 at the surface of the gamut. Although any number of calculations of saturation could be used, there are approximations to calculating this number which are well known in the industry, for example;

$$\text{Saturation}=(\max(r,g,b)-\min(r,g,b))/\max(r,g,b)$$

The resulting saturation value may then used to generate one of the curves. The piecewise linear line, for example, with a Pmax value of 0.75 may be generated by the following equation:

$$\text{Pre_reduce}=\min(1,1-((\text{Saturation}-0.25)/(1-0.25)))$$

Then the input red green and blue values may be each multiplied by such a Pre_reduce value, as generated by any of the above embodiments:

$$R=R*\text{Pre_reduce}$$

$$G=G*\text{Pre_reduce}$$

$$B=B*\text{Pre_reduce}$$

Finally, these RG and B values may be run through a GMA algorithm to convert RGB to RGBW. Other embodiments of a pre-reduce function are discussed in WO 2007/047537 and incorporated herein by reference.

In yet another embodiment, the pre-reduction function may also be made a function of hue. Faces and other skin tones, for example, have a very narrow range of hue and it may be advantageous to use a different pre-reduction function on images with these features. In yet another embodiment, the pre-reduction saturation function may also be made a function of brightness. So for a given saturation value, rather than using a constant scaling value, one would scale based on the proximity to BLACK. This would act like a gamma function, and it allows one to shift the output pixel distribution closer (or farther) to the RGBW gamut hull. It should also be appreciated that the pre-reduction function could be based as a function of some combination of hue, saturation and brightness.

In the discussion above, one embodiment might have only one pre-reduction function for all primaries. It may be desirable, however, to have a separate pre-reduction function for each (or a subset) of the input R G and B primaries. This could add the ability to do color correction or adjust the white point of the display.

It is possible to place pre-reduction in many places in the image processing system, such as before an input gamma module. Because the values before input gamma typically have a smaller bit-size, this may have the advantage of decreasing the gate count of hardware based on this design. In addition, it is possible to combine the pre-reduction functions with the input gamma function, performing the gamma correction and the pre-reduction in one step. Because the input gamma function is often implemented as a look-up-table that is pre-calculated, it may then be possible to use other algorithms, such as a Gaussian curve without paying a penalty in more complicated hardware.

Figure 6A:
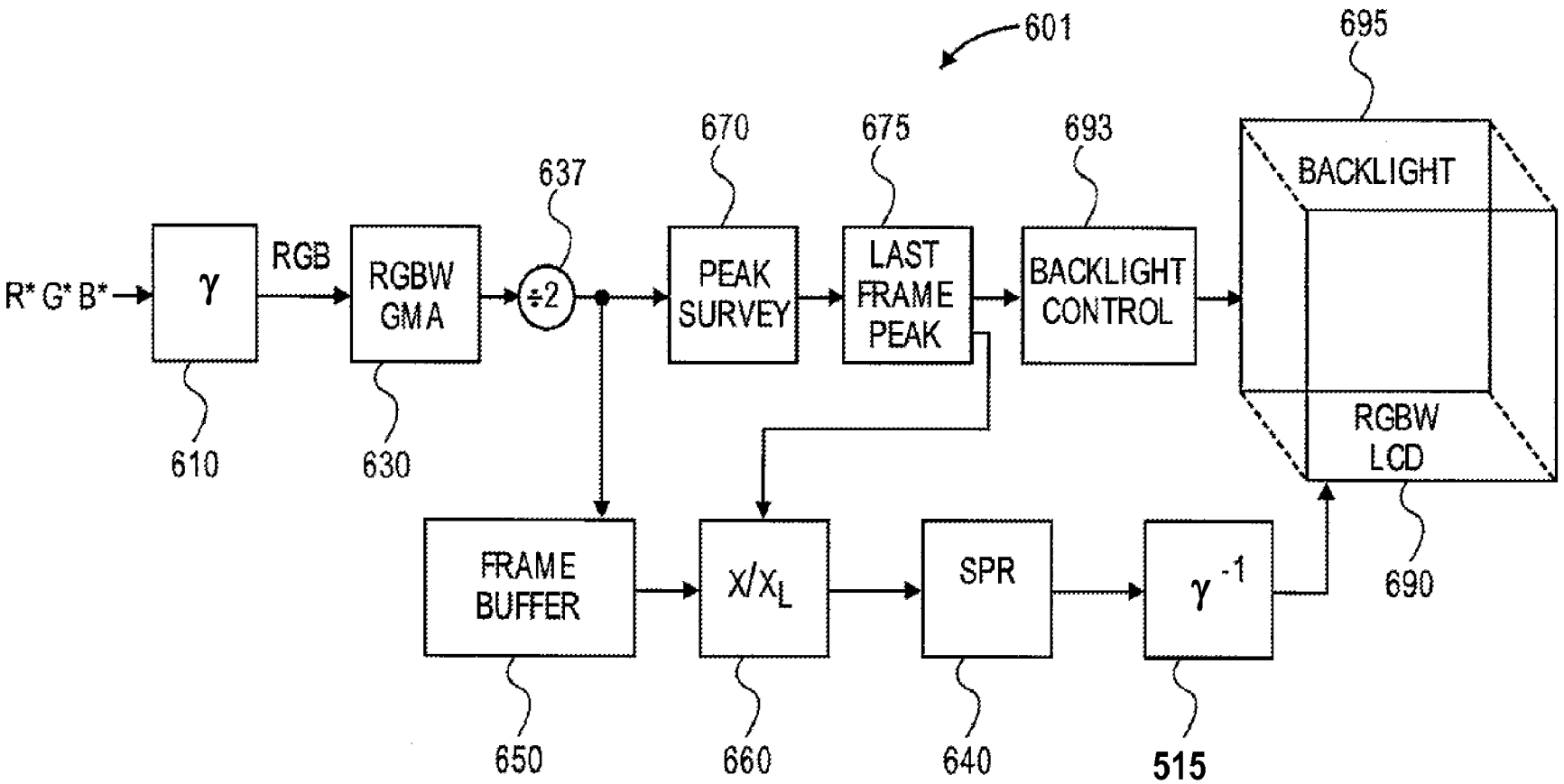
FIG. 6A is a block diagram of an embodiment of the present invention that dynamically adjusts the gamut hull.

With reference with to FIG. 6A, FIG. 6A shows a block diagram 601 of another embodiment of the present invention. Block diagram 601 is suitably modified to allow the backlight 695 brightness to be adjusted in response to the image color/brightness gamut and to adjust the RGBW color data to maintain constant brightness in spite of the varying backlight 695 brightness. Perceptually quantized R*G*B* data of a given binary bit depth is linearized by the Gamma function 610 to be a greater binary bit depth linearly encoded RGB signal. The RGB color data is converted to RGBW color data in the RGBW GMA 630 function block. Without pre-reduction or clamping, the RGBW color data may contain OOG colors whose red, green, or blue value may exceed the maximum allowable value by two times if the RGBW gamut system provides twice the brightness as an RGB display with the same backlight. Thus, the RGBW may be scaled down, for example divided in two by a simple binary right shift function 637. This value may not be a factor of two if the gain factor for a given RGBW display is other than two. In such cases, the divisor may be set to the RGBW display gain. This divide-by-two operation 637 may result in loss of some precision which can be avoided by doing it elsewhere in the pipeline, for example in the $X/X_L$ module 660. This may be accomplished by storing or processing an extra bit in frame buffer 650 and peak survey module 670.

To ensure that the backlight 695 is set to the minimum brightness needed to just enclose the image color/brightness gamut hull or shape, the scaled down RGBW color data in a given frame may be surveyed to find the peak value by the Peak Survey function 670. This function detects and extracts the maximum primary value, R G B or W in the entire frame.

This peak value may be used by the Last Frame Peak function 675 to calculate the backlight and normalization values to be used in the next frame period, as will be discussed in reference to FIG. 6E. This backlight calculation from the previous frame period may be used by the Backlight Control function 693 to actively control the Backlight 695 brightness. Meanwhile the scaled down RGBW may also be stored in the Frame Buffer 650 to be used in the next frame period. Thus, the image displayed may possibly be one frame behind the current. During the current frame period, scaled down RGBW from the previous frame period may be fetched from the Frame Buffer 650 to be compensated, normalized by the value from the Last Frame Peak from the previous frame period in $X/X_L$ normalizing function 660.

The $X/X_L$ normalized RGBW data is subpixel rendered by the SPR function 640 possibly using methods disclosed in many of the above incorporated applications. Because the target LCD 690 may have a non-linearly quantized electro-optical transfer function, the linear subpixel rendered data is non-linearly quantized to match the LCD by the Inverse Gamma function 515. This function may or may not be the inverse of the input Gamma function 610.

Figure 6B:
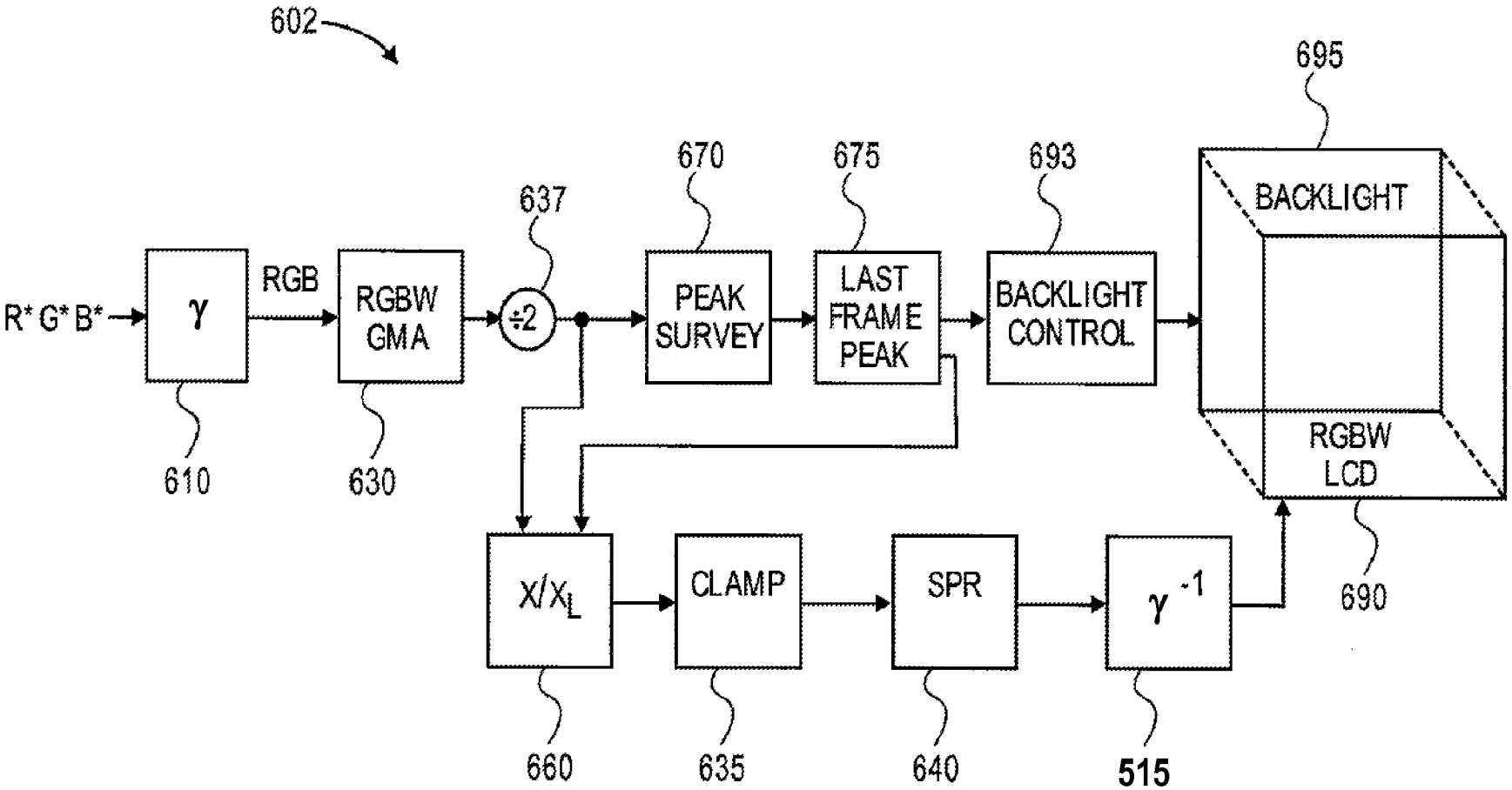
FIG. 6B is a block diagram of an alternate embodiment of the system of FIG. 6A that may use less gates to implement.
Figure 6C:
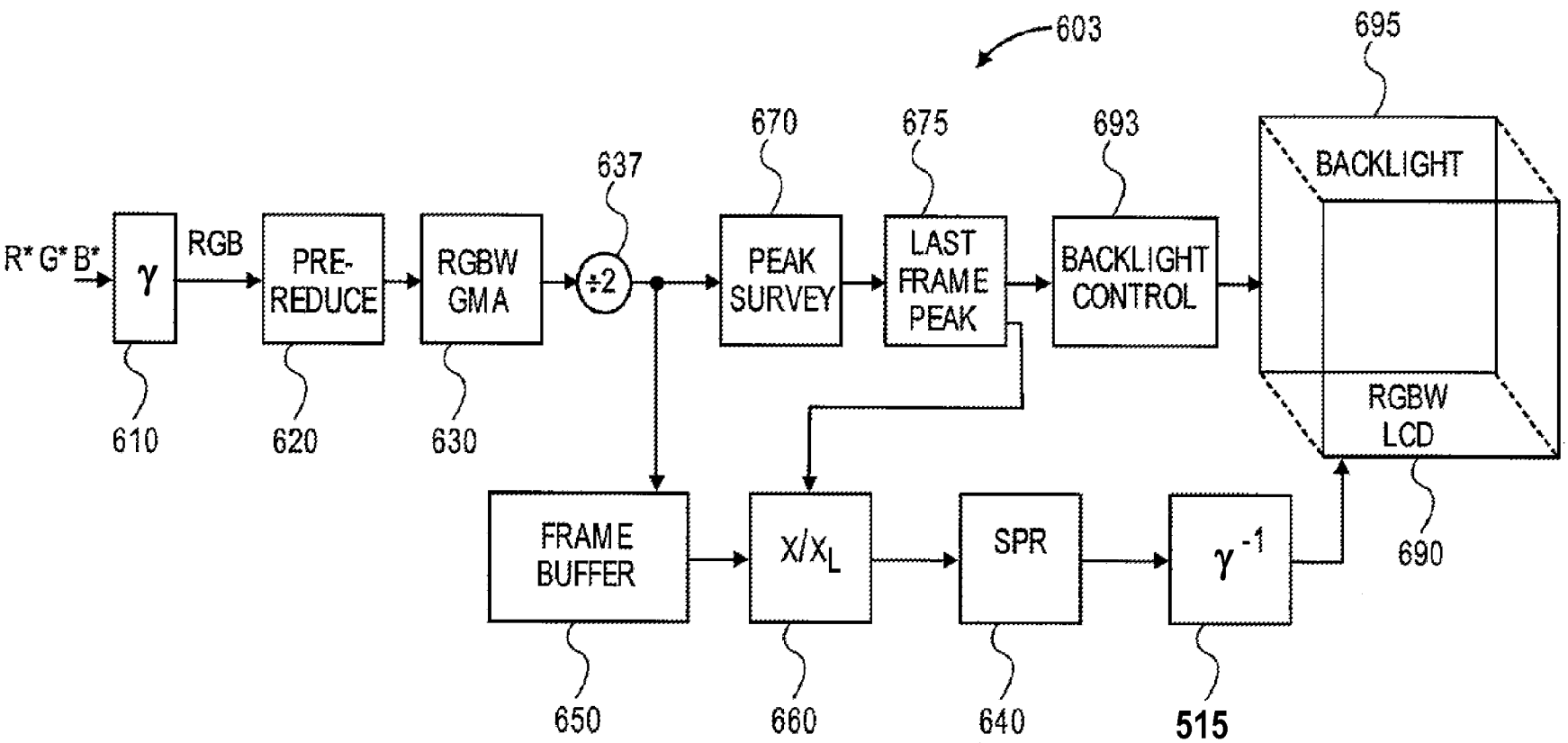
FIG. 6C is a block diagram of an alternative embodiment of the system of FIG. 6A that adds a pre-reduction module that may decrease backlight power usage.
Figure 6D:
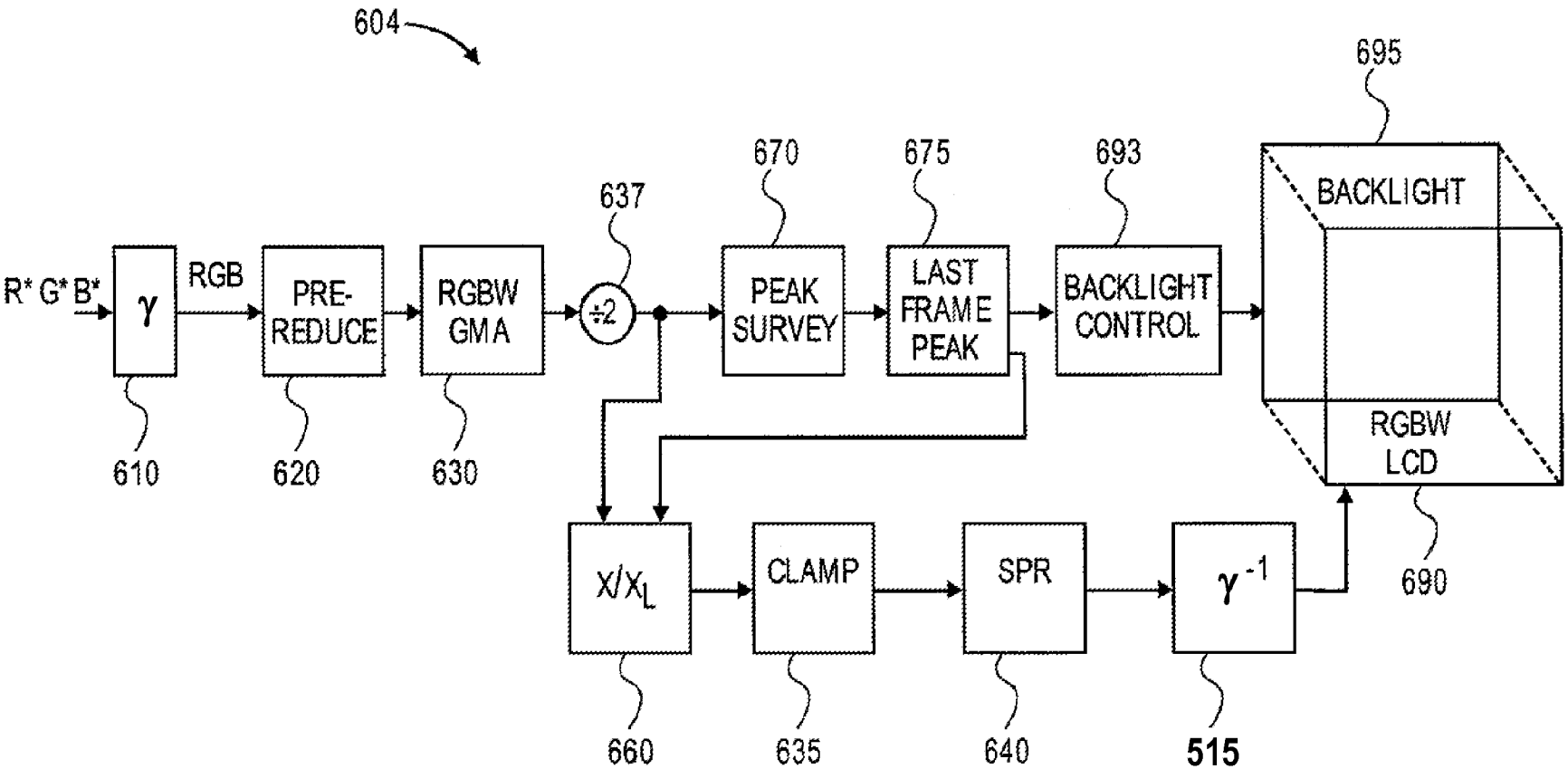
FIG. 6D is a diagram of an alternate embodiment of the system of FIG. 6C that may use less gates to implement.
Figure 6E:
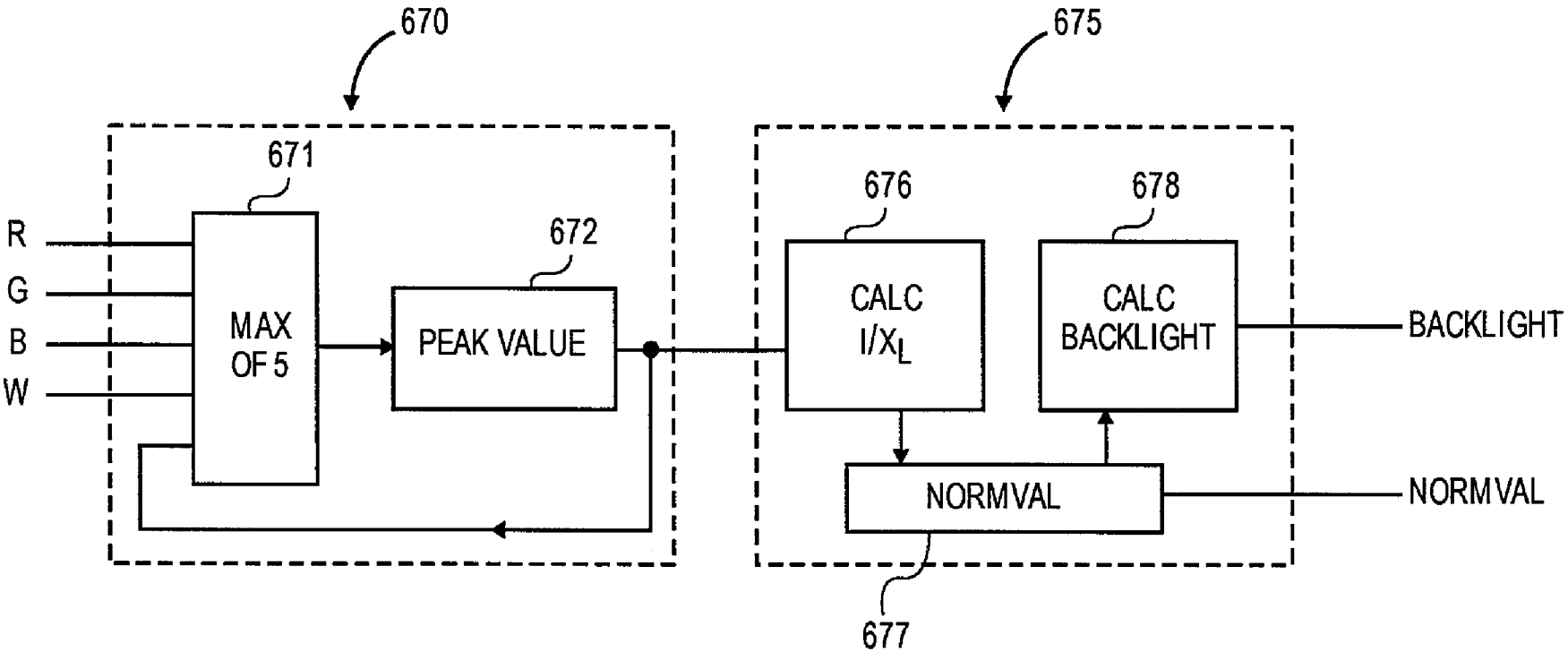
FIG. 6E is a block diagram of the color peak survey and last frame peak modules of FIGS. 6A, 6B, 6C and 6D

Additional details of the Color Peak Survey function 670 and Last Frame Peak function 675 are shown in FIG. 6E. Inside Color Peak Survey function 670, there is a Peakval register 672 that contains the largest primary value seen in the current frame. This register may be cleared to zero at the start of every frame. For every pixel in the frame, Max Of 5 comparator 671 compares the R G B W input signals and the current peakval and may choose the largest of these 5 values. That largest value may be stored back in peakval register 672. At the end of each frame Last Frame Peak function 675 calculates the color gain and backlight values. The $X/X_L$ normalizing function 660 in FIGS. 6A, 6B, 6C, & 6D may divide each RGBW value by the peak value. A division operation is computationally expensive in time and gates and it may be desirable to replace this division with a multiplication. This may be done by inverting the peakval signal in CALC $1/X_L$ function 676 and storing the result in NORMVAL register 677 which is used as a multiplier in later operations. The inversion may be done by performing a division since there is plenty of time in the vertical retrace interval of a display. Alternately the inversion may be performed by storing all possible values in a LUT.

When the peakval is zero, the NORMVAL may be set to zero. When the NORMVAL is between 0 and one, it may be stored as a fixed point binary number. This is the case of FIG. 4B where the backlight is increased and the RGBW values are decreased to compensate. It may be desirable to store this value as a fixed point binary number for ease of implementation in hardware. The number of bits used may determine how much quantization error is introduced in the inversion calculation. A method of preventing this quantization error from affecting the image will be described below. The NORMVAL can also range between 1 and the maximum in-gamut color. This is the case of FIG. 4C when the backlight is decreased and the RGBW values are increased to compensate. In this case the stored NORMVAL in a hardware implementation may be an integer value that contains at least the same number of bits as the maximum in-gamut color. Quantization error may be reduced by including extra bits below the binary point. Because the two cases of FIGS. 4B and 4C are different in this way, it may be advantageous to split the processing into two paths such as will be shown in FIG. 9A. The backlight value is proportional to the peakval from the previous frame. One way to calculate this would be to simply scale the peakval to the range of the backlight controller. However, quantization error in the calculation of NORMVAL will cause discrepancies between the normalization of RGBW values and the brightness of the backlight. These errors may be substantially eliminated by calculating the backlight value from the NORMVAL after the quantization has occurred. This may be accomplished by inverting the NORMVAL again with a division or a LUT in Calc Backlight function 678. The same divider circuit or the same LUT could be used to do both inversions. The result of this quantization and second inversion may be that the backlight may not use all the possible values in its range, but the values that are used may always be the ones that have no quantization error. Increasing the number of bits in NORMAL may increase the number of brightness steps used in the backlight.

Because frame buffer memory requires many gates, increasing the area used in a silicon integrated circuit, possibly increasing the cost beyond what may be considered economically viable in a given product, it may be desirable to have a system that does not require a frame buffer. For another embodiment, the block diagram 602 in FIG. 6B is similar to the block diagram 601 in FIG. 6A, save that it has been modified to eliminate the Frame Buffer function 650. Perceptually quantized R*G*B* data of a given binary bit depth is linearized by the Gamma function 610 to be a greater binary bit depth linearly encoded RGB signal. The RGB color data is converted to RGBW color data in the RGBW GMA 630 function block possibly using methods disclosed in many applications referenced above.

Without pre-reduction or clamping, the RGBW color data may contain OOG colors whose red, green, or blue value may exceed the maximum allowable value by two times if the RGBW gamut system provides twice the brightness as an RGB display with the same backlight. Thus, the RGBW may be scaled down, for example divided in two by a simple binary right shift function 637. This value may not be a factor of two if the gain factor for a given RGBW display is other than two. In such cases, the divisor may be set to the RGBW display gain. This divide by two operation 637 may result in loss of some precision which can be avoided by doing the divide later in the pipeline, for example in the $X/X_L$ module 660. This would require storing or processing an extra bit in peak survey module 670 and last frame peak storage 675. To ensure that the backlight 695 is set to the minimum brightness needed to just enclose the image color/brightness gamut, the scaled down RGBW color data in a given frame is surveyed to find the peak value by the Peak Survey function 670. This peak value is used in the Last Frame Peak function 675 to calculate and store the backlight and normalization values to be used in the next frame period. The backlight value from the previous frame period is used by the Backlight Control function 693 to actively control the Backlight 695 brightness.

Meanwhile the scaled down RGBW may also be compensated by the normalization value from the Last Frame Peak from the previous frame period in $X/X_L$ normalizing function 660. The $X/X_L$ normalized data may still have OOG color values, including in the W, the white, channel if the peak value from the previous frame period is less than that of the current frame period. The normalized color data is clamped to the RGBW color/brightness hull by the Clamp function 635. It may be desirable to use 'clamp to luminance'. By clamping to the closest luminance value available, the luminance error during the current frame period may be minimized, possibly at the expense of the color saturation. If the next frame period's image is the same as the current, as often happens, then the colors that are clamped during the current frame period may be substantially realized during the next frame period. Since the Human Vision System recognizes luminance faster than color saturation, the error may not be noticed by the casual viewer. The normalized and clamped RGBW data may then be subpixel rendered by the SPR function 640. Because the target LCD 690 may have a non-linearly quantized electro-optical transfer function, the linear subpixel rendered data may be non-linearly quantized to match the LCD by the Inverse Gamma function 515. This function may or may not be the inverse of the input Gamma function 610.

The performance of the systems described in the block diagrams 601 & 602 in FIGS. 6A & 6B tends to allow that all colors in the RGB gamut are substantially reproduced in the RGBW display. It also tends to save power when displaying images that are either all dark, or have no bright saturated colors. For example, consider the representative image color/brightness gamut 410 shown in FIG. 4A. This image has bright white colors 460 but the backlight need only be set to half brightness, thus also at half power. Another example, not shown, would be pure black & white images, such as text. This type of image would also use only half power. This may have advantage for applications where the power is from batteries whose power drain may be kept to a minimum to extend the time between recharging. Further, the power may be less than half if the image has a smaller color/brightness gamut such as shown in FIG. 4C. The worst case power would be full brightness on the backlight when a bright saturated color is present in the input image. For example, consider the representative image color/brightness gamut 411 in FIG. 4B. This image has bright saturated colors that require the backlight to be nearly full power.

Figure 7A:
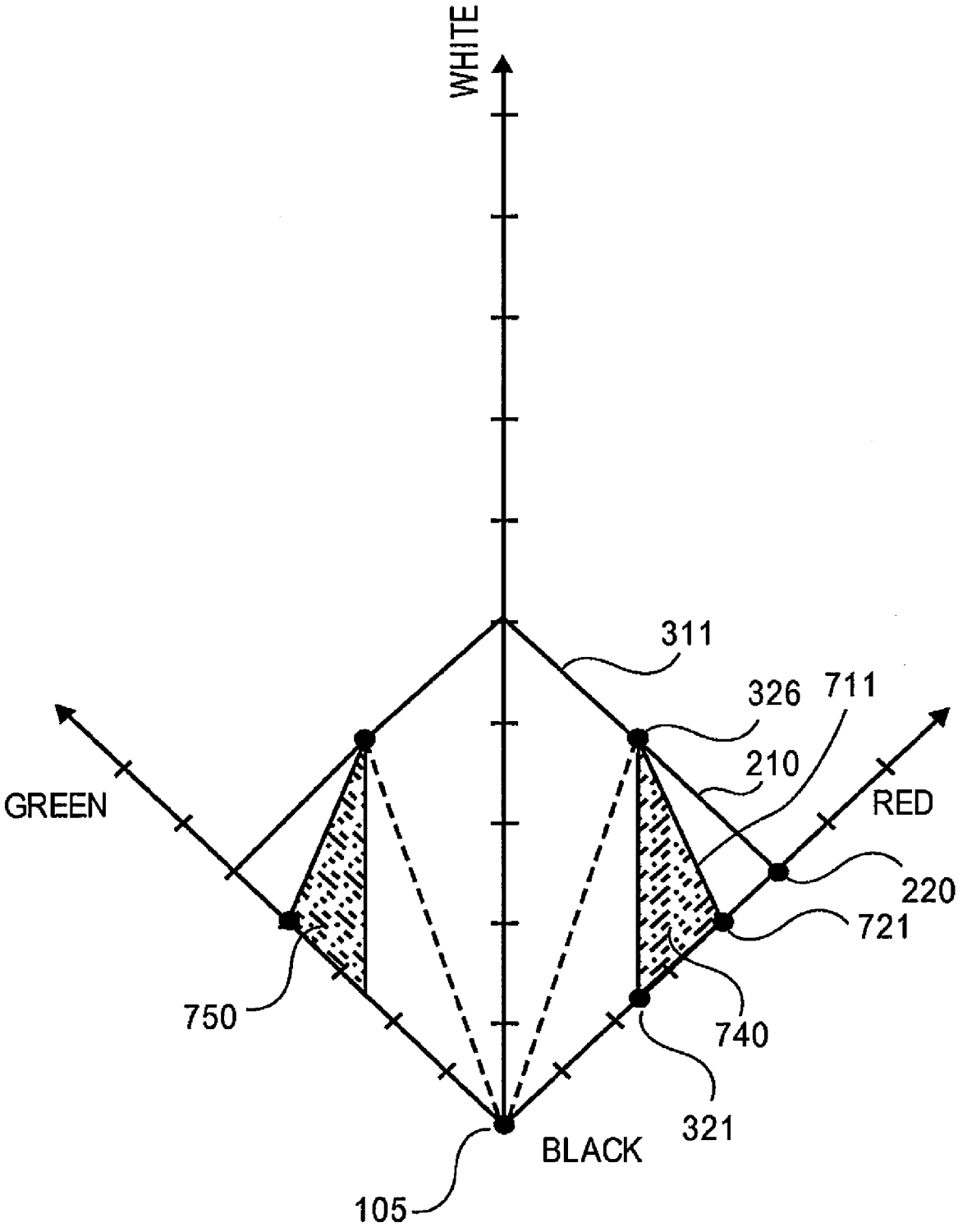
FIG. 7A depicts how pre-reduction may tend to decrease the gamut of an input image.

It may be desirable in some applications to reduce the power further by limiting the brightness of all or some of the saturated colors. The addition of a Pre-Reduce function block may be one method of achieving this. A block diagram of this embodiment is shown in FIG. 6C. This is similar to FIG. 6A but with the addition of PreReduce module 620. Similarly, FIG. 6D is the diagram of FIG. 6B with the addition of a PreReduce module 620. For example, referring to FIG. 3C, if the OOG colors 340 & 350 are reduced in brightness, this would reduce the amount of power required to display images with those colors in their color/brightness gamuts. Additionally, consider color/brightness diagram in FIG. 7A. It shows the RGBW color/brightness gamut hull 311 overlaid on the original RGB color/brightness gamut hull 210. In this case, the saturated colors may all be darkened. For example, the colors in the triangle defined by Black 105, the brightest saturated red 220, and the mid saturation red 326 may all be darkened toward Black 105, resulting in the triangle defined by Black 105, a given brightness saturated red 721, and mid saturation red 326. The green and the blue (as well as yellow, cyan, and magenta) may also be reduced in this fashion. After this operation, fewer colors are found to be Out-Of-Gamut 740 & 750 for scaled RGBW gamut 311. As previously discussed above, in one embodiment, the pre-reduce block may calculate the saturation of the color to be render, then decreases the luminosity of the color as a function of the saturation.

There may be some disadvantages to pre-reduction. For example, the shape of the color-brightness gamut hull may be altered, with both desirable and sometimes undesirable consequences. One of these consequences might be that the simultaneous luminance contrast between the brightest white and the brightest saturated colors, especially yellow, is increased, causing color appearance differences when images having both bright white and bright colors are displayed. The color-brightness gamut hull for a conventional RGB, red, green, blue, three-primary display has relative brightness ratios of 30:59:11 respectively. Thus the brightness ratio of white vs. any single saturated primary color would be the sum of red, green, and blue over the brightness of the primary.

However, one important metric may not be the brightness ratio, but the simultaneous luminance contrast, more specifically, the Michaelson Contrast given by the formula (Max-Min)/(Max+Min)=% contrast. Thus, to determine the simultaneous luminance contrast between white and yellow (yellow being the sum of red and green): (100−(30+59))/(100+(30+59))=11/189=5.8%. The worst case for yellow would be to decrease the brightness until it is no longer Out-Of-Gamut. However, this would increase the Michaelson Contrast to 38.4%. The relative change in contrast between the RGB and RGBW contrast is 38.4%/5.8%=6.6 times, or 560% more simultaneous luminance contrast, assuming W=RGB. To put this into perspective, comparing the worst case change of simultaneous luminance contrast between RGB and RGBW systems for the major saturated colors, the change in white to yellow is the greatest, as can be seen in table 1:

TABLE 1

| Color | RGB | RGBW | Relative Change |
|---|---|---|---|
| Yellow | 5.8% | 38.4% | 560% |
| Cyan | 17.6% | 48.2% | 170% |
| Green | 25.8% | 61.4% | 140% |
| Magenta | 39.6% | 66.0% | 60% |
| Red | 53.8% | 73.9% | 37% |
| Blue | 80.2% | 89.6% | 10% |

As can be seen in Table 1, the worst case relative change in luminance contrast in yellow may be far greater than for the other saturated colors. The color appearance of bright saturated yellows may be noticeably different on an RGBW display compared to an RGB display, while the color appearance of the other bright saturated colors may not be objectionably changed, especially blue. Thus, it may be desired to reduce the relatively greater change in simultaneous luminance contrast in the bright saturated yellows while maintaining the benefit of decreased power. Thus, the yellow triangle, the colors between red and green, may be reduced less than the other colors so that when these bright saturated yellow colors occur, more power is used to reproduce these colors, but the red to blue to green colors are reduced more so that when only bright saturated colors in range occur (no bright saturated yellows), the power is reduced.

Adding the Pre-Reduce function block to the system shown in the block diagram 601 in FIG. 6A results in the system shown in the block diagram 603 in FIG. 6C. Perceptually quantized R*G*B* data of a given binary bit depth is linearized by the Gamma function 610 to be a greater binary bit depth linearly encoded RGB signal. The linear RGB is partially scaled down, possibly as a function of both hue angle and saturation to allow brighter saturated yellows than other colors in the Pre-Reduce function 620. The partially pre-reduced RGB color data is converted to RGBW color data in the RGBW GMA 630 function block.

Without complete pre-reduction or clamping, the RGBW color data may contain OOG colors whose red, green, or blue value may exceed the maximum allowable value by up to two times if the RGBW gamut system provides twice the brightness as an RGB display with the same backlight. Thus, the RGBW is scaled down, divided in two by a simple binary right shift function 637. This value may not be a factor of two if the gain factor for a given RGBW display is other than two. In such cases, the divisor may be set to the RGBW display gain. The backlight 695 may be set substantially to the minimum brightness needed to just enclose the image color/brightness gamut, the scaled down RGBW color data in a given frame is surveyed to find the peak value by the Peak Survey function 670. This peak value may be used by the Last Frame Peak function 675 to calculate and store the backlight and normalization values to be used in the next frame period. The backlight value from the previous frame period is used by the Backlight Control function 693 to actively control the Backlight 695 brightness.

Meanwhile, the scaled down RGBW may also be stored in the Frame Buffer 650 to be used in the next frame period. Thus, the image displayed may be one frame behind the current. During the current frame period, scaled down RGBW from the previous frame period may be fetched from the Frame Buffer 650 to be compensated, normalized by the value from the Last Frame Peak from the previous frame period in $X/X_L$ normalizing function 660. The $X/X_L$ normalized RGBW data may then be subpixel rendered. Because the target LCD 690 may have a non-linearly quantized electro-optical transfer function, the linear subpixel rendered data may be non-linearly quantized to match the LCD by the Inverse Gamma function 515. This function may or may not be the inverse of the input Gamma function 610.

Adding the Pre-Reduce function block to the system shown in the block diagram 602 in FIG. 6B results in the system shown in the block diagram 604 in FIG. 6D. Perceptually quantized R*G*B* data of a given binary bit depth may be linearized by the Gamma function 610 to be a greater binary bit depth linearly encoded RGB signal. The linear RGB is partially scaled down, possibly as a function of both hue angle and saturation to allow brighter saturated yellows than other colors in the Pre-Reduce function 620. The partially pre-reduced RGB color data may be converted to RGBW color data in the RGBW GMA 630 function block. Without complete pre-reduction or clamping, the RGBW color data may contain OOG colors whose red, green, or blue value may exceed the maximum allowable value by two times if the RGBW gamut system provides twice the brightness as an RGB display with the same backlight. Thus, the RGBW is scaled down, divided in two by a simple binary right shift function 637.

This value may not be a factor of two if the gain factor for a given RGBW display is other than two. In such cases, the divisor may be set to the RGBW display gain. To ensure that the backlight 695 is set to the minimum brightness needed to just enclose the image color/brightness gamut, the scaled down RGBW color data in a given frame is surveyed to find the peak value by the Peak Survey function 670. This peak value is used by the Last Frame Peak function 675 to calculate and store the backlight and normalization values to be used in the next frame period. The backlight value from the previous frame period is used by the Backlight Control function 693 to actively control the Backlight 695 brightness. Meanwhile the scaled down RGBW is also being compensated, normalized by the value from the Last Frame Peak from the previous frame period in $X/X_L$ normalizing function 660. The $X/X_L$ normalized may still have OOG color values, including in the W, the white, channel if the peak value from the previous frame period is less than that of the current frame period. The normalized color data is clamped to the RGBW color/brightness hull by the Clamp function 635. It may be desirable to use 'clamp to luminance'. By clamping to the closest luminance value available the luminance error during the current frame period is minimized, at the expense of the color saturation. If the next frame period's image is the same as the current, as often happens, then the colors that are clamped during the current frame period will be fully realized during the next frame period. Since the Human Vision System recognizes luminance faster than color saturation, the error may not be noticed by the casual viewer. The normalized and clamped RGBW data is subpixel rendered by the SPR function 640. Because the target LCD 690 may have a non-linearly quantized electro-optical transfer function, the linear subpixel rendered data is non-linearly quantized to match the LCD by the Inverse Gamma function 515. This function may or may not be the inverse of the input Gamma function 610.

Priority Color Gamut Mapping

Figure 7B:
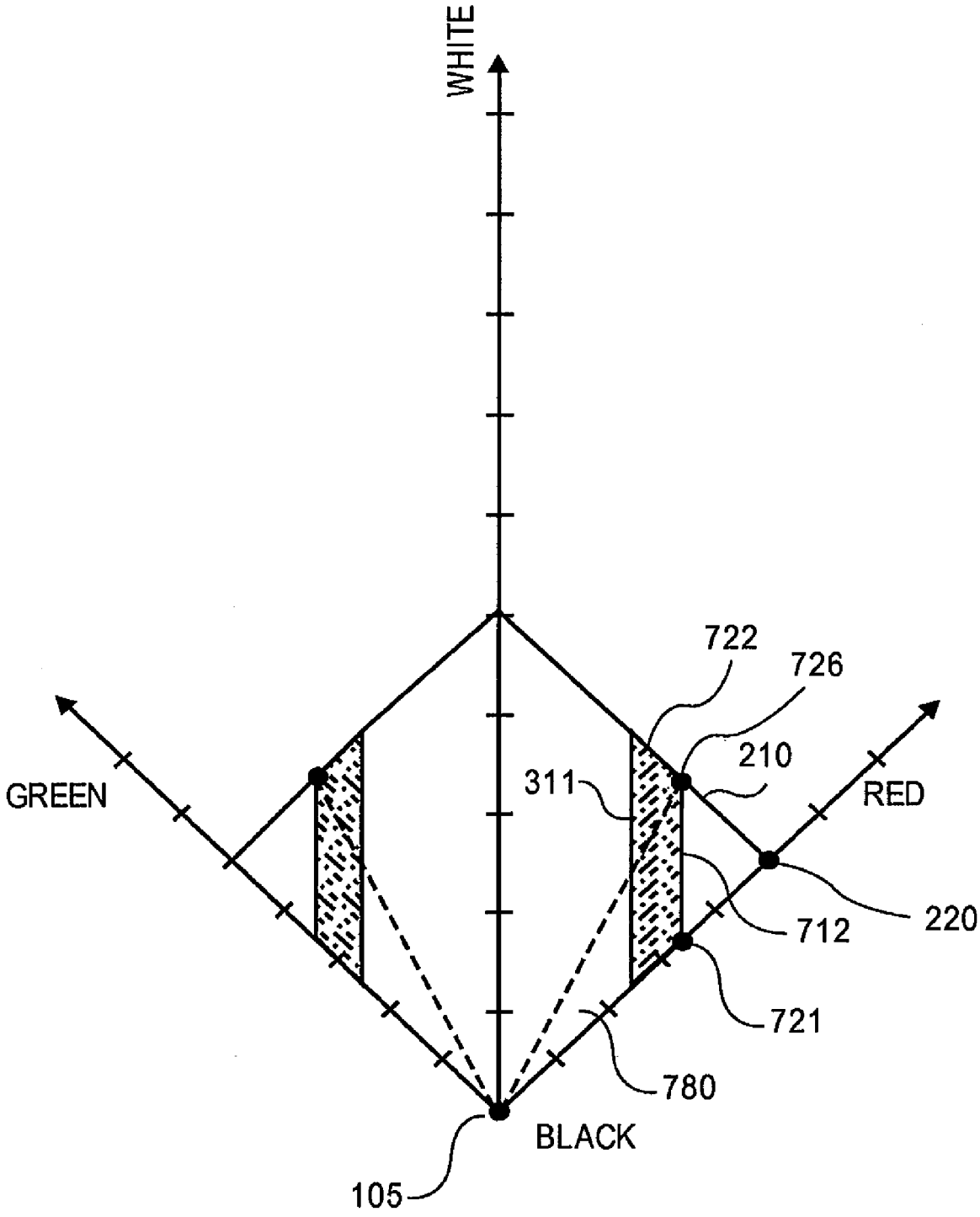
FIG. 7B shows an alternate method of pre-reducing the gamut of an input image.
Figure 8A:
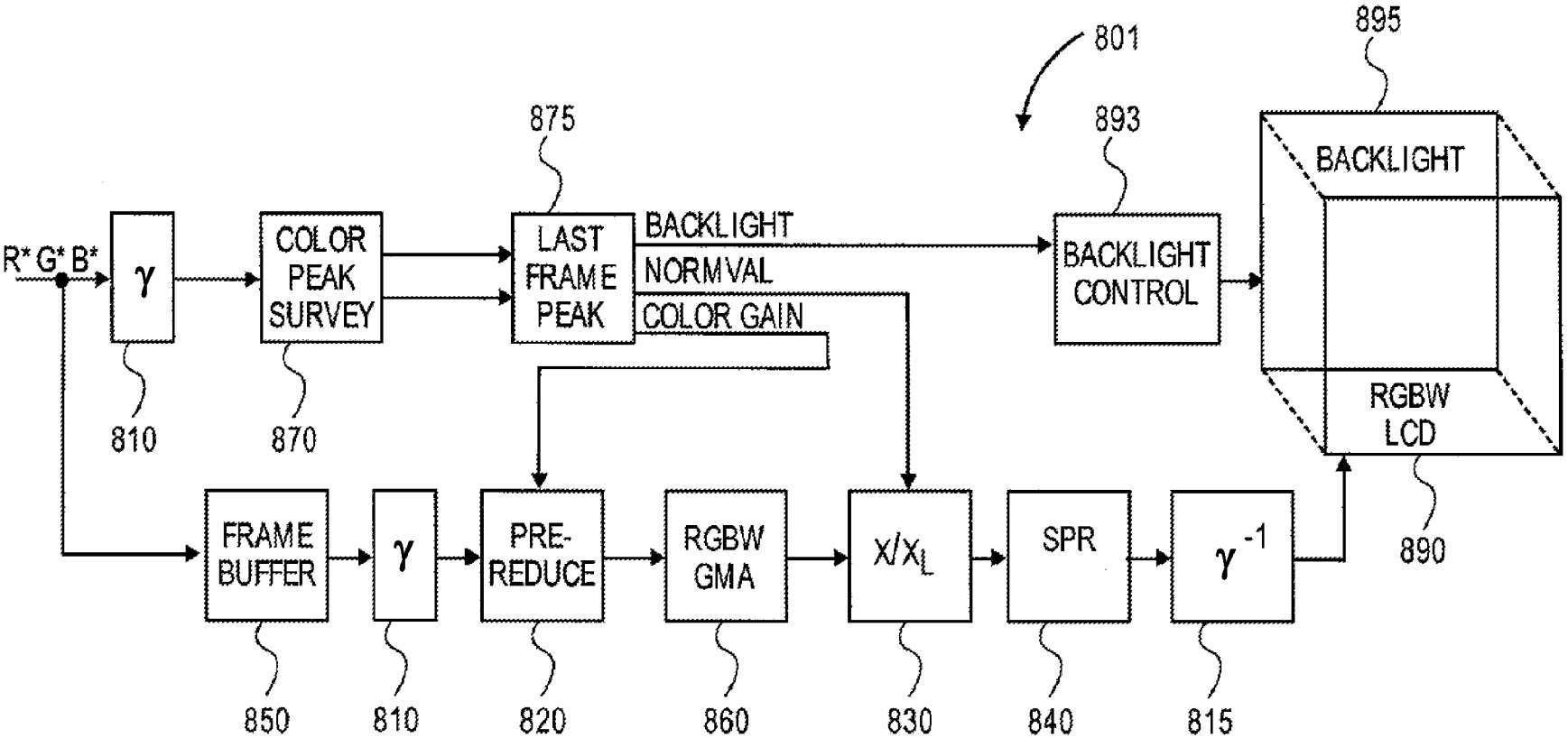
FIG. 8A is an alternate embodiment of a system made in accordance with the principles of the present invention that processes priority colors.
Figure 8B:
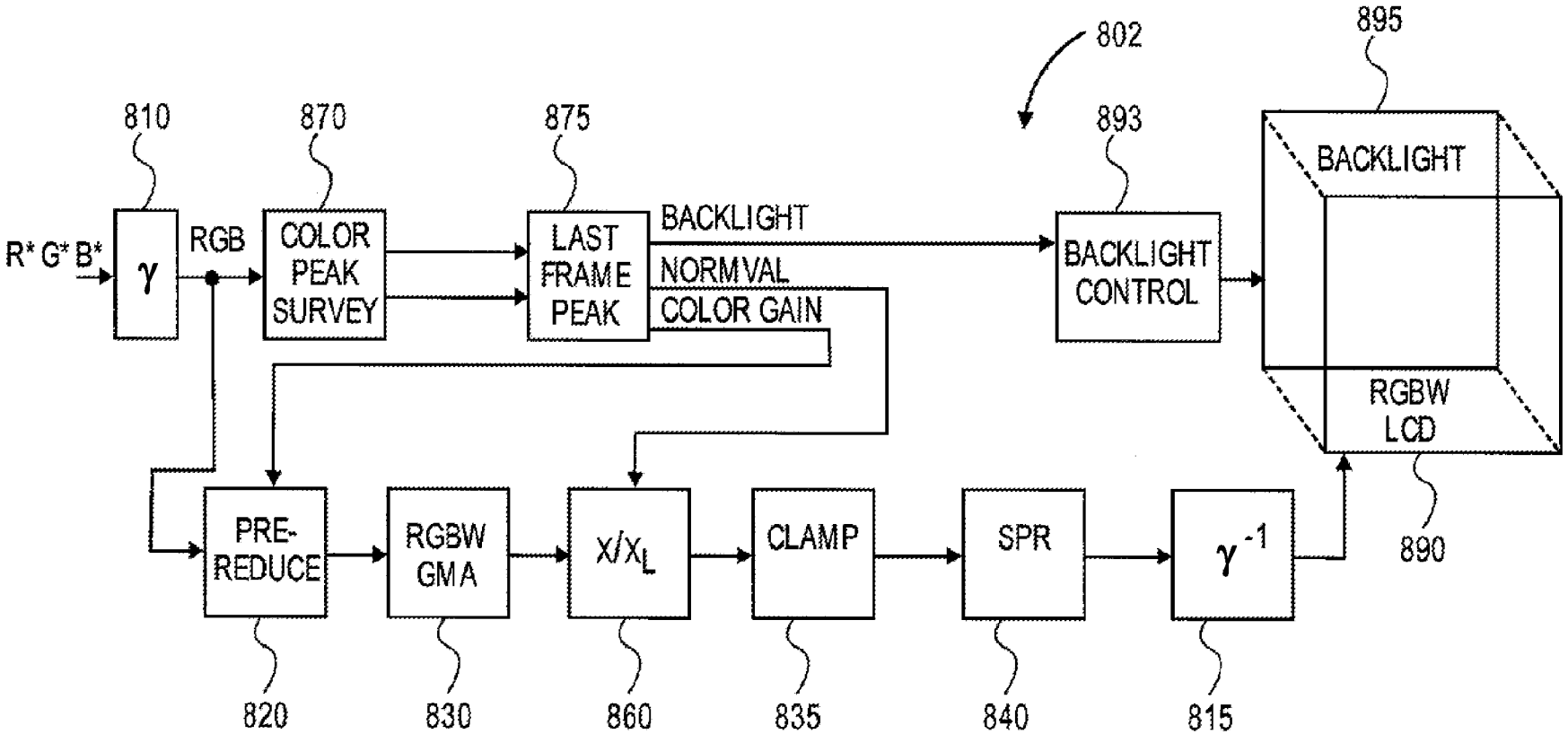
FIG. 8B is an alternative embodiment of a system of FIG. 8A that may use fewer gates.

When the image contains "priority" bright saturated colors or colors that are to be reproduced at greater or possibly full brightness (e.g. bright saturated cyan, magenta or yellow or any other desired color), the colors that need not be reproduced at full value may also be reproduced at substantially full brightness if the system is arranged as the block diagrams 801 and 802 in FIGS. 8A & 8B. In these systems, the colors may be surveyed for the presence of such priority colors and the behavior of the Pre-Reduce 820 and the backlight are adjusted to allow non-priority colors to be as bright as may be reproduced given a selected backlight power based on the brightness of the priority colors present. One possible function in the Pre-Reduce 820 block may be to adjust the gain (e.g. scaling down) of the colors in the triangle defined in FIG. 7A by black 105, the brightest mid-saturation color 326, and the brightest fully saturated color 220 as a function of saturation and the desired color gain. Thus the value, or angle, of the maximum colors after the operation, the line defined between the brightest mid-saturation color 326 and the brightest fully saturated post operation color 721 may be a function of the color gain. This may change the area of the potentially OOG colors 740 that require the backlight 895 brightness to be increased. Another possible function in the Pre-Reduce 820 block may be to adjust the gain (e.g. scaling down) of the colors in the triangle defined in FIG. 7B by black 105, the brightest mostly saturated color 726, and the brightest fully saturated color 220 as a function of saturation and the desired color gain. Thus the value, or angle, of the maximum colors after the operation, the line defined between the brightest mostly saturated color 726 and the brightest fully saturated post operation color 721 would be a function of the color gain. This would change the area of the potentially OOG colors 722 that require the backlight 895 brightness to be increased.

The block diagram 801 in FIG. 8A shows one embodiment of the present invention that uses the brightness of priority colors to adjust the brightness gain on non-priority colors. Perceptually quantized R*G*B* data of a given binary bit depth may be linearized by the Gamma function 810 to be a greater binary bit depth linearly encoded RGB signal. The backlight 895 may be set substantially to the minimum brightness needed to just enclose the image color/brightness gamut, the linearized RGB color data in a given frame may be surveyed to find the peak value by the Color Peak Survey function 870. During vertical retrace, the largest primary may be sent to the Last Frame Peak function 875 to calculate and store the backlight, normalization and color gain values to be used in the next frame period. The Backlight peak value from the previous frame period may be used by the Backlight Control function 893 to actively control the Backlight 895 brightness.

Thus, the image displayed may be one frame behind the current. During the current frame period, R*G*B* from the previous frame period is fetched from the Frame Buffer 650 to be linearized by a Gamma function 810. The linear RGB may be partially scaled down, as a function of saturation and the Color Gain fetched from the Last Frame Peak 875 in the Pre-Reduce function 820. The partially pre-reduced RGB color data may be converted to RGBW color data in the RGBW GMA 830 function block. The RGBW color data is then normalized by the value from the Last Frame Peak from the previous frame period in $X/X_L$ normalizing function 860. The $X/X_L$ normalized RGBW data may be subpixel rendered by the SPR function. Because the target LCD 890 may have a non-linearly quantized electro-optical transfer function, the linear subpixel rendered data may be non-linearly quantized to match the LCD by the Inverse Gamma function 815. This function may or may not be the inverse of the input Gamma function 810.

Figure 8C:
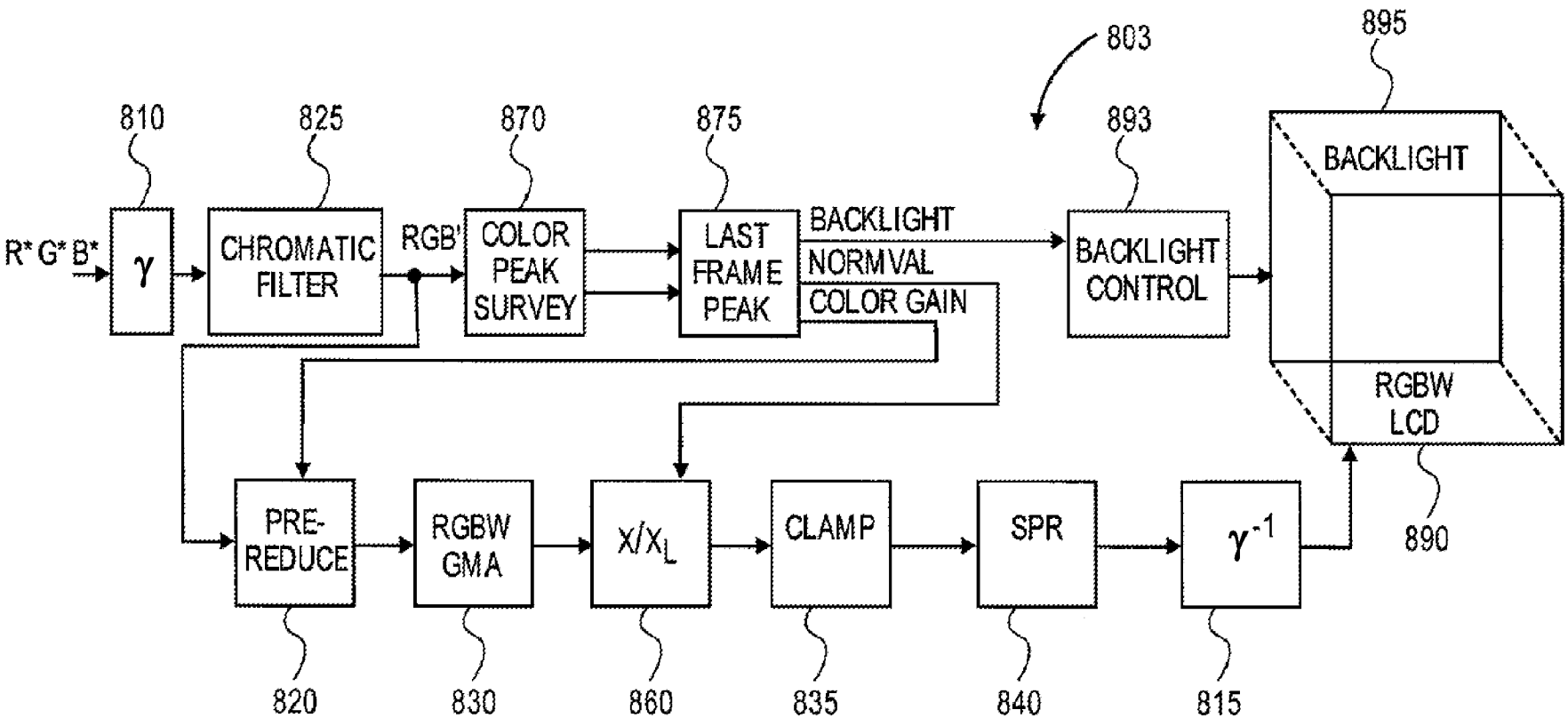
FIG. 8C is an embodiment of a system of FIG. 8A that employs a chromatic filtering module.
Figure 8D:
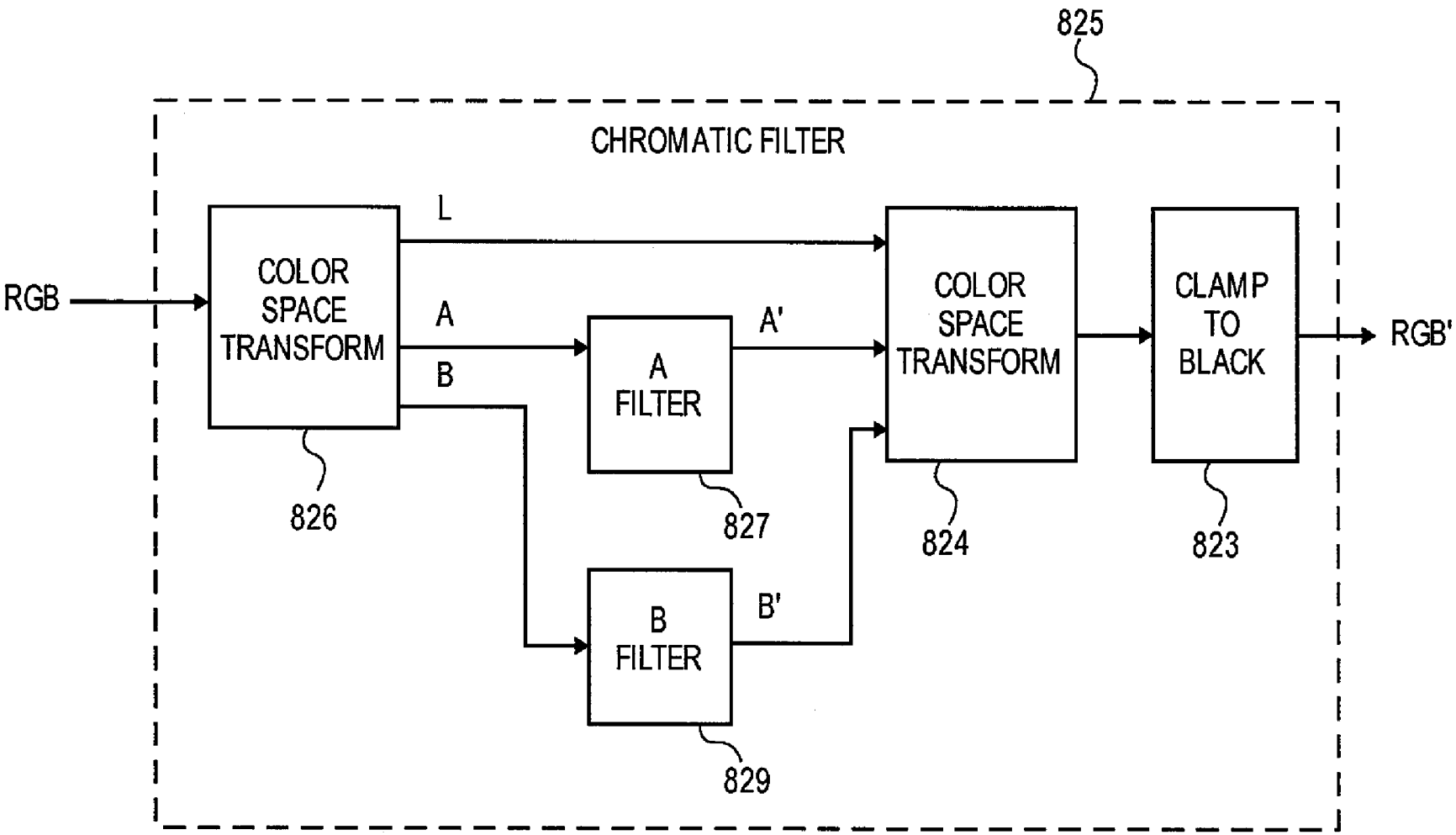
FIG. 8D is one embodiment of the chromatic filtering module of FIG. 8C.
Figure 8E:
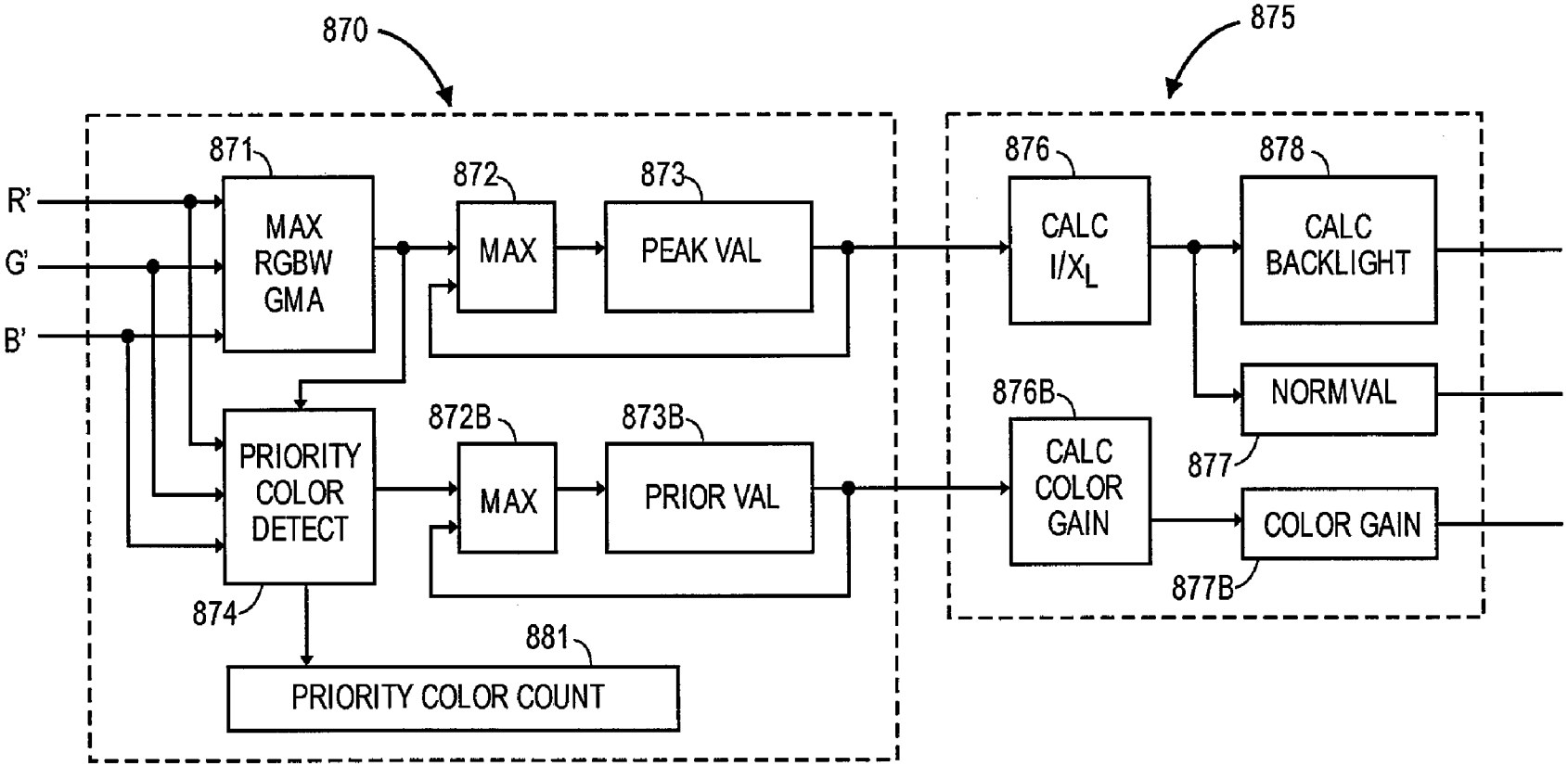
FIG. 8E is a block diagram of the color peak survey and last frame peak modules of FIGS. 8A, 8B, 8C and 8D.

Details of the block 870 and block 875 are shown in FIG. 8E. The block 870 may calculate the peak of the RGBW values as they would be before they are pre-reduced so it may have a MAX RGBW GMA module 871 separate from the main RGBW GMA in FIG. 8ABC. The maximum of the RGBW primaries may be calculated so this module may be implemented as a complete RGBW module followed by a comparator that selects the maximum of R G B and W. Alternately a simplified RGBW GMA that only calculated the maximum primary may be much simpler than a complete RGBW GMA module and may contain approximately one third as many gates when implemented in hardware. For each input RGB' value in a frame the max comparator 872 compares the output from the block 871 with the value of PEAKVAL register 873. The larger of the two is output and stored back as the new PEAKVAL.

If PEAKVAL register 873 is initialized to zero at the start of a frame then by the end of the frame, it may contain the largest R G B or W primary in the entire frame. Priority Color Detector 874 defects priority colors in the input RGB' signals. Priority colors may be passed on to max comparator 872*b*. For example, if the test B'<max(R',G') is true, then the input color is yellow. Other colors may be detected in a similar manner. Max comparator 872*b* compares the maximum primary from block 871 with PRIORVAL register 873*b* and stores the larger of the two back into block 873*b*. If block 873*b* is initialized to zero at the start of each frame then at the end of the frame it will have the largest primary (R G B or W) of the priority color. Priority Color Count register 891 may be initialized to zero at the start of every frame and incremented by one every time block 874 detects a priority color. By the end of each frame, this block 891 contains the number of priority colors seen in the frame. This may be used to modify calculations. After the end of each frame the CALC 1/Xl module 876 in block 875 inverts the PEAKVAL from block 870 in to calculate the normalization value. The result may be stored in NORMVAL register 877 to be used during the next frame. In Calc Backlight module 878, the quantized output of the Calc 1/XL module 876 may be used to prevent quantization errors when calculating the backlight value. Calc Color Gain module 876*b* is similar to Calc 1/Xl module 876 but it calculates a normalization value from the PRIORVAL from CPSM870. This may be stored in COLORGAIN register 877*b* to be used in the next frame.

Because frame buffer memory requires many gates, increasing the area used in a silicon integrated circuit, possibly increasing the cost beyond what may be considered economically viable in a given product, it may be desirable to have a system that does not require a frame buffer. The block diagram 802 in FIG. 8B is similar to the block diagram 801 in FIG. 8A, save that it has been modified to eliminate the Frame Buffer function 850. Perceptually quantized R*G*B* data of a given binary bit depth may be linearized by the Gamma function 810 to be a greater binary bit depth linearly encoded RGB signal. The backlight 895 may be set substantially to the minimum brightness needed to just enclose the image color/brightness gamut, during the current frame the colors values may be surveyed by the Color Peak Survey function 870, sending the results to the Last Frame Peak memory buffer 875 for calculations and storage. The Backlight peak value from the previous frame period may be used by the Backlight Control function 893 to actively control the Backlight 895 brightness. Thus, the brightness of the current image may be calculated from the previous one.

Meanwhile, the linear RGB may be partially scaled down, as a function of saturation and the Color Gain fetched from the Last Frame Peak 875 in the Pre-Reduce function 820. The partially pre-reduced RGB color data may be converted to RGBW color data in the RGBW GMA 830 function block. During the current frame period, scaled down RGBW from the current frame period may be normalized by the value from the Last Frame Peak from the previous frame period in $X/X_L$ normalizing function 860. Thus the normalization for the current frame may be calculated in the previous frame. The $X/X_L$ normalized data may still have OOG color values, including in the W, the white, channel if the peak value from the previous frame period is less than that of the current frame period. The normalized color data is clamped to the RGBW color/brightness hull by the Clamp function 635. It may be desirable to use 'clamp to luminance'. By clamping to the closest luminance value available, the luminance error during the current frame period may be minimized, at the expense of the color saturation. If the next frame period's image is the same as the current, as often happens, then the colors that are clamped during the current frame period may be fully realized during the next frame period. Since the Human Vision System recognizes luminance faster than color saturation, the error may not be noticed by the casual viewer. The $X/X_L$ normalized and clamped RGBW data is subpixel rendered by the SPR function 840. Because the target LCD 890 may have a non-linearly quantized electro-optical transfer function, the linear subpixel rendered data may be non-linearly quantized to match the LCD by the Inverse Gamma function 815. This function may or may not be the inverse of the input Gamma function 810.

It may be desirable to survey the colors to determine if there is sufficient number of pixels of a priority color (e.g. bright saturated yellow). Priority Color Count register 881 in FIG. 8E contains this number. It may be possible to ignore small numbers pixels with such priority colors as they may not be objectionable. This would have the advantage of reducing the backlight power. The Color Peak Survey function 870 may send this color count to the block 875 to influence the Backlight and Color Gain values based on the number of pixels that have priority colors.

Alternative Subpixel Rendering Techniques

Although all of the embodiments described herein may use any known subpixel rendering (SPR) techniques and still benefit from dynamic gamut mapping and backlight control means and mechanisms described herein, there are some alternative SPR systems and methods that might be desirable in such systems.

When applying subpixel rendering techniques to whole pixel image data, there is the possibility of error for certain image patterns, namely saturated color against unsaturated color—e.g. green and white checkerboard. This is particularly true when the subpixel repeating pattern for a display is of a RGBW format—as disclosed in many of the applications incorporated by reference above—or other multiprimary subpixel layouts in which metamers occur among the chosen primary subpixel colors. For example, the white (W) subpixel represents a metamer for red, green and blue (RGB) subpixels. In co-owned application WO 2006/12755 (the '755 publication, which is incorporated herein by reference), there are disclosed various embodiments of utilizing metamer-luminance signal based sharpening ("meta-luma") techniques. Also in the '755 publication, there are disclosed various embodiments of combining meta-luma sharpening techniques with other SPR techniques such as area resampling and difference of Gaussian (DOG) sharpening techniques as employed on image data on a same color plane (e.g. green color plane) ("same color sharpening") or employing different color plane image data to perform sharpening ("cross color sharpening").

If such mixed sharpening algorithm uses same color sharpening when on—for example—the green subpixel and meta-luma sharpening when on the white subpixel; there may be a difference in luminance and color for two phases of checkerboard.

Thus, it may be desirable to determine when to use meta-luma sharpening and same color sharpening and abate or avoid any such differences. One embodiment may be to look at the saturation of pixels near the target pixel and if any are saturated beyond some threshold, then same color sharpening may be used. If the pixels are all unsaturated below some threshold, then meta-luma sharpening may be used. The following pseudo-code may be employed to implement this embodiment:

```
xp=x
meta      = spr.sample("gma",xp,y,L,metasharp)
if spr.fetch("gma",xp,y,S) < sat__thresh or spr.fetch("gma",xp+1,y,S) < sat__thresh or
spr.fetch("gma",xp−1,y,S) < sat__thresh or spr.fetch("gma",xp,y−1,S) < sat__thresh or
spr.fetch("gma",xp,y+1,S) < sat__thresh then
red     = spr.sample("gma",xp,y,R,diamond)+spr.sample("gma",xp,y,R,fullsharp)
green = spr.sample("gma",xp,y,G,diamond)+spr.sample("gma",xp,y,G,fullsharp)
blue   = spr.sample("gma",xp,y,B,diamond)+spr.sample("gma",xp,y,B,fullsharp)
   else
red     = spr.sample("gma",xp,y,R,diamond) + meta
green = spr.sample("gma",xp,y,G,diamond) + meta
blue   = spr.sample("gma",xp,y,B,diamond) + meta
   end
xp=x+1
meta      = spr.sample("gma",xp,y,L,metasharp)
   if spr.fetch("gma",xp,y,S) < sat__thresh or spr.fetch("gma",xp+1,y,S) < sat__thresh or
spr.fetch("gma",xp−1,y,S) < sat__thresh or spr.fetch("gma",xp,y−1,S) < sat__thresh or
spr.fetch("gma",xp,y+1,S) < sat__thresh then
white = spr.sample("gma",xp,y,W,diamond)+spr.sample("gma",xp,y,W,fullsharp)
  else
white = spr.sample("gma",xp,y,W,diamond) + meta
  end
  end
```

In this code, sat_threshold may be set to a low value and saturation value "S" may be calculated as W/maxRGB or minRGB/maxRGB. This means that S=0 refers to unsaturated e.g. white or gray and S=1 refers to pure colors. The special case of R=G=B=0 may be identified as unsaturated. "Metasharp" represents a meta luma sharpening technique. "Fullsharp" represents same color sharpening. Other filters may be used based on the results of this test.

For one possible hardware embodiment, it may be possible to use the value of S calculated in the prescaling block. If S is less than a threshold sat_threshold, then a flag may be set to 0; otherwise the flag is set to 1. This information may be calculated in the GMA and may be stored through the line buffers for calculation in SPR block. This may be done by carrying one less bit for blue data in the PenTile engine and using this bit for the flag. Alternatively, the line buffers may be expanded by 1 bit.

In the SPR block, the S flag is checked for the target pixel, the pixels to right, left, up, and down. If any are set to 1, then same color sharpening is used. If same color sharpening is used, the two checkerboard phases will look the same.

An alternate embodiment is to look at all eight surrounding pixels plus the target pixel and then make a decision.

Chromatic Filtering

Since a small number of priority colors may not increase the backlight power, as well as the presence of non-priority but still bright saturated colors, it may be desirable to provide a means whereby some of these colors may still be reproduced in a manner that will reduce the color appearance shifts caused by simultaneous contrast in those cases where the backlight power has not been sufficiently increased to reproduce them directly. For example, chromatic filtering may improve, reduce, simultaneous contrast color appearance shifts for high spatial frequency image components. Consider yellow text or lines on a white background. With chromatic filtering, the total energy of the chromatic signal may be maintained even as the colored lines or text strokes are desaturated, blended to the white surround, while the white surround takes on some of the color. Blue from the surrounding white will bleed into the yellow and yellow (or more precisely, negative, or minus, blue) will bleed into the white. Both of these colors, being desaturated, will pass through the PreReduce function 820 unmolested. Because the human eye can't see high spatial frequency chromatic signals, especially those in the yellow/blue color opponent channel, the blurring of the chromatic signal will not be visible.

The block diagram 803 in FIG. 8C is similar to the block diagram 802 in FIG. 8B except that a Chromatic Filter function 825 has been added. Perceptually quantized R*G*B* data of a given binary bit depth may be linearized by the Gamma function 810 to be a greater binary bit depth linearly encoded RGB signal. The linearized RGB image may be chromatically filtered in the Chromatic Filter function 825. Referring to FIG. 8D, the Chromatic Filter function 825 is expanded. The linearized RGB color data may be transformed into the LAB color space, or some other perceptually uniform color space, by the first Color Space Transform function 826. The A chromatic channel is blurred by some amount by the A Filter 827 to produce a filtered A' signal. The B chromatic channel is blurred by some amount by the B Filter 829 to produce a filtered B' signal. Since the A chromatic channel may roughly approximate the red/green chromatic channel in the Human Vision System and the B chromatic channel may roughly approximate the yellow/blue chromatic channel in the Human Vision System, the B Filter 829 may be more aggressive than the A Filter 827 since the yellow/blue chromatic channel has lower contrast sensitivity function than the red/green chromatic channel in the Human Vision System.

The filtered LAB' signal may be converted to a filtered RGB' signal by the second Color Space Transform function 824. This signal may have values that are greater than allowed since a colored signal with the same luminance as white may not be reproduced, so the filtered RGB' signal may be clamped toward black, at the highest allowed color to maintain the same color hue and saturation by the Clamp to Black function 823. Returning to FIG. 8C, the backlight 895 may be set substantially to the minimum brightness needed to just enclose the image color/brightness gamut, during the current frame the filtered RGB' colors values are surveyed by the Color Peak Survey function 870 in FIG. 8C. The results may be sent to Last Frame Peak memory buffer 875 for calculations and storage. The Backlight peak value from the previous frame period may be used by the Backlight Control function 893 to actively control the Backlight 895 brightness. Thus, the brightness of the current image may be calculated from the previous one.

Meanwhile, the filtered RGB' data may be partially scaled down, as a function of saturation and the Color Gain fetched from the Last Frame Peak 875 in the Pre-Reduce function 820. The partially pre-reduced RGB' color data may be converted to RGBW' color data in the RGBW GMA 830 function block. During the current frame period, scaled down RGBW' from the current frame period may be normalized by the value of the Last Frame Peak from the previous frame period in $X/X_L$ normalizing function 860. Thus the data in the current frame may be normalized by the value calculated in the previous frame. The $X/X_L$ normalized data may still have OOG color values, including in the W, the white, channel if the peak value from the previous frame period is less than that of the current frame period. The normalized color data may be clamped to the RGBW color/brightness hull by the Clamp function 635. It may be desirable to use 'clamp to luminance'. By clamping to the closest luminance value available, the luminance error during the current frame period may be minimized, at the expense of the color saturation. If the next frame period's image is the same as the current, as often happens, then the colors that are clamped during the current frame period will be fully realized during the next frame period. Since the Human Vision System recognizes luminance faster than color saturation, the error may not be noticed by the casual viewer. The $X/X_L$ normalized and clamped RGBW' data may be subpixel rendered by the SPR function 840. Because the target LCD 890 may have a non-linearly quantized electro-optical transfer function, the linear subpixel rendered data may be non-linearly quantized to match the LCD by the Inverse Gamma function 815. This function may or may not be the inverse of the input Gamma function 810.

Another embodiment of chromatic filtering may be accomplished as follows: first, calculate the "L", the luminance, of the linearized RGB pixel values and store them. Secondly, filter the RGB planes with a suitable blurring filter, possibly using the diamond filter to produce filtered R'G'B' pixel values. Since this filtering operation may also filter the "L" channel, the stored L values may be used to readjust the luminance of the filtered R'G'B' pixel values back to their original values. This may be done by calculating the L' of each R'G'B' pixel value. The R'G'B' pixel values are then adjusted using the ratio of the original L and L' by multiplying the R'G'B' pixel values by L/L'. Apart from a diamond filter, it may also be possible to use any number of other simple filters, such as:

| |
|---|
| 1 1 1 |
| 1 4 1 |
| 1 1 1 |

With all values above divided by 12.

Figure 10A:
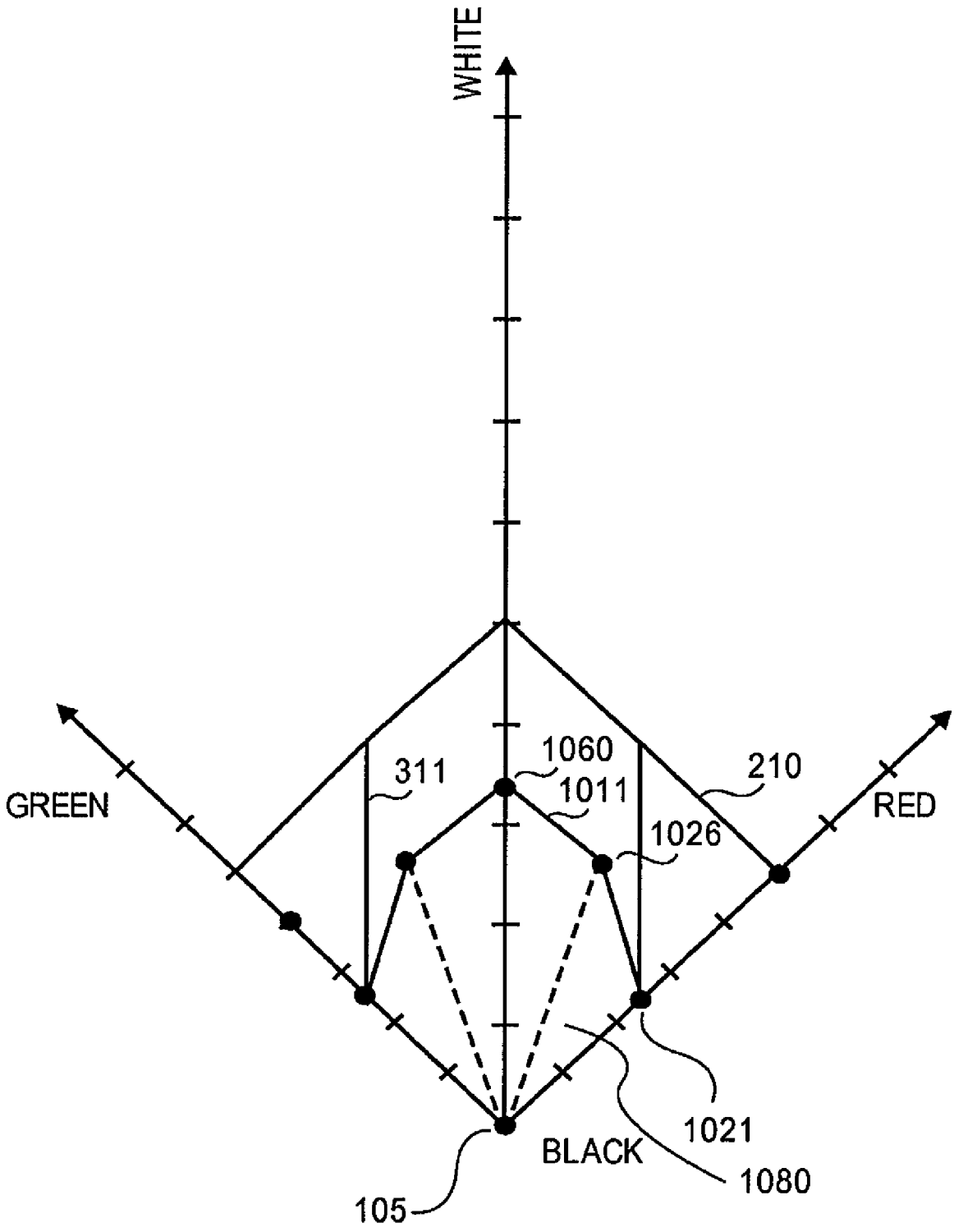
FIGS. 10A and 10B depict gamut hull alterations as a result of various possible pre-reduction functions.

Other methods of adjusting the ratio of the saturated vs. desaturated colors may be employed. For example, it is possible to reduce the desaturated colors as well as the saturated colors to perform the normalization function within the pre-reduce function, eliminating the later $X/X_L$ normalization. In FIG. 10A, the RGB gamut hull 210 may be pre-reduced to the smaller gamut hull 1011 inside in which the brightness of the maximum brightness white is mapped to a smaller number 1060, that may be compensated for by having a brighter backlight value, to fit inside of the valid RGBW color gamut hull 311. The triangle defined by black 105, the brightest mid-saturation color 1026, and the brightest fully saturated color 1021 may be reduced as a function of saturation and the desired color gain. Thus the value, or angle, of the maximum colors after the operation, the line defined between the brightest mid-saturation color 1026 and the brightest fully saturated post operation color 1021 may be a function of the color gain. The desaturated colors not in the triangles 1080 may be uniformly reduced. Note that the reduced gamut hull shape 1011 may be proportionally the same as the reduced gamut hull shape 711 in FIG. 7A.

Figure 10B:
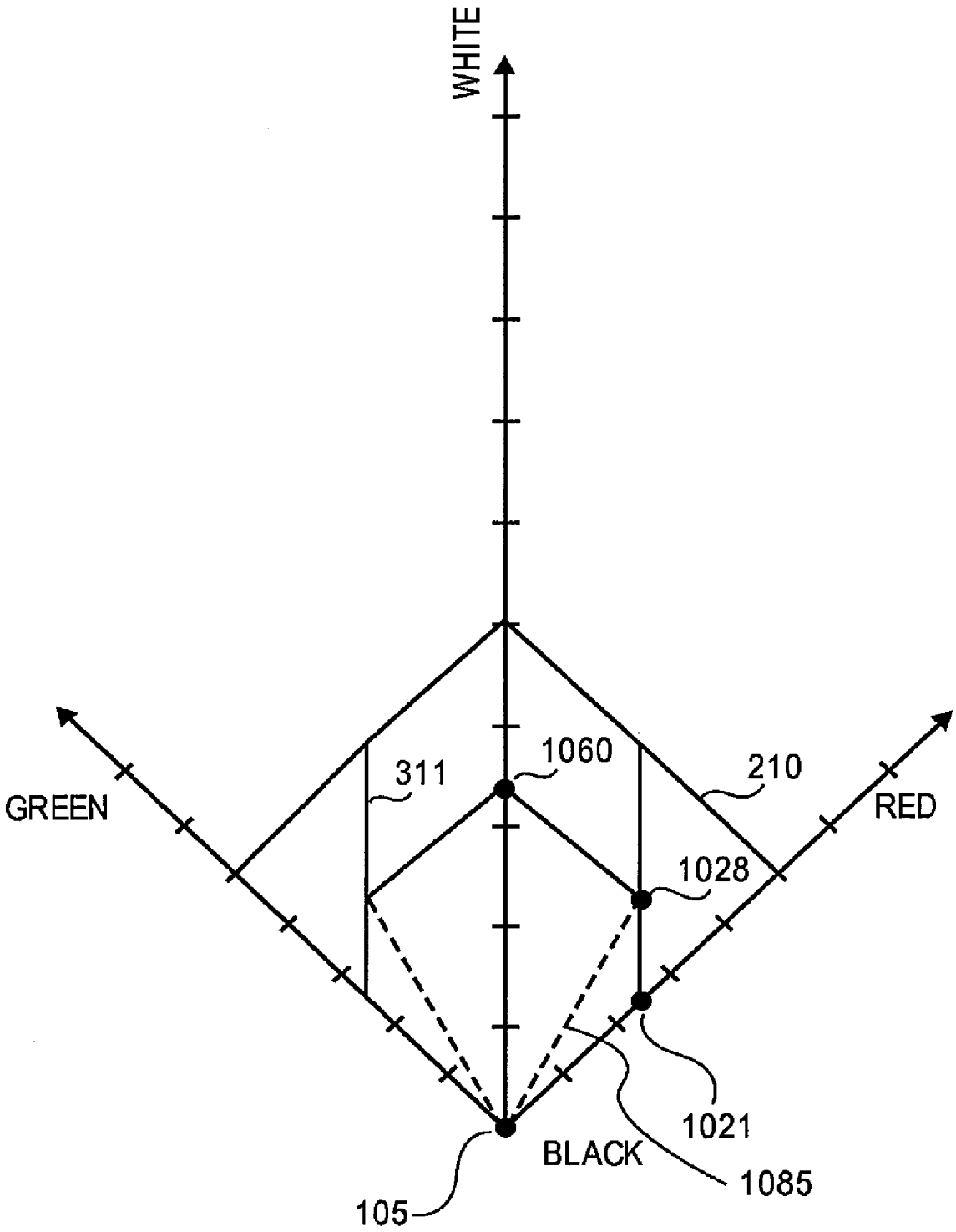

Another possible function in the pre-reduce function may be to adjust the gain (scaling down) of the colors in the original RGB gamut hull 210 to the smaller one shown inside, with the colors in the triangle 1085 defined in FIG. 10B by black 105, the brightest mostly saturated color 1028, and the brightest fully saturated color 1021 having been reduced as a function of saturation and the desired color gain, with the values of the colors not in the triangles 1085, including the maximum white 1060, being linearly reduced. Thus the value, or angle, of the maximum colors after the operation, the line defined between the brightest mostly saturated color 1028 and the brightest fully saturated post operation color 1021 may be a function of the color gain. Note that the reduced gamut hull shape may be proportionally the same as the reduced gamut hull shape 712 in FIG. 7A.

Figure 9A:
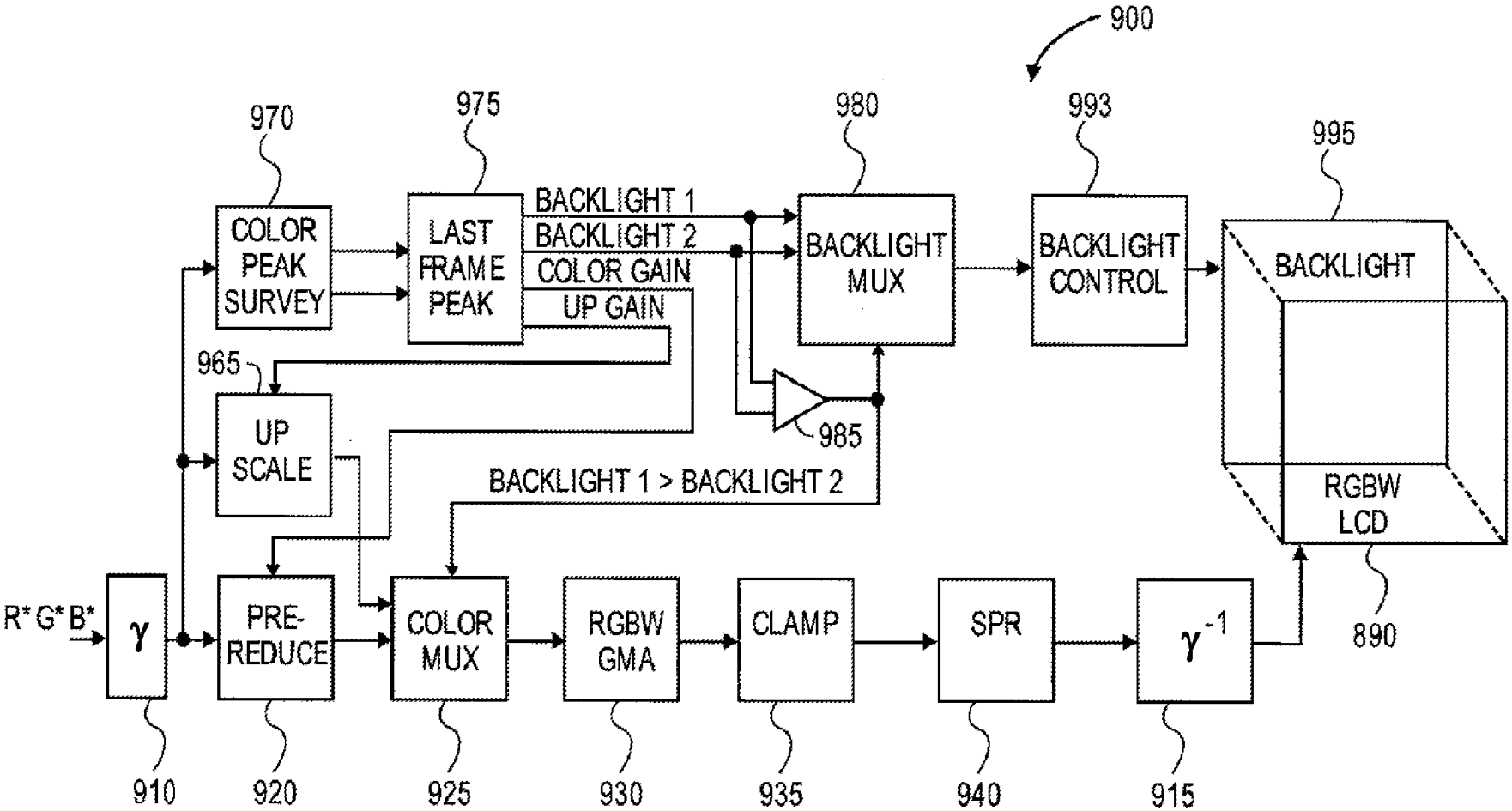
FIG. 9A is a block diagram of an embodiment of the present invention with separate gamut scaling paths.

FIG. 9A shows a block diagram 900 of a system that performs this operation. The X/XL normalization module may be replaced by a pre-reduce module 920. An X/XL module typically may reduce (multiply by a value less than one) or expand (multiply by a value greater than one). As mentioned above, it may be desirable to split these two operations and perform them on separate paths. This is done in FIG. 9A by using Pre-Reduce module 920 to do reductions and a separate Up Scale module 965 to do expansions. Both operations may be done in parallel and one of the results may be selected by Backlight MUX 980 and Color MUX 925.

Perceptually quantized R*G*B* data of a given binary bit depth may be linearized by the Gamma function 910 to be a greater binary bit depth linearly encoded RGB signal. The linear RGB goes down three different paths. In a first path, the linear RGB may be surveyed in Color Peak Survey module 970. The survey results may be used at the end of each frame in Last Frame Peak function 975 to calculate and store backlight and gain values for the next frame. The two backlight values from Last Frame Peak function 975 may be fed to comparator 985 to determine which is larger and the result may be used in backlight mux 980 to select the largest of the two values. The resulting largest backlight value from the previous frame period may be used by the Backlight Control function 993 to actively control the Backlight 995 brightness.

In the second path, the linear RGB signal may be processed by up scale module 965 using the up gain value from last frame peak storage 975. In the third path, the linear RGB signal may be processed in pre-reduce module 920. Color MUX 925 may select one of these two signals based on the result from comparator 985. The selected signal, pre-reduced or up-scaled RGB color data, may be converted to RGBW color data in the RGBW GMA 930 function block. Without complete pre-reduction or clamping, the RGBW color data may contain OOG colors whose red, green, or blue value may exceed the maximum allowable value by two times if the RGBW gamut system provides twice the brightness as an RGB display with the same backlight. Thus, the selected color data may be clamped to the RGBW color/brightness hull by the Clamp function 935. It may be desirable to use 'clamp to luminance'. By clamping to the closest luminance value available, the luminance error during the current frame period may be minimized, at the expense of the color saturation. If the next frame period's image is the same as the current, as often happens, then the colors that are clamped during the current frame period may be fully realized during the next frame period. Since the Human Vision System recognizes luminance faster than color saturation, the error may not be noticed by the casual viewer. The normalized and clamped RGBW data is subpixel rendered by the SPR function 940. Because the target LCD 990 may have a non-linearly quantized electro-optical transfer function, the linear subpixel rendered data may be non-linearly quantized to match the LCD by the Inverse Gamma function 915. This function may or may not be the inverse of the input Gamma function 910.

Figure 9B:
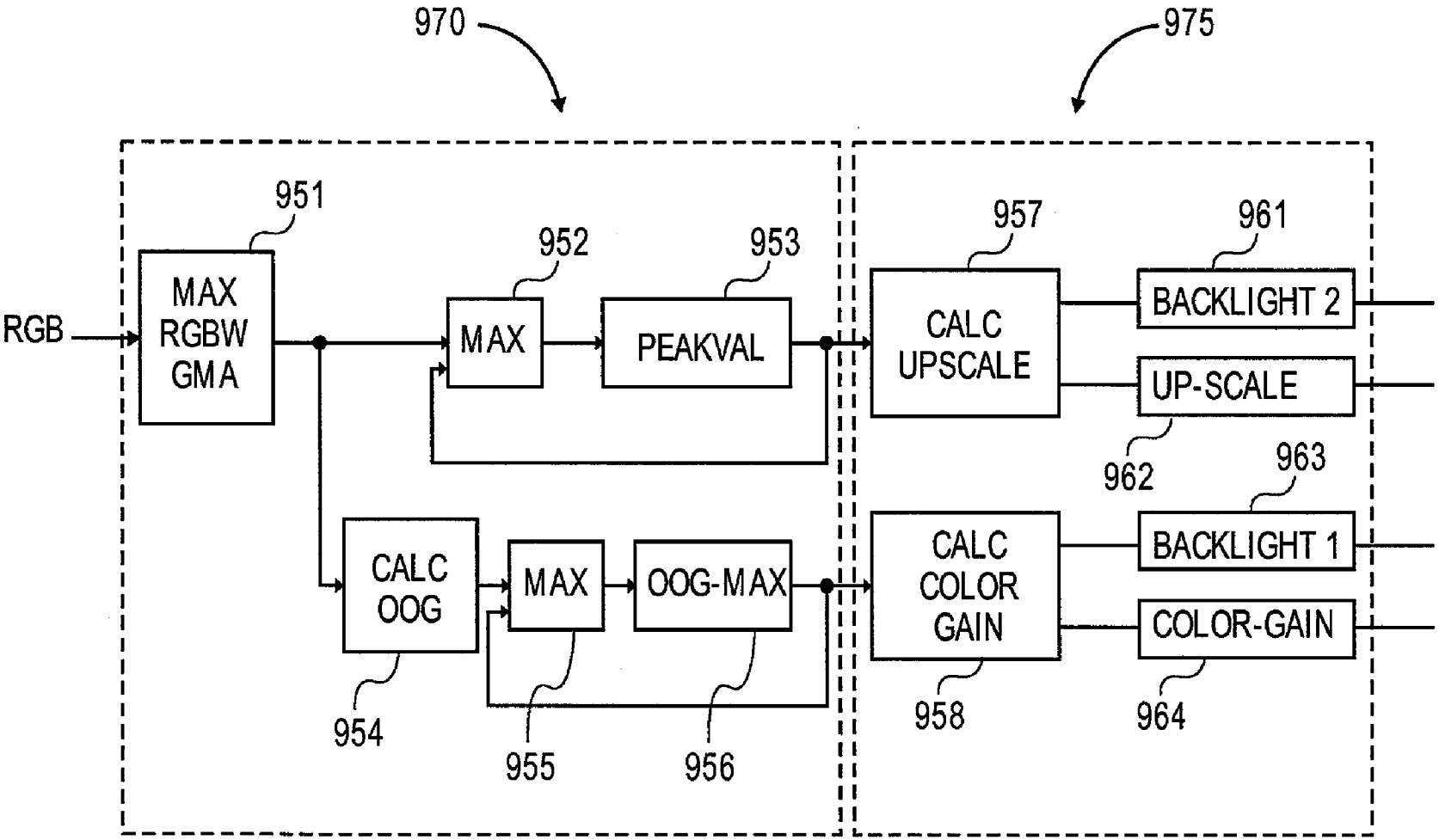
FIG. 9B is a block diagram of the color peak survey and last frame peak modules of FIG. 9A.

The details of color peak survey module 970 and Last Frame Peak module 975 are shown in FIG. 9B. Linear RBG values may be sent to MAX RGBW GMA module 951. This could be a normal RGBW GMA module with a test at the end to select the largest of the 4 color primaries on the output. However, it may use one third fewer gates to construct this module to calculate the maximum primary directly. The output from MAX RGBW GMA module 951 may be sent down two paths. In the first path, Peakval register 953 may be initialized to zero at the start of a frame of input data. For every Linear RGB value in and input frame, the value of Peakval register 953 may be compared against the output of MAX RGBW GMA module 951 in MAX module 952. The largest of the two values may be stored back in Peakval register 953 so that this register may eventually contain the largest value from the entire frame. It may be desirable to clamp this value to the maximum in-gamut value since out-of-gamut values may be handled by the second path.

In the second path, MAX RGBW GMA output values from each input color in a frame may be sent to CALC OOG module 954. This module calculates how far the output from MAX RGBW GMA module 951 is out-of-gamut. One way to calculate this may be to subtract the maximum in-gamut value from the MAX RGBW value and clamp all negative values up to zero. If the signal is not out-of-gamut then no value is sent to the next module. Optionally, this module could also not send values to the next module if the color is not a priority color. For example the test B<max(R,G) is only true when the color is in the "yellow triangle" of a chromaticity diagram. This test may make the CALC OOG module 954 only test yellow colors for out-of-gamut. If the MAX RGBW GMA module 951 output is yellow and is out of gamut then a non-zero value may be output to MAX module 955. MAX module 955 compares the OOG value with previous OOG values in the same frame and outputs the larger of the two. OOGMAX register 956 thus acquires the largest OOG value seen in the frame and thus may be initialized to zero before the start of each frame. After all the input values from an entire frame have been seen then the Last Frame Peak module 975 calculates and stores the results. Calc up-scale module 957 uses the peakval register 953 output to calculate the Backlight 2 and up-scale values.

One way to calculate the backlight2 value may be simply to divide half the peakval by the maximum in-gamut color. This results in a value between 0 and ½ which may be scaled and quantized to the integer range of the backlight control values. The up-scale output value is the maximum in-gamut color divided by the peakval. When the peakval is zero, the backlight may also be black and zero may be used for the up-scale value. This calculation results in a value between zero and the maximum in-gamut color which may be stored in register UPSCALE 962. The division may be implemented by an inverse look-up-table (LUT). The division would ordinarily result in many non-integer values so some fixed point bit size may be chosen and values truncated to integers. This operation ordinarily results in quantization errors but those may be avoided by calculating the backlight2 value backwards from the up-scale value. The backlight2 value in this embodiment may be half of the inverse of the up-scale value. Note that the same inversion LUT may be used for this calculation. The result is a floating point number between 0 and ½ which may be scaled and quantized to the range of the backlight control values before storing it in BACKLIGHT2 register 961. The result of calculating backlight2 backwards from the up-scale value may be that many of the possible backlight control values may not be used, but those that may be used may not have quantization error when used with the corresponding up-scale value. In mathematical notation the formula for these two values would be:

$$upscale=MAXCOL/peakval$$

$$backlight2=MAXBACK/upscale/2$$

Where MAXCOL is substantially the maximum in-gamut color and MAXBACK is substantially the maximum backlight control value. In one embodiment, Calc Color Gain module 958 may calculate the backlight1 and color-gain values in the following manner: the backlight1 value is ½ plus half of the oogmax value divided by the maximum in-gamut color. This is a value between ½ (when oogmax is 0) and 1 (when oogmax is at the maximum) and may be scaled and quantized to the integer range of the backlight controller before storing in BACKLIGHT1 register 963. The color-gain value may be one minus half of the oogmax value divided by the maximum in-gamut color. No inversion may be necessary in this calculation. However, if this is coupled with the inversion table in the pre-reduce module, quantization error may be reduced there as well. This results in a color-gain value between 1 and ½ which may be scaled and quantized to the range of values that the pre-reduce module expects and stored in COLORGAIN register 964. In mathematical notation the formula for these two values would be:

$$backlight2=(1+oogmax/MAXCOL)*MAXBAK/2$$

$$colorgain=1-oogmax/MAXCOL/2$$

Systems with Different Backlights

Figure 11:
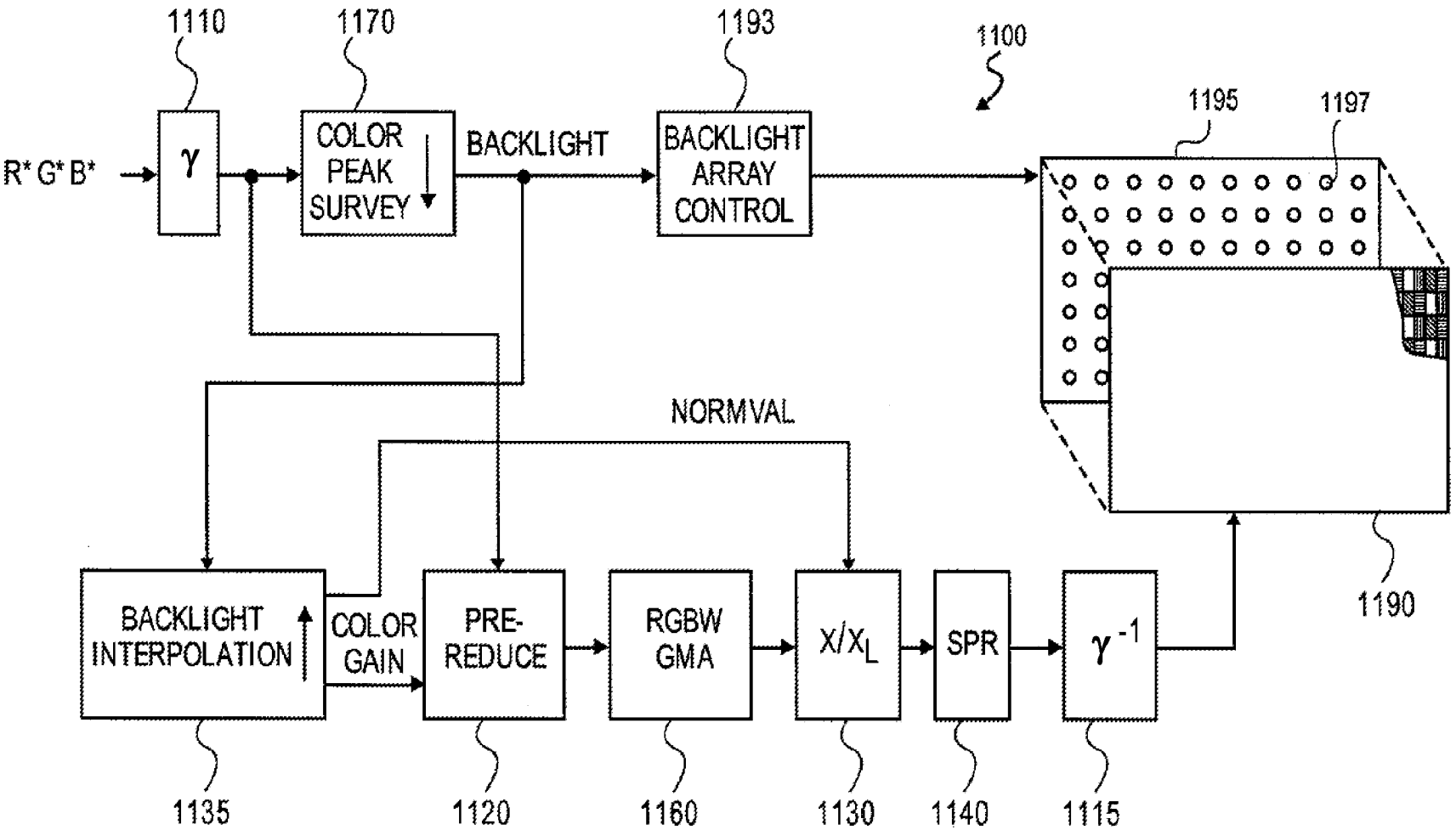
FIG. 11 is a block diagram of one embodiment of a system using two dimensional arrays of light emitters in the backlight.

It should be noted that the techniques of the present application apply whether the backlight of the system is a unitary backlight (i.e. one backlight unit that illuminates the entire display area of the LCD) or whether the backlight tends to partition the LCD display area (e.g. as is found with a low resolution LED backlight where each LED is separately controllable and addressable, as depicted in FIG. 11). Indeed, the techniques disclosed herein work in systems employing CCFL, white LEDs or colored LEDs that illuminate the entire display area of a display—as well as sets or arrays of CCFLs, white or colored LEDs that may illuminate a portion of display area of a display. These techniques would also work with other backlights such as incandescent, plasma, Organic Light Emitting Diodes (OLED), Electroluminescent (EL), or other emissive backlight technology.

Arrays of light emitting diodes (LEDs) are used as light emitting sources in backlit display systems. U.S. Pat. No. 6,923,548 B2 discloses a backlight unit in a liquid crystal display that includes a plurality of lamps or chips arranged such that LED chips realizing R, G, and B colors are built in the respective lamps or chips. U.S. Pat. No. 6,923,548 B2 describes the backlight unit as realizing high brightness and providing a thin backlight unit. U.S. Pat. No. 7,002,547, which is hereby incorporated by reference herein, discloses a backlight control device for a transmissive type or for a transreflective type liquid crystal display equipped with LEDs as a backlight. The backlight control device includes an LED driving circuit connected to a power supply circuit for driving the LED, and a current control device that detects brightness around the liquid crystal display for controlling the driving current for the LED according to the detected brightness. Hideyo Ohtsuki et al., in a paper entitled "18.1-inch XGA TFT-LCD with wide color reproduction using high power led-backlighting," published in the Proc. of the Society for Information Display International Symposium, in 2002, disclose an 18.1 inch XGA TFT-LCD module using an LED-backlighting unit. Ohtsuki et al. disclose that a side-edge type backlight is applied and two LED strips are located on the top and bottom edges of a light-pipe. Each LED strip arranges multiple red, green and blue LEDs. The lights from the red, green and blue LEDs are mixed and injected into the light-pipe. The brightness of the red, green and blue LEDs can be dimmed independently by a control circuit. Ohtsuki et al. disclose that the color-filter of this LCD panel is well-tuned to get higher color saturation.

U.S. Pat. No. 6,608,614 B1 entitled "Led-based LCD backlight with extended color space" discloses a backlight for a liquid-crystal display that includes a first LED array that provides light with a first chromaticity and a second LED array that provides light with a second chromaticity. A combining element combines the light from the first LED array and the second LED array and directs the combined light toward the liquid crystal display. A control system is operationally connected to the second LED array. The controller adjusts the brightness of at least one LED in the second LED array to thereby adjust the chromaticity of the combined light.

US 2005/0162737 A1 (hereafter, "the '737 publication)", entitled "High Dynamic Range Display Devices," discloses a display having a screen which incorporates a light modulator and which is illuminated with light from a light source comprising an array of controllable light-emitters. The controllable-emitters and elements of the light modulator may be controlled to adjust the intensity of light emanating from corresponding areas on the screen. FIG. 8 of the '737 publication (not duplicated herein) shows a section through a display 60 in which a rear-projection screen 53 comprising a diffusing layer 22 is illuminated by an array 50 of LEDs 52. The brightness of each LED 52 is controlled by a controller 39. Screen 53 includes a light modulator 20. The rear face of light modulator 20 is illuminated by LED array 50. FIG. 8A of the '737 publication (not duplicated herein) is a schematic front view of a portion of display 60 for a case where controllable elements (pixels) 42 of light modulator 20 correspond to each LED 52. Each of the controllable elements 42 may comprise a plurality of colored sub-pixels. The '737 publication discloses that LEDs 52 may be arranged in any suitable manner, and shows two likely arrangements of LEDs 52 as being rectangular and hexagonal arrays. A diffuser 22A in conjunction with the light-emitting characteristics of LEDs 52 causes the variation in intensity of light from LEDs 52 over the rear face of light modulator 20 to be smooth. The '737 publication further discloses that light modulator 20 may be a monochrome light modulator, or a high resolution color light modulator. Light modulator 20 may comprise, for example, a LCD array. The '737 publication discloses that display 60 can be quite thin. For example, display 60 may be 10 centimeters or less in thickness. US 2005/0162737 A1 is hereby incorporated by reference herein.

For merely one example of a two dimensional array of light emitters in the backlight, consider the block diagram 1100 in FIG. 11. FIG. 11 shows one embodiment of the present invention that uses the brightness of priority colors to adjust the brightness gain on non-priority colors. Perceptually quantized R*G*B* data of a given binary bit depth may be linearized by the Gamma function 1110 to be a greater binary bit depth linearly encoded RGB signal. To ensure that the individual emitter 1197 in the backlight array 1195 may be substantially set to the minimum brightness needed to just enclose the image color/brightness gamut in the point spread function of the light emitter underlying the LCD in that region of the image, the linearized RGB color may be surveyed to find the peak value within each point spread function of the light emitters 1197 in the backlight array 1195 by the Color Peak Survey function 1170. The Backlight Array Control may convert the brightness values to appropriate voltages and timing signals to adjust each of the light emitters 1197 in the Backlight Array 1195. The linear RGB may be partially scaled down, as a function of saturation and the Color Gain calculated from the interpolated value of the backlight intensity in that region of the image in the Pre-Reduce function 1120. The partially pre-reduced RGB color data may be converted to RGBW color data in the RGBW GMA 1160 function block.

The RGBW color data is then normalized by the value from the Backlight Interpolation function 1135 in $X/X_L$ normalizing function 1130. The $X/X_L$ normalized RGBW data is subpixel rendered by the SPR function 1140. Because the target LCD 1190 may have a non-linearly quantized electro-optical transfer function, the linear subpixel rendered data may be non-linearly quantized to match the LCD by the Inverse Gamma function 1115. This function may or may not be the inverse of the input Gamma function 1110.

In one embodiment, Backlight Interpolation function may use the value of each light emitter in backlight array, as may be established in Peak Function block, to calculate the distribution of light of each color at each output pixel in display panel overlying light emitter. This distribution may be interpolated from the values of the light emitters established in Peak Function block, taking into account the point spread function (PSF) of each light emitter in array and the presence of diffusers and other optical components. This operation is an "up sampling" function, as indicated by the up arrow, and many possible "up sampling" functions may be suitable. One such function is a summation of the point sample contribution of the PSFs of the local light emitters times their values computed by the down sampling Peak function.

Table 2 provides pseudo-code for provides an example of a Peak Function, called "dopeak," in pseudo code that uses the maximum value of the input image region to determine the value for one light emitter. For simplicity of illustration, this peak function makes the assumptions that the output display panel has a resolution of 8 times that of the backlight array, that the backlight array includes red, green and blue light emitters disposed in a rectangular (or square) array, and that the red, green and blue light emitters are coincident.

Table 2 also provides a backlight interpolation function called "dointerp." This function fetches from a memory area called "ledbuf" (LED buffer) and writes to memory area for storing output color values called "fuzbuf." The function "dointerp" is called once for each input pixel and calculates the effect of all the surrounding backlight point spread functions to produce the color value that would be seen under the input (logical) pixel. The "dointerp" function uses a point spread function for each light emitter that assumes that each pixel can only be affected by the surrounding four light emitters.

TABLE 2

Pseudo-Code for Peak Survey "dopeak" and Backlight Interpolation Function, "dointerp"

```
function dopeak (x,y)          --build backlight image
  local r,g,b
  local Rp,Gp, Bp = 0,0,0
  local i, j
  for i=0, 15 do               --find the peak value
    for j=0,15 do
        r,g,b = spr.fetch("ingam",x*8+1−4,y*8+j−4)
        Rp = math.max(Rp,r)
        Gp = math.max(Gp,g)
        Bp = math.max(Bp,b)
    end
  end
  spr.store("led",x,y,Rp,Gp,Bp)
end
function dointerp(x,y)          --build the effective backlight image
 local xb,yb = math.floor(x/8),math.floor(y/8)    --position of a nearby
                                                  -- backlight
 local xd,yd = spr.band(x,7),spr.band(y,7)    --distance to a nearby LED
 center
 local r,g,b              --color of the backlight centers
 local rs,gs,bs=0,0,0     --sum of the overlapping backlight point spread
                          functions
 local psf                --point spread function for current pixel and LED
 r,g,b = spr.fetch(ledbuf,xb−1,yb−1)    --get LED center color
 psf = math.floor(spread[xd]*spread[yd]/4096)    --calculate point spread
                                                 --function here
 rs = rs + r*psf                         --sum upper left LED
 gs = gs + g*psf
 bs = bs + b*psf
 r,g,b = spr.fetch(ledbuf,xb,yb−1)       --color of upper right LED
 psf = math.floor(spread[7−xd]*spread[yd]/4096) --PSF for this led
 and pixel
 rs = rs + r*psf                         --sum upper left LED
 gs = gs + g*psf
 bs = bs + b*psf
 r,g,b = spr.fetch(ledbuf,xb−1,yb)       --color of lower left LED
 psf = math.floor(spread[xd]*spread[7−yd]/4096) --PSF for this led
 and pixel
 rs = rs + r*psf                         --sum upper left LED
 gs = gs + g*psf
 bs = bs + b*psf
 r,g,b = spr.fetch(ledbuf,xb,yb)         --color of lower right LED
 psf = math.floor(spread[7−xd]*spread[7−yd]/4096) --PSF for this led
 and pixel
 rs = rs + r*psf                         --sum upper left LED
 gs = gs + g*psf
 bs = bs + b*psf
```

TABLE 2-continued

Pseudo-Code for Peak Survey "dopeak" and Backlight Interpolation Function, "dointerp"

```
 rs = math.floor(rs/4096)                --sum was 12bit precision (+2 for
                                         --4 LEDs)
 gs = math.floor(gs/4096)                --colapse them back to 8bits
 bs = math.floor(bs/4096)
 spr.store(fuzbuf,x,y,rs,gs,bs);         --and save in output buffer
end
```

The combination of the two functions, the "down sampling" of the Peak Function followed by the "up sampling" of the Backlight Interpolation function may retain the original resolution of the input image in terms of sample count (image size), but produce a set of output image values with lower spatial frequencies, i.e., a filtered version of the RGB input image data that approximates the distribution of light from the light emitter array. This data is then input to X/XL function. Note that some images may have regions of uniform (i.e., the same) color values. Knowledge of the location of uniform color regions in the image may be used to reduce computational load in GMA function by retaining/reusing values common to the region.

Input image RGB data is first modified by the relationship between the brightness of each incoming RGB value after input gamma function and the actual amount of RGB light available at that given pixel from backlight array, as provided by Backlight Interpolation function. This modification is accomplished in X/XL function by the ratio, X/XL, where X is the incoming value of R, G, or B. and XL is the backlight brightness value at that pixel of RL, GL, or BL. Thus, a given RGB to RGBW gamut mapping algorithm may have the input value R/RL, G/GL, B/BL. Those of skill in the art will appreciate that the use of X/XL function 136 allows for an "off-the-shelf" GMA function to be utilized (e.g., any of the gamut mapping functions disclosed in the above-referenced applications), without a modification needed to accommodate the light contributions of the light emitters in backlight array.

It should be obvious to those skilled in the art that the teachings herein may be adapted to display systems other than those used as examples here. For example, the RGBW panel need not be subpixel rendered, being whole pixel rendered instead. The panel may have more than three saturated color primaries, for example it may comprise a layout with red, green, blue, and yellow (RGBY), or red, green, blue, and cyan (RGBC), or red, green, blue, cyan, and white (RGBCW), or red, green, blue, yellow and white (RGBYW), or other multiprimary panels, subpixel rendered or whole pixel rendered. The backlight may be white or it may be some other color as needed.

In addition, it should also be noted that the backlight illumination may depend on several factors that may work either independently or in concert. For example, backlight illumination may change as a result of changing luminance values in the image data to be rendered; the mode in which the display is being operated (e.g. primarily video rendering as opposed to text rendering); or the amount of out-of-gamut colors detected in the image data. It should also be appreciated that the techniques described herein work with either type of backlight (e.g. unitary or partitioning) as well as for each possible factor that changes backlight illumination.

Additional Embodiments of Dynamic Simultaneous Contrast Control

Figure 12B:
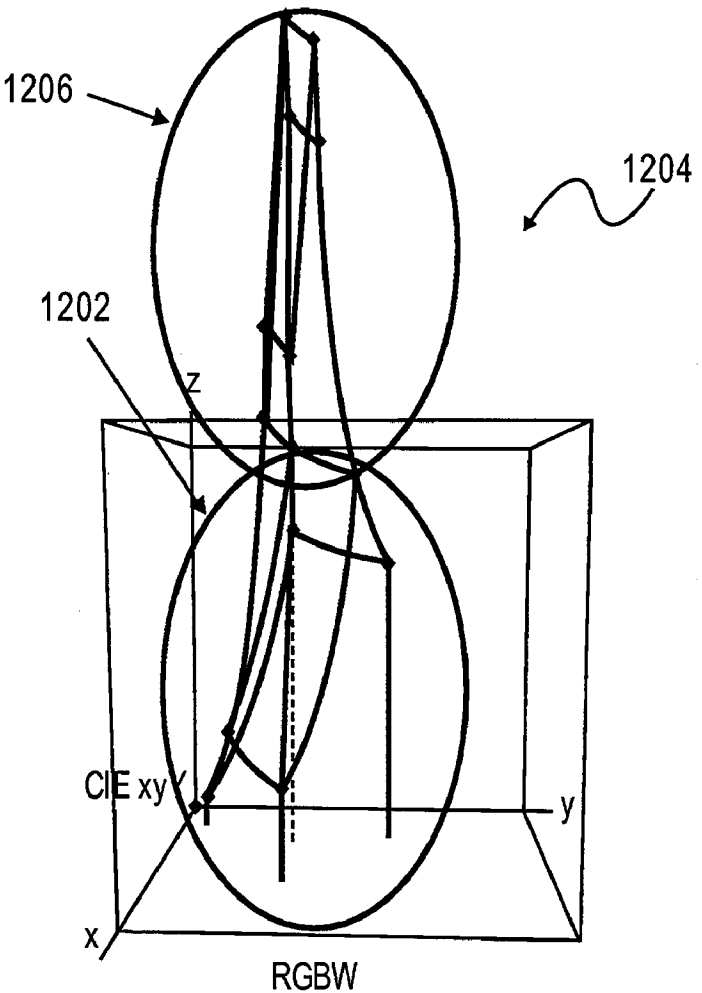
FIGS. 12A and 12B depict the 3-D gamut hulls of an RGB and RGBW display respectively.
Figure 12A:
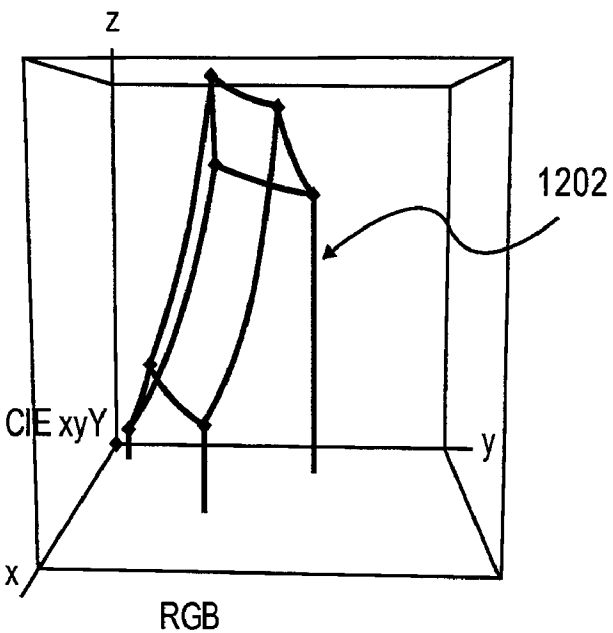

FIGS. 12A and 12B depict the three dimensional gamut hull of an RGB and RGBW display respectively in CIE xyY space. As may be seen in FIG. 12A, the hull 1202 provides a certain space in which in gamut colors may be expressed by a putative RGB display. In FIG. 12B, in general with the addition of a white (W) subpixel in a RGBW display, hull 1204 is expanded, whereby nearly the original hull 1202 has another gamut hull section 1206 added on by virtue of operation of the W (or clear) subpixel. Most notably, the gamut hull is extended in the luminance axis (z) but the saturation of the colors tends to taper going towards peak luminance—which may approximate twice the luminance over that which is possible with an RGB display.

Figure 13:
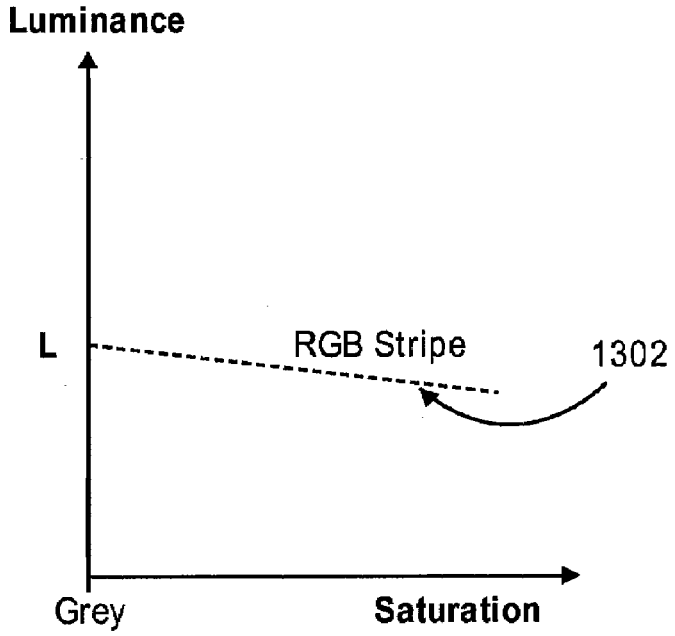
FIGS. 13 and 14 show graphs depicting the slopes of luminance vs. saturation in an RGB display and RGBW display respectively.
Figure 14:
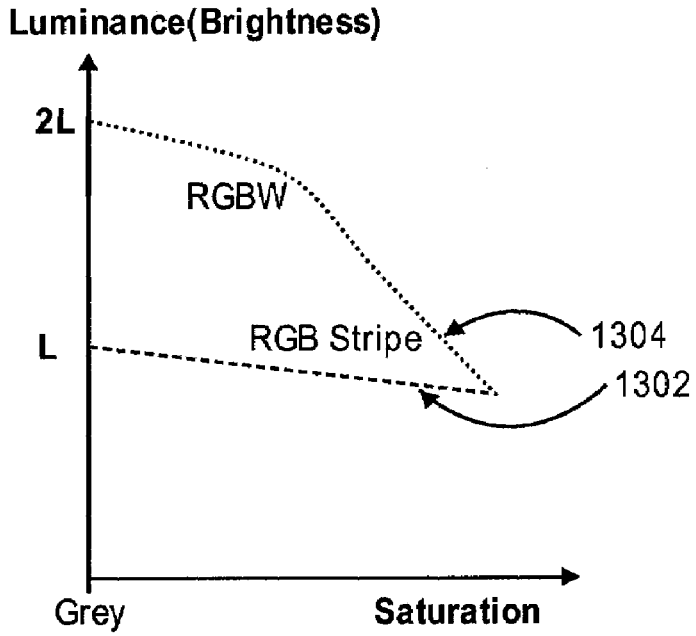

FIGS. 13 and 14 are graphs depicting the slopes of luminance vs. saturation in an RGB display and RGBW display respectively. Slope 1302 depicts a gradual sloping curve of luminance versus saturation—noting that bright saturated colors in an RGB display maintain their relative luminance as the colors become more saturated. However, in a RGBW display, slope 1304 shows a steeper curve as the image may travel from maximum luminance to a bright saturated color. It is noted that, in an RGBW display, for the same power, the luminance of a desaturated color may be as high as 2× brighter than for RGB displays; but that, for the same power, the luminance of pure colors approximates the same as for RGB displays.

Figure 15:
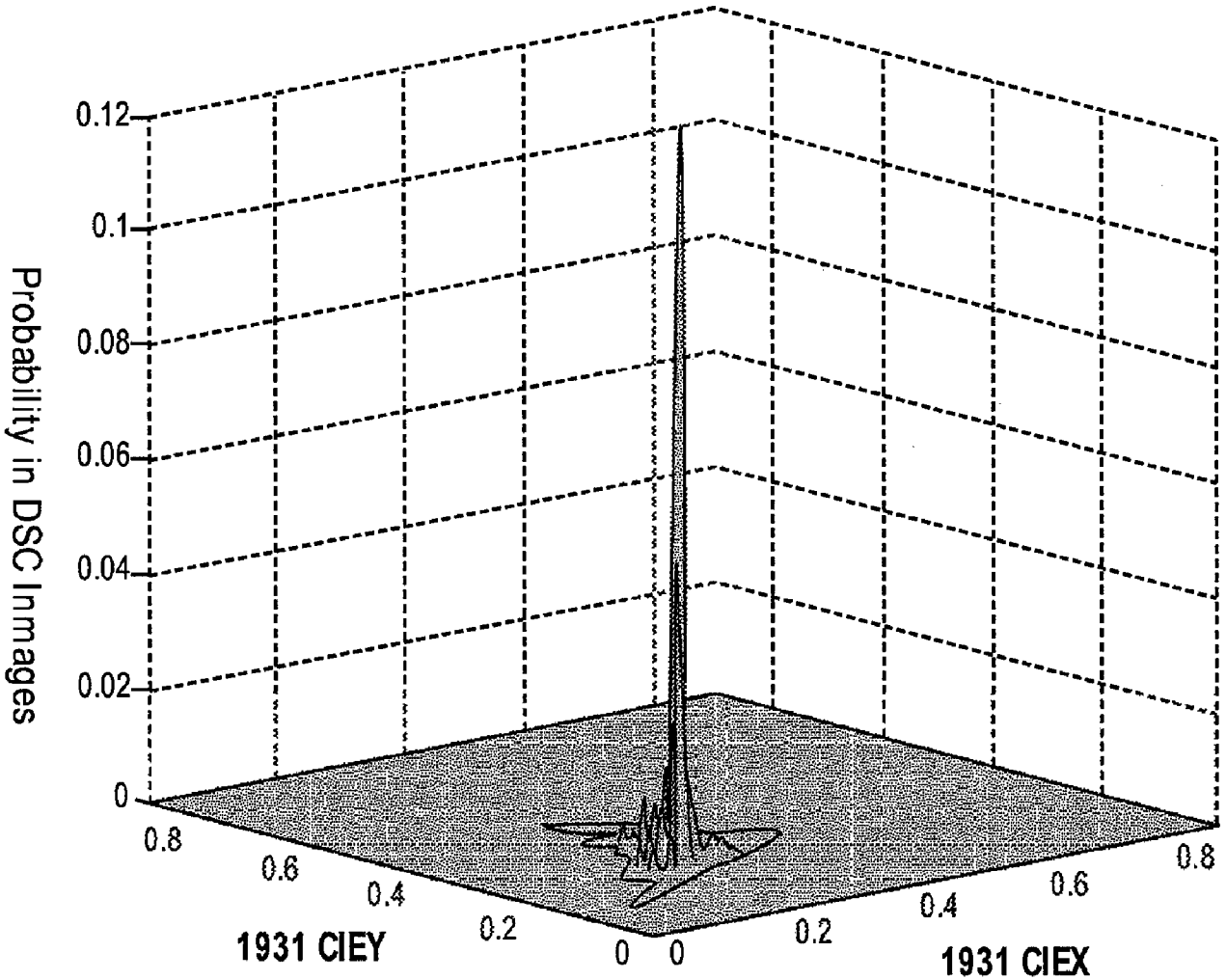
FIGS. 15 and 16 show histogram plots of color values that occur in a large set of natural images and how such a plot matches with the performances of an RGB vs. RGBW display respectively.
Figure 16:
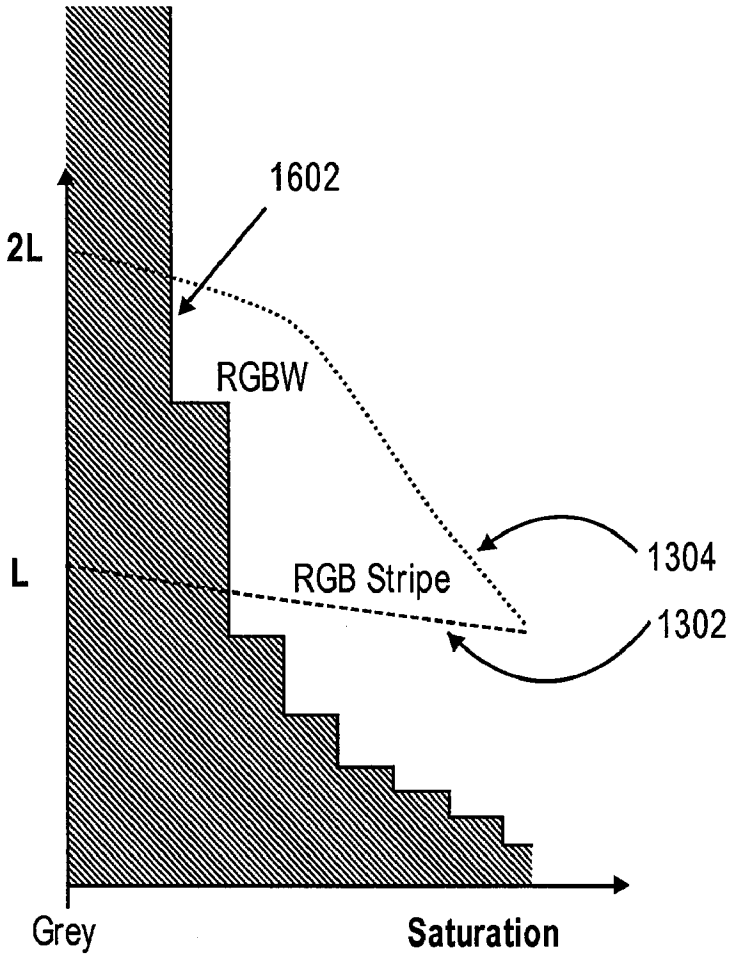

It is important to note; however, for a large set of natural images, a probabilistic histogram plot of color values may assume the following shape as seen in FIG. 15. The peak of the image data points may tend to cluster around a white point—seemingly mirroring the experience of natural images—there may be more desaturated colors (from specular reflections and the like) than bright, saturated colors. FIG. 16 shows how such a putative histogram saturation plot 1602 of image data points might match with the performance of a RGB display versus an RGBW display. As may be seen, the RGBW panel may do a better job in rendering very bright desaturated color images with greater fidelity than the RGB display.

An embodiment of a RGBW display, however, might seek to improve on its typical performance when rendering bright saturated colors. Some embodiments may dynamically alter their performance depending on a number of criteria—either singly or in combination. For example, some criteria might be user selection, application selection or analysis of image data—to mention just a few.

Figure 17:
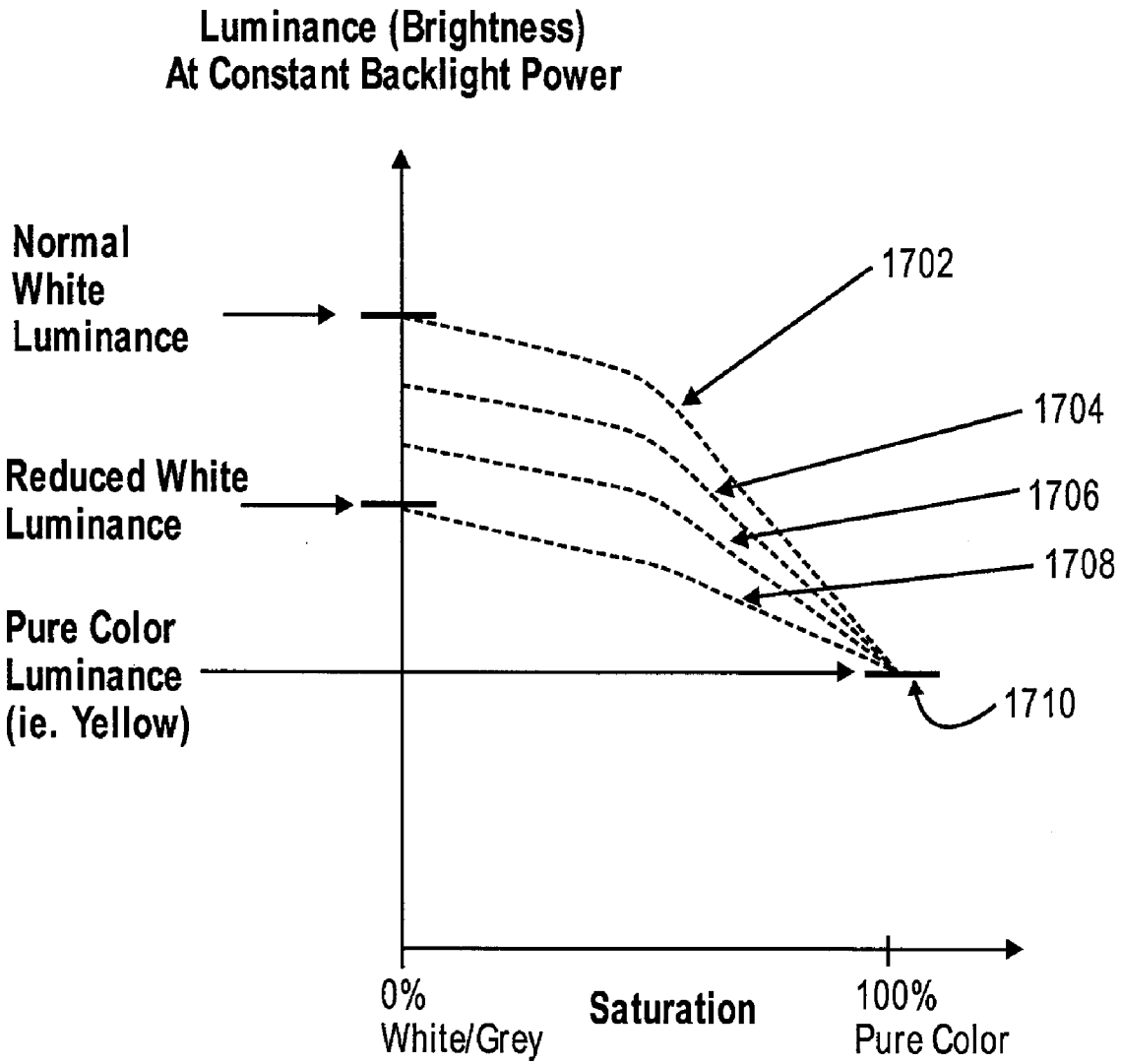
FIG. 17 depicts a first embodiment of a dynamic gamut mapping system that may tend to control simultaneous contrast effects by selecting a mode of operation as depicted by a set of curves in FIG. 17.

FIG. 17 depicts a first embodiment of a dynamic gamut mapping/simultaneous contrast control system and method. As mentioned above, in RGBW display systems, the difference in luminance of white versus the luminance of purely saturated colors tends to be large and this tends to make the pure colors appear darker when they are present simultaneously with bright white colors in a given image. This phenomenon is known as a "simultaneous contrast" effect. In one embodiment, it is possible to effect a saturation-based "prescaling" method to reduce the luminance of unsaturated colors such that the white luminance and pure color luminance values may be closer together—thus reducing the simultaneous contrast.

In FIG. 17, curve 1702 may be termed "Normal Mode" as the mode whose settings create the highest difference or ratio between unsaturated color luminance versus saturated color luminance. Curves 1704, 1706 and 1708 may be termed "Reduced Simultaneous-Contrast Modes" as modes of display operation that could be set to have lower than normal difference or ratio between unsaturated color luminance versus saturated color luminance. During Reduced Simultaneous-Contrast Modes, pure colors will appear brighter than they do in Normal mode; however, this may come at the expense of valuable white brightness which is often required to make displays more viewable in bright ambient conditions. The set of curves, as shown in FIG. 17, may tend to converge to a single point or region of luminance, saturation points (as depicted by point 1710). As noted, this mode of operation may be affected by dropping the luminance of the white subpixel according to a set of criteria.

It will be appreciated in many embodiments that a discrete number, infinite or near-infinite set of curves could define the Reduced Simultaneous-Contrast Modes. In addition, the curves might assume a different shape that a piecewise linear curve in some embodiments and some curves might seek to converge to different points rather than a single point such as 1710.

Figure 18:
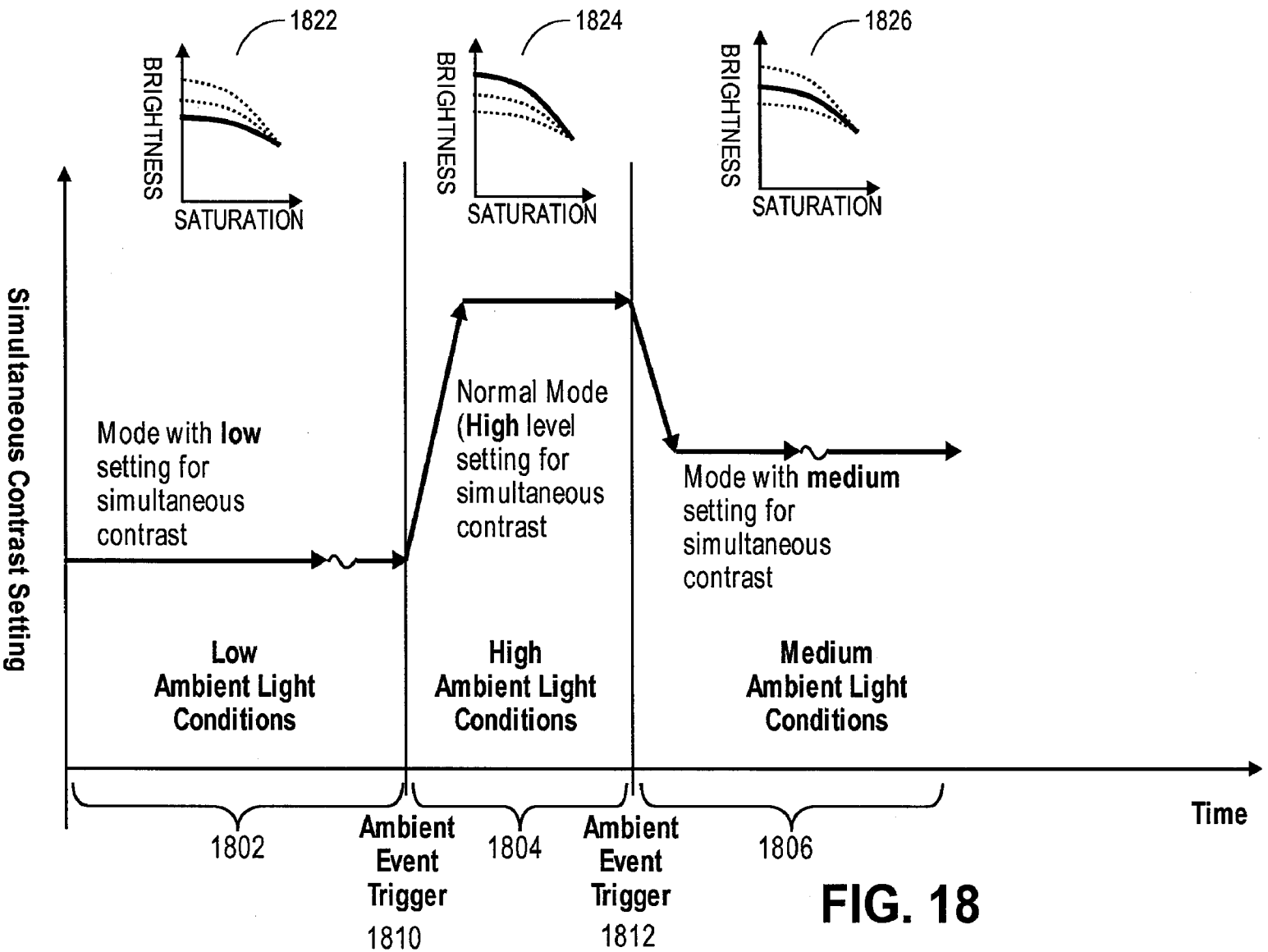
FIG. 18 depicts an exemplary use model of a system of FIG. 17 that employs different modes of operation for gamut mapping and simultaneous contrast control.

One possible embodiment of operation of a system having operating curves shown in FIG. 17 is depicted in FIG. 18. FIG. 18 is one example of operation of such a system over time. The operation of the system could be affected by certain conditions, such as user selection, system selection of mode depending on the application running the display (e.g. text display or video display) or ambient light conditions where the display is in use. In some embodiment, these modes could also run in systems in which do not survey input image data; but might operate and normalize image data according to the predetermined modes that are selected.

For example, period 1802 could be a low ambient light condition, period 1804 a period of high ambient light condition (e.g. the user of a cell phone steps outside from a darker building interior) and period 1806 a period of medium ambient light condition (e.g. where the user may have stepped under an awning outside). Performance curves 1822, 1824 and 1826 could correspond to the performance of the display system respectively.

The changes in the brightness vs. saturation curve performance may occur in a variety of ways. For example, a light sensor communicating with the display device could automatically set the appropriate performance curve. Alternatively, the user could manually set the performance curve to suit the tastes of the user.

Continuing with a putative example, using a sensor to signal the intensity of ambient light, simultaneous contrast settings can be made to track the ambient light conditions. As shown in FIG. 18, in high ambient light, the highest level of simultaneous-contrast may be set since the user might be less concerned with color but more concerned about discerning text and other image objects on the display. In progressively lower ambient light conditions, white brightness may be less important than color performance and so the simultaneous contrast is proportionally reduced to favor pure color performance. It will be appreciated that mode transitions may be implemented to occur suddenly or they can occur smoothly in a sequence of multiple-steps.

Figure 19:
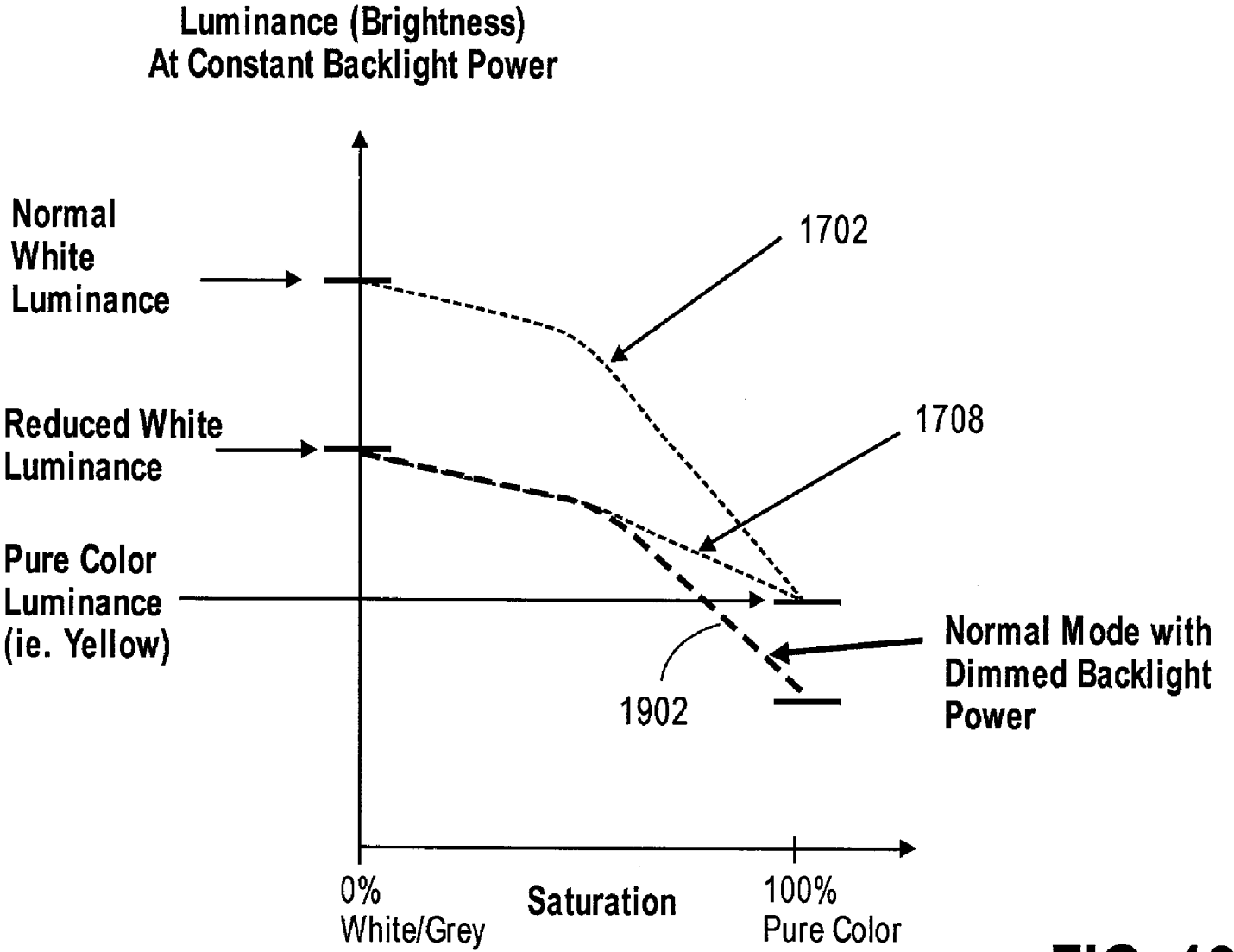
FIG. 19 depicts another embodiment of a dynamic gamut mapping system that may tend to control simultaneous contrast effects.

FIG. 19 depicts yet another embodiment of a dynamically simultaneous contrast control method and system. In FIGS. 17 and 18, it may be assumed or approximated that the backlight would maintain substantially constant luminance (e.g. full power or somewhere less than full power) and the luminance of the white subpixel is dynamically reduced (e.g. by pre-reducing the white luminance). However, in FIG. 19, the reduction of the performance of the white subpixel may be coupled with dynamic control of the backlight luminance. Dimming the backlight of a display lowers its power consumption yet may also effectively lowers its luminance. In FIG. 19, curve 1902 could be termed a "Normal Mode with Dimmed Backlight Power" (contrasting with previously mentioned curves 1702 and 1708). In one embodiment of curve 1902, curve 1902 could be designed such that its white luminance portion coincides with the white luminance of a "Reduced Simultaneous-Contrast Mode" 1708. It should be noted that most unsaturated colors may appear to have the same brightness in either of these modes; however, the Normal Mode With Dimmed Backlight will tend to consume less power yet appear to have dimmer saturated colors.

Figure 20:
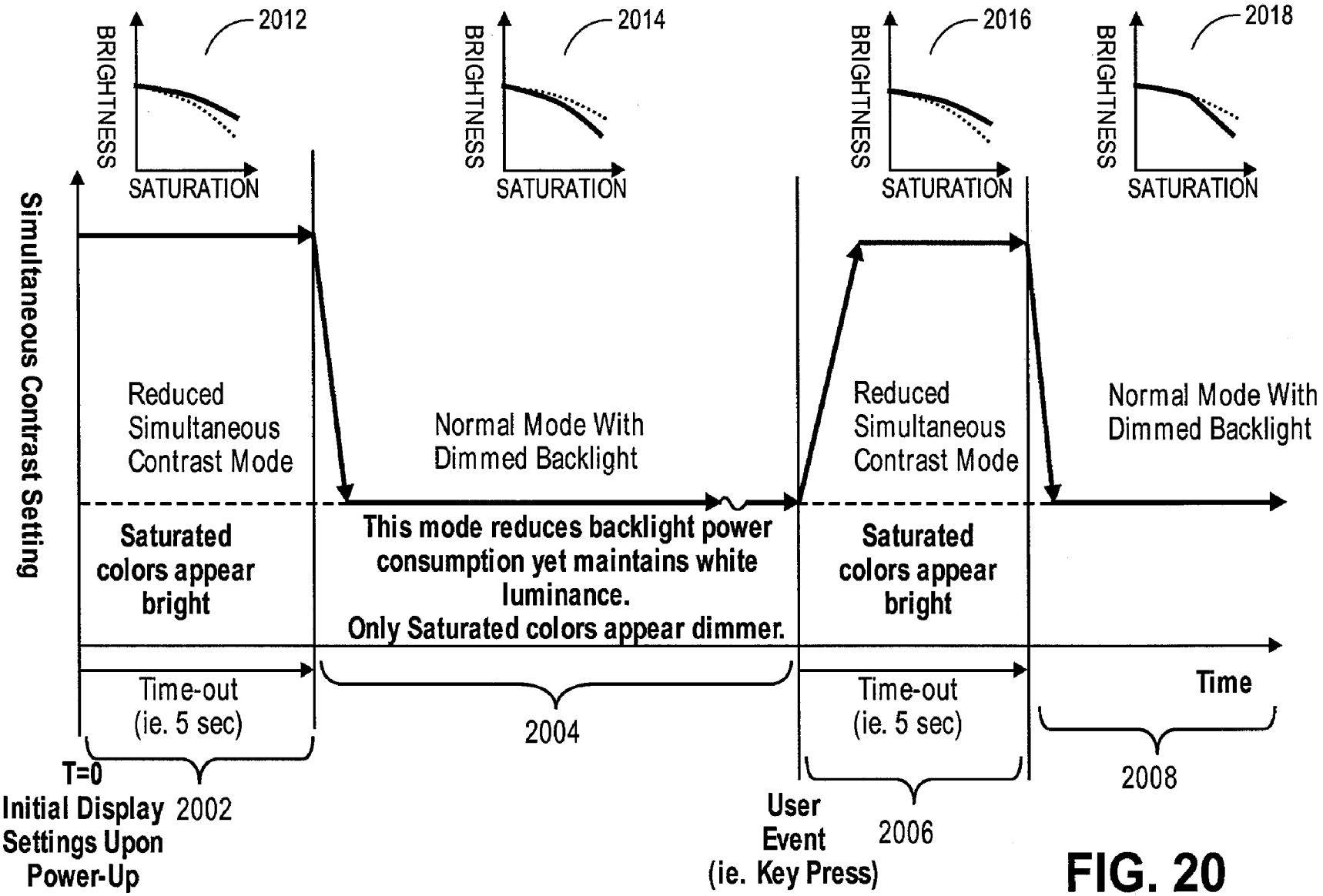
FIG. 20 depicts an exemplary use model of a system of FIG. 19 that employs different modes of operation for gamut mapping and simultaneous contrast control.

FIG. 20 is just one example of the operation of the system of FIG. 19. Again, time periods 2002, 2004, 2006 and 2008 (together with their associated performance curves 2012, 2014, 2016 and 2018 respectively) are depicted. In this example, it could be posited that period 2002 is an initial turning-on of the display system—where it may be desirable to display bright saturated colors. Thus, a Reduced Simultaneous Contrast Mode curve could be selected. After a period of time and going into period 2004, it may be desired to conserve backlight power (e.g. after a time-out period which is preselected or possibly in response to user input)—thus, Normal Mode with Dimmed Backlight might be selected. Over time (and when it is desired to display bright saturated colors), the system could select a curve accordingly. Period 2008 could again be a period of power conservation. As before, simultaneous-contrast mode transitions may occur suddenly or they may occur smoothly in a sequence of multiple-steps. Simultaneous-contrast mode transitions and mode durations may depend not only on user input events, but by preset factory settings or user-defined settings, or other events including but not limited to operating system events (such as battery status, ambient light status, video or still image status), application software events (camera or game status), external events (such as incoming calls and messages).

Additional Prescaling Embodiments

As described above, one possible action taken when detecting out of gamut colors may be to adjust the color prescaling (either saturated or unsaturated) so that colors are more in gamut and adjust the backlight to maintain luminance. Another method to adjust the brightness of colors might be to adjust the saturated color prescaling in combination with the luminance clamping control. For example, if it is desirable to increase the brightness of saturated colors, but keep the backlight level lower (to save power), one may allow saturated colors to go out of gamut by a given percentage and then clamp the values towards the luma axis. This may tend to increase the brightness by slightly desaturating the color. Since the prescaling of each primary color can independently be set, the color desaturation can be localized.

Figure 24:
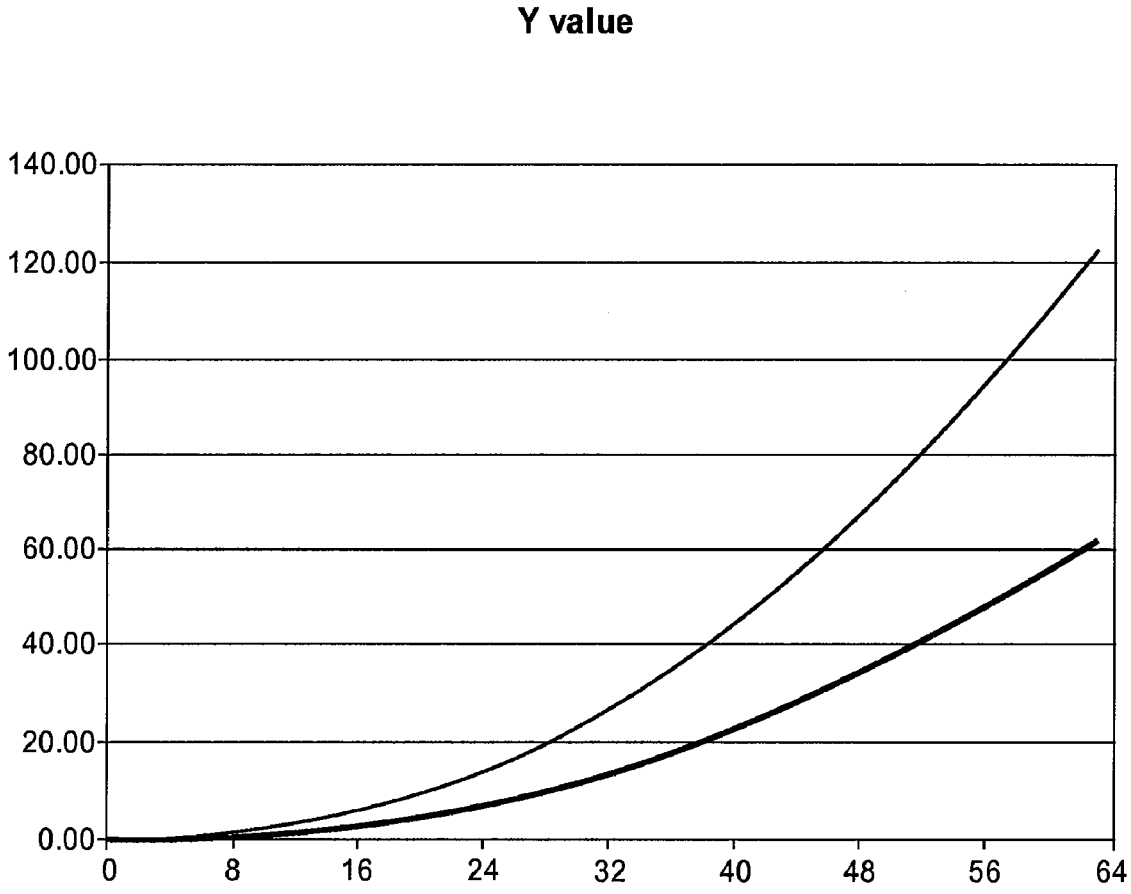
FIGS. 24 through 25 depict performance curves of luminance versus image data settings comparing RGB and RGBW displays and color errors between the two displays respectively.

With reference to FIG. 24, the luminance of black to green ramp is shown; the top curve is target luminance; while the bottom curve is RGBW output with prescaling set to 1 for unsaturated and 0.5 for saturated colors. Since this curve is for saturated colors only, it should be noted that the brightness is one half of target and the colors appear dark. To represent the correct luminance in this case, the backlight power may be doubled.

Figure 25:
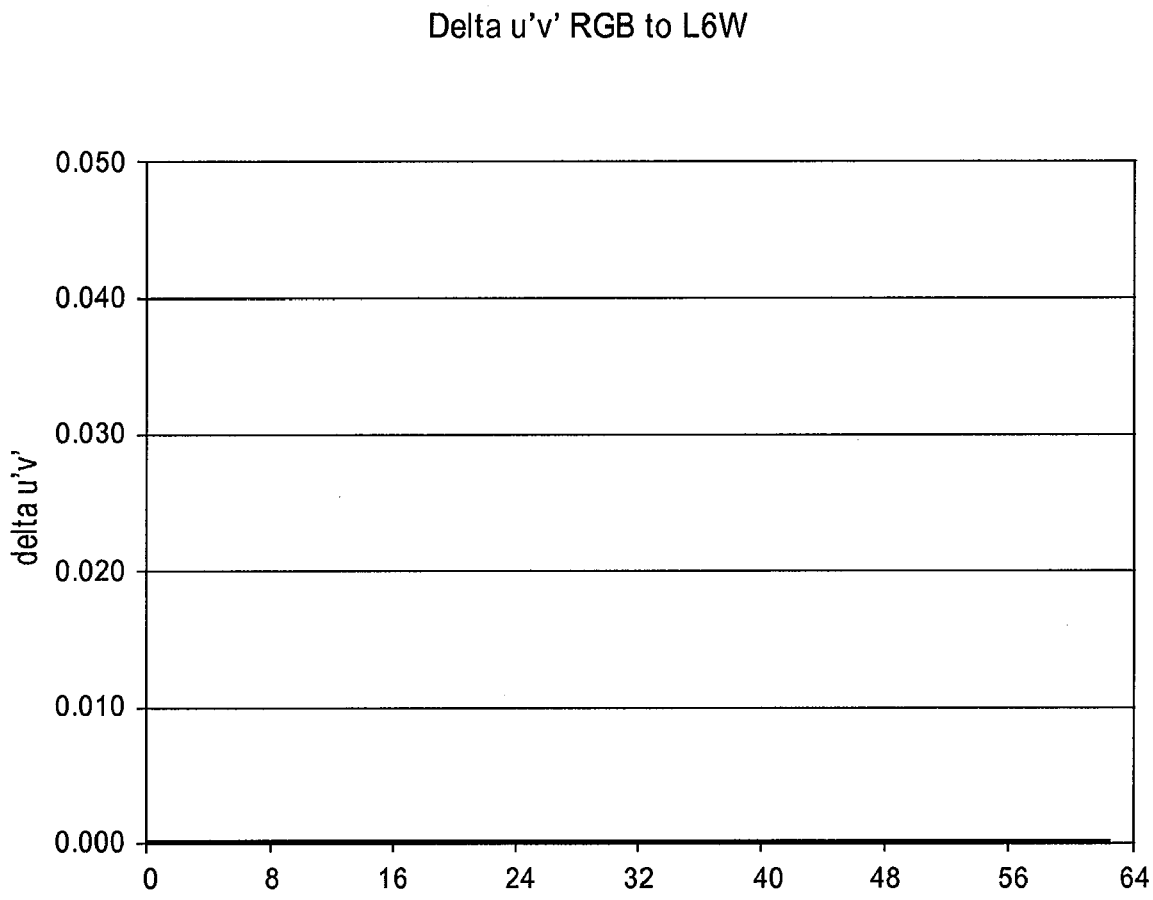

FIG. 25 depicts the situation with prescaling set as stated above, there may be no theoretical error in color point (u'v'). However, if the saturated color prescaling is set to 0.75 and the clamping set to 0.5 (half way between clamp to black and clamp to luma), then the brightness will be increased with no change in backlight but color shift may be introduced.

Figure 26:
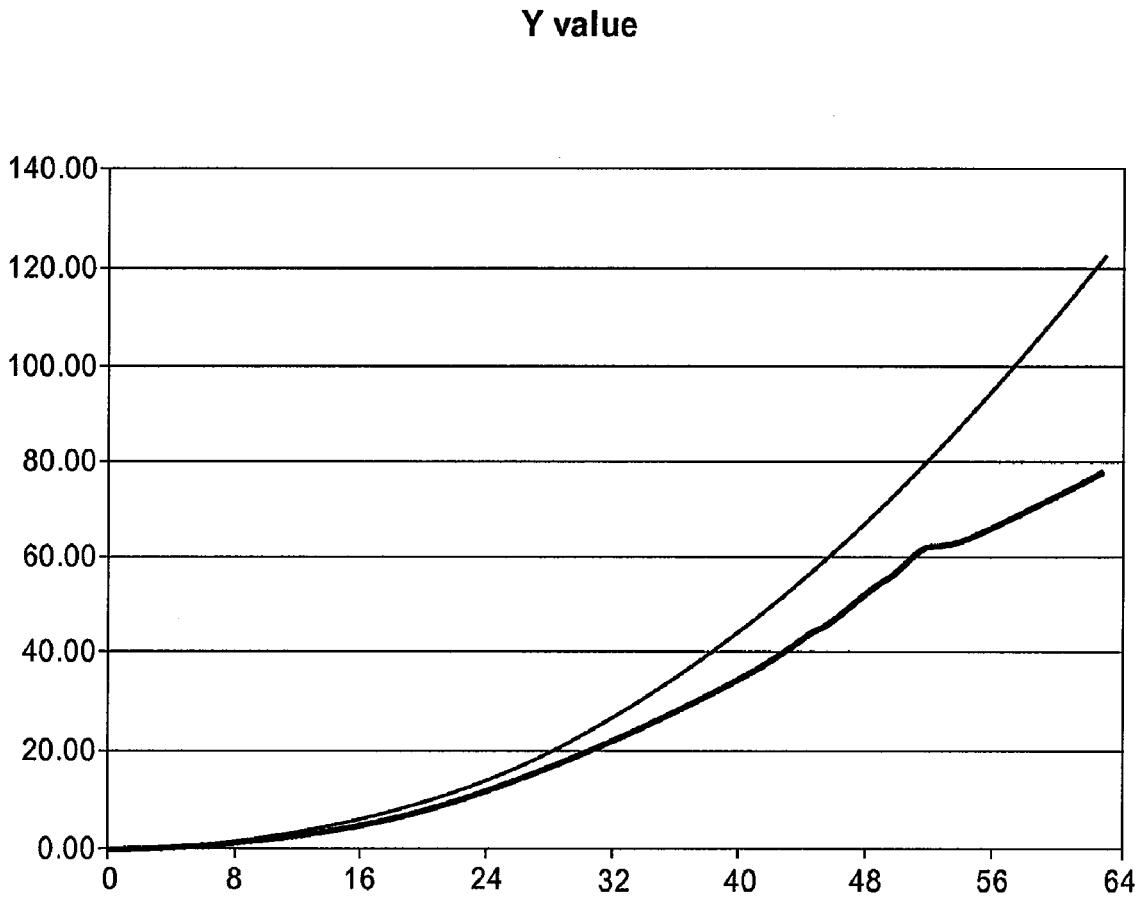
FIGS. 26 through 27 depict performance curves of luminance versus image data settings comparing RGB and RGBW displays and color errors between the two displays respectively.
Figure 27:
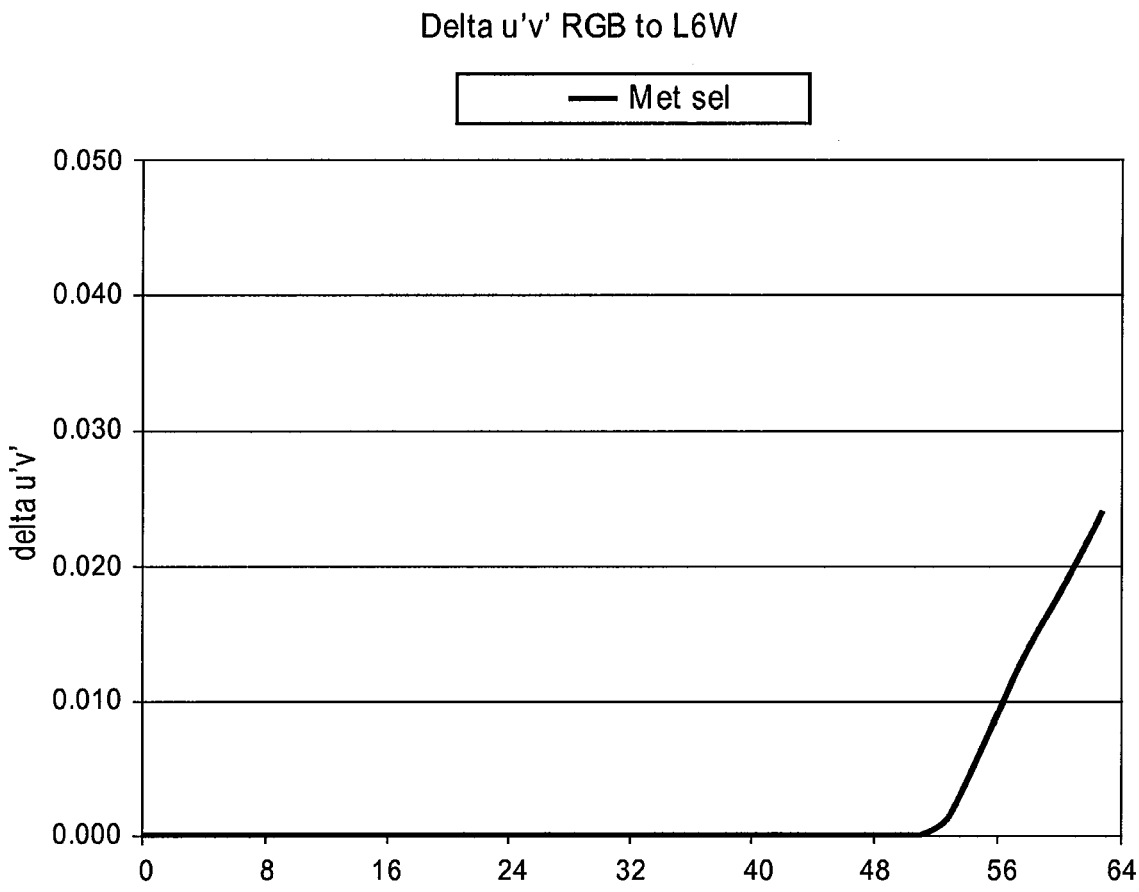

FIG. 26 shows the situation when saturated prescaling set to 0.75. It should be noted that brightness increases by 33%. FIG. 27 depicts the situation of Delta u'v' showing desaturation of 0.025 at maximum input level (63 in this case). This may be noticeable change but may be acceptable for some applications.

In another embodiment, when out of gamut mixed colors are detected, especially cyan, magenta or yellow (or some other priority color, as mentioned above), a cyan, magenta or yellow boost (CMY boost) function, as described below, may be energized to increase the brightness of those colors. In this manner, no backlight change may be necessary and power may be conserved. It should be appreciated that any combination of unsaturated color prescaling, saturated color prescaling, or CMY boost can be used to optimize the system for best performance and lowest power. It should also be appreciated that the independent control of both unsaturated and saturated color prescaling allows the independent adjustment of color points as the backlight and scaling value change. For example, if the color coordinates change if gray level, as is often the case for LCDs, then the prescaling values can be set to compensate for this change, resulting in more accurate color rendition.

CMY Boost Function

With any RGBW or multiprimary system (including not only the novel ones described in the '575 application but also in conventional ones, like RGBW quad systems), the problem of "simultaneous contrast" is an issue that arises with rendering images having pure (or highly saturated) colors rendered against a white or very light background. In fact, such saturated colors would tend to look dark against such a white or light background. This is especially evident for yellow, cyan and possibly magenta—which are bright mixed colors. This discussion provides a possible solution to the problem of displaying these bright mixed colors on a display with RGBW (or "X") primary colors. In general the techniques disclosed herein examine the input color image data for "major colors" and a "minor color" to determine which section of the color space an input color image data value is located. For example, if the input color image data is specified as RGB data, and the R and G data values are high and the B value is low, then the color is near yellow; if R and B are high and G is low, then the color is near magenta; and if B and G are high and R is low, then the color is near cyan. When such a condition is met, the technique computes a substitute color value for the low valued color data value. In effect, the technique seeks to adjust the level of the low valued color, referred to as "boost," in a manner that allows for smooth color transitions (i.e., the "boost" decreases smoothly) as the minor color increases or as the major colors decrease.

It will be appreciated that, even though "CMY Boost" refer to cyan, magenta and yellow, these colors are merely exemplary and any other set of suitable colors may advantageously use the techniques discussed herein.

A CMY boost block may be placed in many possible locations within an image pipeline. In these embodiments, the techniques of boost block may be placed before input gamma block, immediately after GMA block. Of course, a CMY boost block can be placed in other parts of the image processing pipeline, including before or after the output gamma block.

One embodiment of the boost function proceeds as follows: the system reads in both the input data and various operating parameters respectively. For merely one embodiment, the boost block could process the input data as red, green and blue image data to affect primarily Cyan (C), Magenta (M) and Yellow (Y). Of course, it will be appreciated other color points could be made to work as well with other mixed color points that suffer simultaneous contrast issues.

Then, a set of parameters may be read in—e.g. Ymax, Cmax, Mmax, Width and Maxcol. Parameters Ymax, Cmax, Mmax and width determine the slope and intercept of the gain curves. Maxcol is the total number of colors for a given color—e.g. 255 for 8 bit data.

The system may then apply a set of conditions. Each of these conditions tests to see if there are mixed colors that might suffer simultaneous contrast. For example, IF R,G>B tests if the color is primarily yellow; IF R,B>G tests if the color is primarily magenta; and if B, G>R tests if the color is primarily cyan. If none of the three tests is satisfied, processing may proceeds down a "No" path, and no boost is made to the input color. If, however, one of the tests is satisfied, then an appropriate change to the input image color data may be made accordingly. For example, the input RGB data values could be sorted first to directly find which of the tests is the appropriate test to apply.

For each step, there could be gain curves and an exemplary formula for processing the data. In general, the processing may selectively desaturate mixed colors (e.g. C, M and/or Y) with a prescribed function in such a way as to not introduce step artifacts. In the case of example above (i.e. three mixed colors C, M or Y), three functions may be developed that depend on the location of the "boost" function (i.e. C, M or Y respectively). If there are more mixed colors to be boosted, then other functions may appropriately be added.

As noted above, the processing looks for "major colors" and "minor color" to determine which section of color space an input color image data value (e.g., an RGB value) is located. For example, if R and G are high and B is low, then the color is near yellow; if R and B are high and G is low, then the color is near magenta; and if B and G are high and R is low, then the color is near cyan. If such a condition is met, then the system seeks to adjust the level of "boost" of the low valued color, so that the boost decreases smoothly as the minor color increases or as the major colors decrease. If R and G are high and B is low, a possible function to boost for blue (B) may be computed as:

$$B=B+\min(\min(\text{Gain_}R,\text{Gain_}G)*\text{Gain_}B,\text{maxcol})$$

and R and G remain the same. If R and B are high and G is low, a possible boost for green (G) is computed as:

$$G=G+\min(\min(\text{Gain_}R,\text{Gain_}B)*\text{Gain_}G,\text{maxcol})$$

and R and B remain the same. If B and G are high and R is low, a possible boost for red (R) is computed as:

$$R=R+\min(\min(\text{Gain_}B,\text{Gain_}G)*\text{Gain_}R,\text{maxcol}$$

and B and G remain the same. Various functions may suffice for such boost processing—i.e. to decrease boost—including a linear drop, as either minor color increases or major colors decrease. The slope of the function may determine how localized the boost is.

Table 3 provides a possible embodiment of computing boost functions that work for our exemplary mixed colors of yellow, cyan and magenta, respectively:

TABLE 3

EXAMPLE BOOST FUNCTIONS

```
Function boost_y(red, green, blue, redmax, greenmax, bluemax, width,
colors)
  maxcol = colors
  gainblue = Max((bluemax / width) * (width − blue / maxcol), 0)
  gainred = Max((1 / (1 − width)) * (red / maxcol − width), 0)
  gaingreen = Max((1 / (1 − width)) * (green / maxcol − width), 0)
  boost_y = Min((Int((Min(gainred, gaingreen)) * gainblue)), maxcol)
End Function
Function boost_c(red, green, blue, redmax, greenmax, bluemax, width,
colors)
  maxcol = colors
  gainred = Max((redmax / width) * (width − red / maxcol), 0)
  gainblue = Max((1 / (1 − width)) * (blue / maxcol − width), 0)
  gaingreen = Max((1 / (1 − width)) * (green / maxcol − width), 0)
```

TABLE 3-continued

EXAMPLE BOOST FUNCTIONS

```
  boost_c = Min((Int((Min(gainblue, gaingreen)) * gainred)), maxcol)
End Function
Function boost_m(red, green, blue, redmax, greenmax, bluemax,
width, colors)
  maxcol = colors
  gaingreen = Max((greenmax / width) * (width − green / maxcol), 0)
  gainblue = Max((1 / (1 − width)) * (blue / maxcol − width), 0)
  gainred = Max((1 / (1 − width)) * (red / maxcol − width), 0)
  boost_m = Min((Int((Min(gainblue, gainred)) * gaingreen)), maxcol)
End Function
```

In the above example, the functions used may be a linear ramp with a max value of redmax (for cyan boost), greenmax (for magenta boost), and bluemax (for yellow boost). "Width" is a value that determines the intercept of the boost function at the y axis. These equations create a "gain" function for each color, which is used to modify the minor color (or white).

Decay Systems and Methods for Dynamic Gamut Mapping

Temporal artifacts may be visible when large changes in the backlight brightness and compensating LCD values occur. When a given portion of an image changes brightness or saturation, from one frame to another, such that it becomes desirable to change the backlight brightness, either brighter or lower, another portion of the image may not have changed. Thus, the change in backlight brightness may be accompanied by an opposite change in the LCD value. However, although the LCD is commanded to change instantaneously, the actual response of the liquid crystal material is slow to respond. This may create an optical lag condition that may create visible bright and dark "flashes". For example, consider the graph in FIG. 21. When the backlight brightness 2110 goes from low to high, the LCD transmissivity command 2120 goes from high to low value to maintain the same color/brightness to the viewer. Similarly, when the backlight brightness 2110 goes from high to low, the LCD transmissivity command 2120 goes from low to high value to maintain the same color/brightness to the viewer. However, the LCD transmissivity actual response 2125 may be slow, typically exhibiting a near logarithmic asymptotic approach to the new LCD transmissivity command value 2120. The difference 2150 & 2155 in the LCD transmissivity actual response 2125 and backlight brightness 2110 may create temporary color/brightness error that may be visible.

It should be noted that this potential visual effect is true whether the backlight of the system is a unitary backlight (i.e. one backlight unit that illuminates the entire display area of the LCD) or whether the backlight tends to partition the LCD display area (e.g. as is found with a low resolution LED backlight where each LED is separately controllable and addressable, as in FIG. 11). It should also be noted that the backlight illumination may depend on several factors that may work either independently or in concert. For example, backlight illumination may change as a result of changing luminance values in the image data to be rendered; the mode in which the display is being operated (e.g. primarily video rendering as opposed to text rendering); or the amount of out-of-gamut colors detected in the image data. It should also be appreciated that the techniques described herein work with either type of backlight (e.g. unitary or partitioning) as well as for each possible factor that changes backlight illumination.

Figure 21:
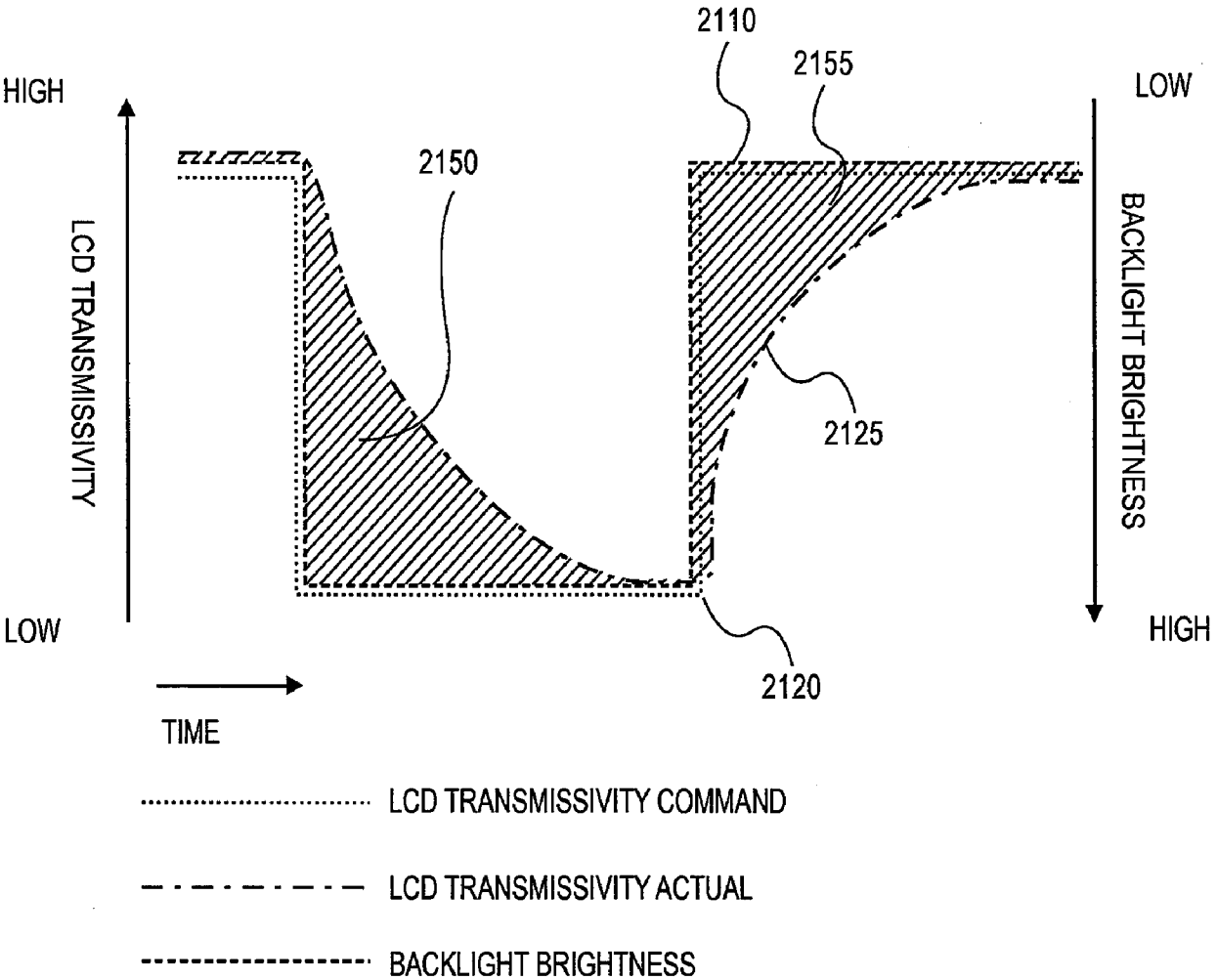
FIG. 21 depicts some exemplary visual effects that may occur in a system that employs a fast responding backlight and lower responding transparent modulating display.

With continued reference to FIG. 21, when the backlight brightness 2110 goes from low to high, the LCD transmissivity actual response 2125 value goes from high to low value too slowly to maintain the same color/brightness to the viewer, allowing too much light 2150, creating a bright flash. Similarly, when the backlight brightness 2110 goes from high to low, the LCD transmissivity actual 2125 goes from low to high value too slowly to maintain the same color/brightness to the viewer, not allowing enough light 2155, creating a dark flash.

Figure 22:
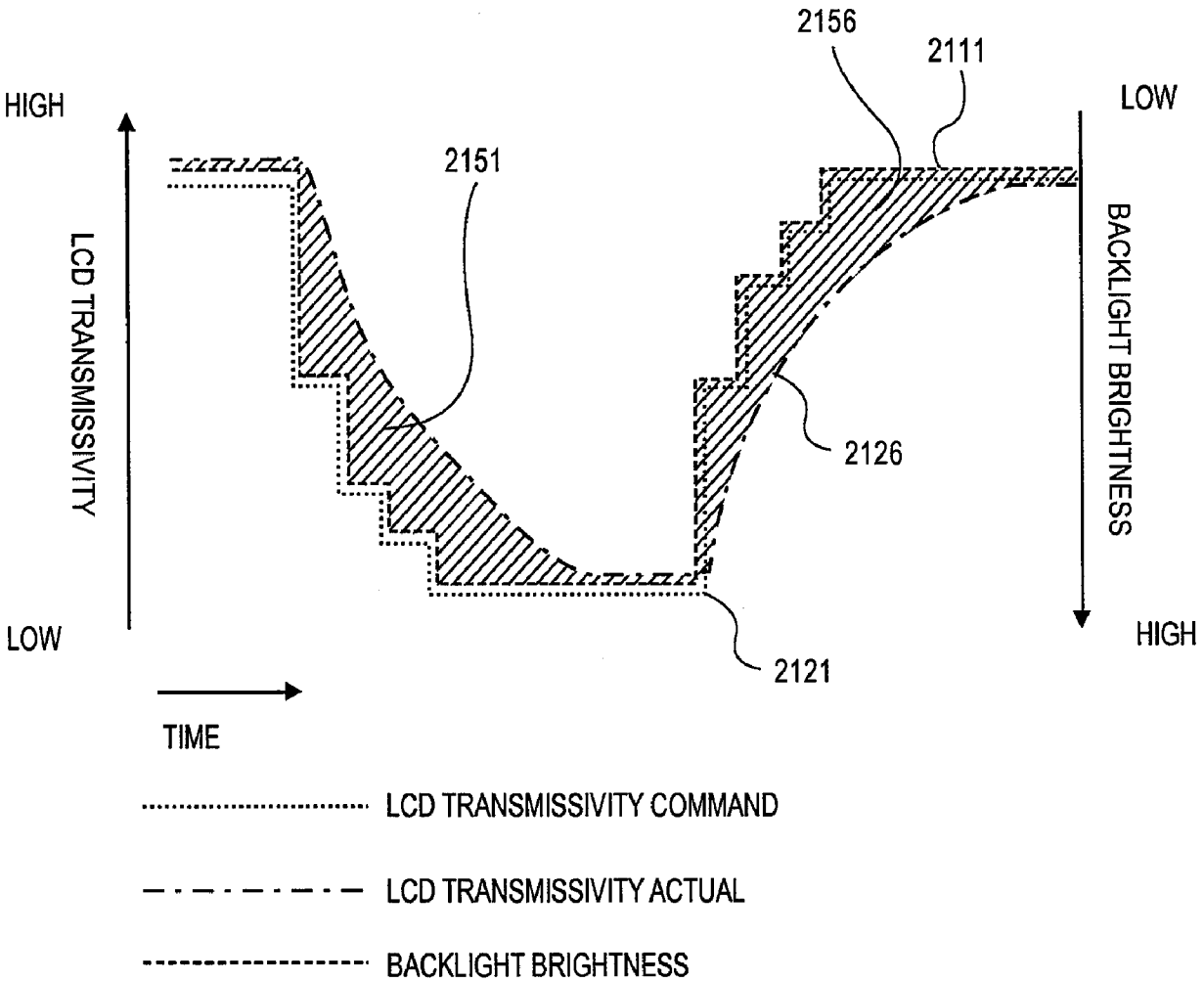
FIG. 22 depict one embodiment of a delaying or decaying method that may be employed to minimize the visual effects as depicted in FIG. 21.

One possible method of reducing the temporal artifact is to slow both the LCD transmissivity command 2121 and backlight brightness 2111 as shown in FIG. 22. This may be done using any possible curve of decaying or decreasing illumination allowable by a backlight and LCD. For merely one example, such a curve could be a series of steps with decreasing amplitude as shown in FIG. 22. In such a system, this slows down the LCD transmissivity actual 2126 response, but this response was slow already. However, it should be noted that the difference between the backlight brightness and the LCD transmissivity actual signal 2151 & 2156 is reduced compared to the difference 2150 & 2155, shown in FIG. 21, when the backlight is changed in only one step. As before, when the backlight brightness 2111 goes from low to high, the LCD transmissivity actual 2126 value goes from high to low value too slowly to maintain the same color/brightness to the viewer, allowing too much light 2151, creating a bright flash. Similarly, when the backlight brightness 2111 goes from high to low, the LCD transmissivity actual 2126 goes from low to high value too slowly to maintain the same color/brightness to the viewer, not allowing enough light 2156, creating a dark flash.

Figure 23A:
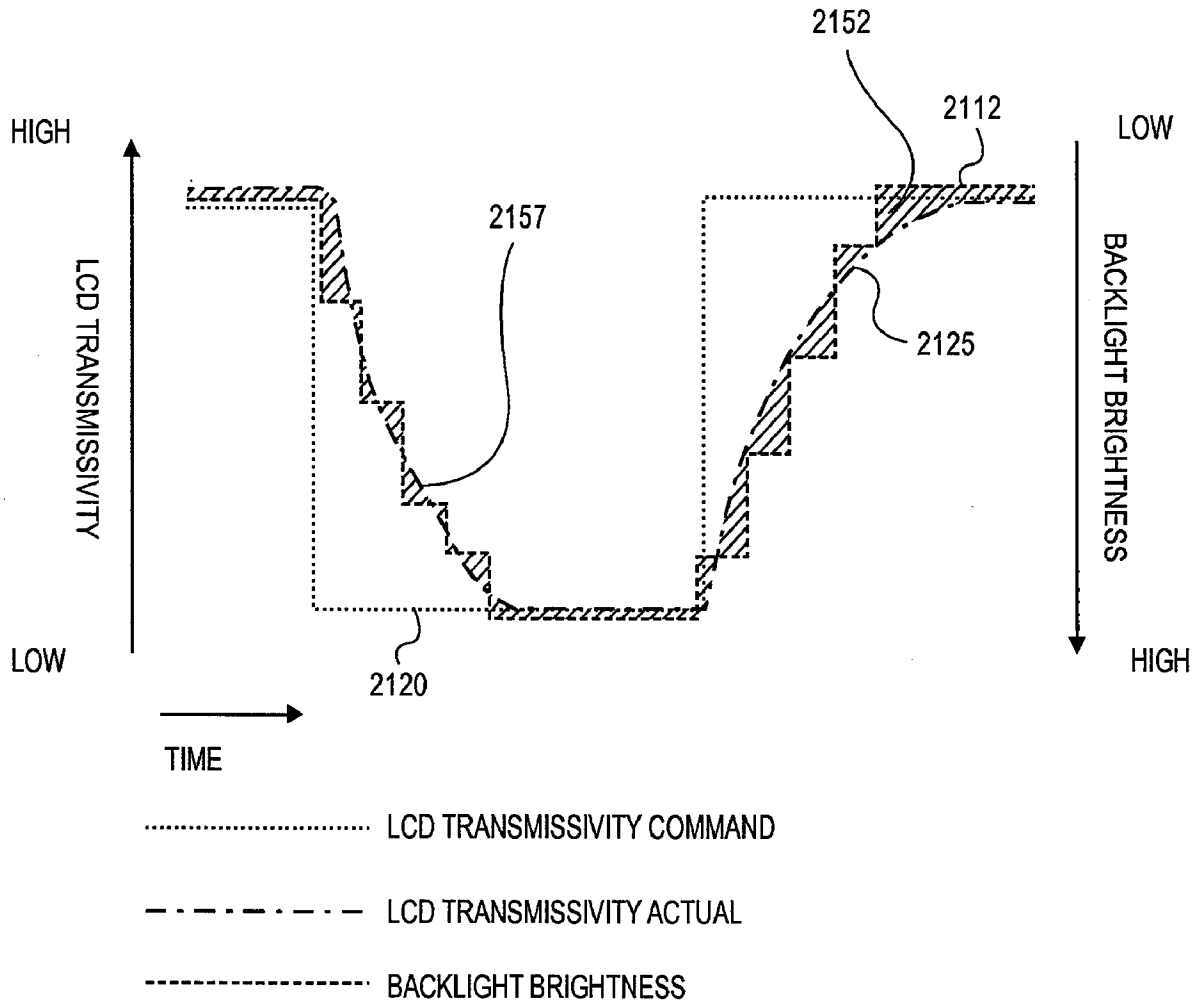
FIGS. 23A and 23B depict other different embodiments of delaying or decaying methods that may be employed to minimize the visual effects as depicted in FIG. 21.

Another possible method of reducing the temporal artifact is to slow only the backlight brightness 2112 as shown in FIG. 23A. This may be done using any suitable decay curve allowable by the backlight—e.g. a series of steps with decreasing amplitude, as shown. This leaves the LCD transmissivity command 2110 and LCD transmissivity actual 2125 response unchanged. The difference between the backlight brightness 2112 and the LCD transmissivity actual 2125 signal 2152 & 2157 is reduced compared to the difference 2150 & 2155, shown in FIG. 21, when the backlight is changed in one step. If adjusted properly, the difference 2152 & 2157 may also be less than the difference 2151 & 2156 when both the backlight brightness 2111 and LCD transmissivity command 2121 are slowed by the same amount. In this case, both the backlight brightness 2112 goes from low to high, or from high to low, and the LCD transmissivity actual 2125 value goes from high to low, or from low to high, value slowly to approximately maintain the same color/brightness to the viewer, allowing too much light 2152 on parts of the steps and not enough light 2157 on other parts of the steps, creating bright and dark flashes at a high rate that are both lower amplitude and less visible, due to the high temporal rate, to the Human Vision System.

Figure 23B:
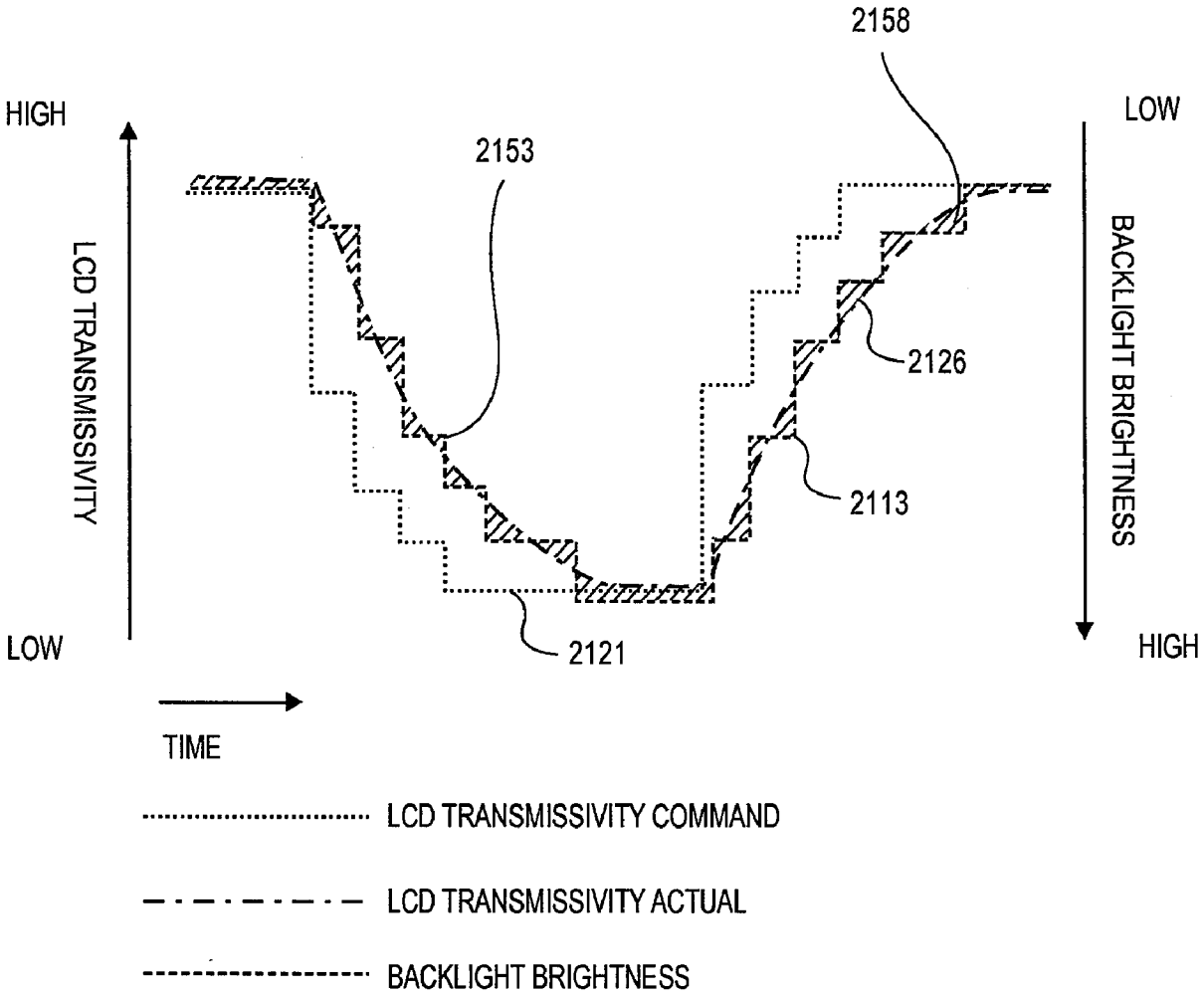

Yet another possible method of reducing the temporal artifact is to slow both the LCD transmissivity command 2121 and backlight brightness 2113, with the backlight brightness 2113 slower than the LCD transmissivity command 2121 as shown in FIG. 23B. This may be done any decay curve allowable by both the LCD and the backlight—e.g. using a series of steps with decreasing amplitude. The difference between the backlight brightness 2113 and the LCD transmissivity actual signal 2153 & 2158 is reduced compared to the difference 2150 & 2155, shown in FIG. 21, when the backlight is changed in one step. If adjusted properly, the difference 2153 & 2158 may also be less than the difference 2151 & 2156 when both the backlight brightness 2111 and LCD transmissivity command 2121 are slowed by the same amount. In this case, both the backlight brightness 2113 goes from low to high, or from high to low, and the LCD transmissivity actual 2126 value goes from high to low, or from low to high, value slowly to approximately maintain the same color/brightness to the viewer, allowing too much light 2153 on parts of the steps and not enough light 2158 on other parts of the steps, creating bright and dark flashes at a high rate that are both lower amplitude and less visible, due to the high temporal rate, to the Human Vision System.

For many of the embodiments for dynamic gamut mapping above, once a change to the backlight luminance is calculated (e.g. either from user modes without regard to particular image data values or from regarding the image data itself), this change may be made substantially instantaneously. In some cases, however, it may be desirable to delaying or decaying the changes to the backlight luminance—e.g. either the entire change or to make the changes in multiple steps so as approach the desired change. There may be two reasons for decaying any changes in the backlight value. One may be to reduce flicker when the input image is changing rapidly. Another might be to compensate for the slow response of LCD shutters when they are changed by large amounts.

Although many possible delay or decay schemes are possible to implement (and the present application encompasses these other methods), one embodiment could be a logarithmic decay algorithm which may be simple to implement. This embodiment may take a weighted average of the previous and the next value and replaces the previous value with the result. The simplest form of this is previous=(previous+next)/2 which will converge on a new value in a maximum of 8 steps when the difference between the previous and next is an 8 bit number. This is the "binary decay" formula because it moves half of the remaining distance at every step.

Another embodiment could be a more general form is a weighted logarithmic decay: previous=(previous*(1−weight)+next*weight). If the weight value is one half, this is the same as the previous formula. In an integer (hardware) environment, it is possible to represent the weight as a fixed point binary number. For example, if this is an 8 bit value, one possible formula might be:

```
Previous=(previous*(256−weight)+next*weight+
    round)/256
```

Where weight may be a value from 0 to 256. If Weight=128, then this is the binary decay case. If Weight=0, then this would have the effect of ignoring the next value and sticking with the previous, and Weight=256 ignores the previous value and switches to the new value at every step (rapid decay). Of course, implementing the case of 256 may not be needed in some embodiments, in which case, it may not be necessary to implement an extra bit in the registers and multipliers to handle this 9 bit number.

If the above formula is implemented in integer arithmetic then, if the round variable has the value of zero, the formula may not converges on a constant next value that is higher than the previous value. If the round variable is 128 (one half the divisor) then the formula may not converge on a constant next value that is lower than the previous value. One embodiment might be to set the round value based on the difference between the previous and next values:

```
if next > previous then
   round = 255
else
   round = 0
end
```

If this test is done beforehand, then the formula may converge in either direction. An 8 bit fixed point weight value might use 8*8=16 bit multipliers, with 8 bits being shifted off after the additions. Also note that in binary calculations, the value (256-weight) may be calculated by inverting every bit in the weight value.

If a lower gate count is desired, the number of bits in the weight value may be reduced. However, this may decrease the number of different decay rates that to choose from. For example, if the weight value only has 4 bits, then there may be only 16 weight values to choose from, the round value will be set to 15 for converging up, and the multipliers would be 8*4=12 bits with 4 bits shifted off after the additions.

Figure 28:
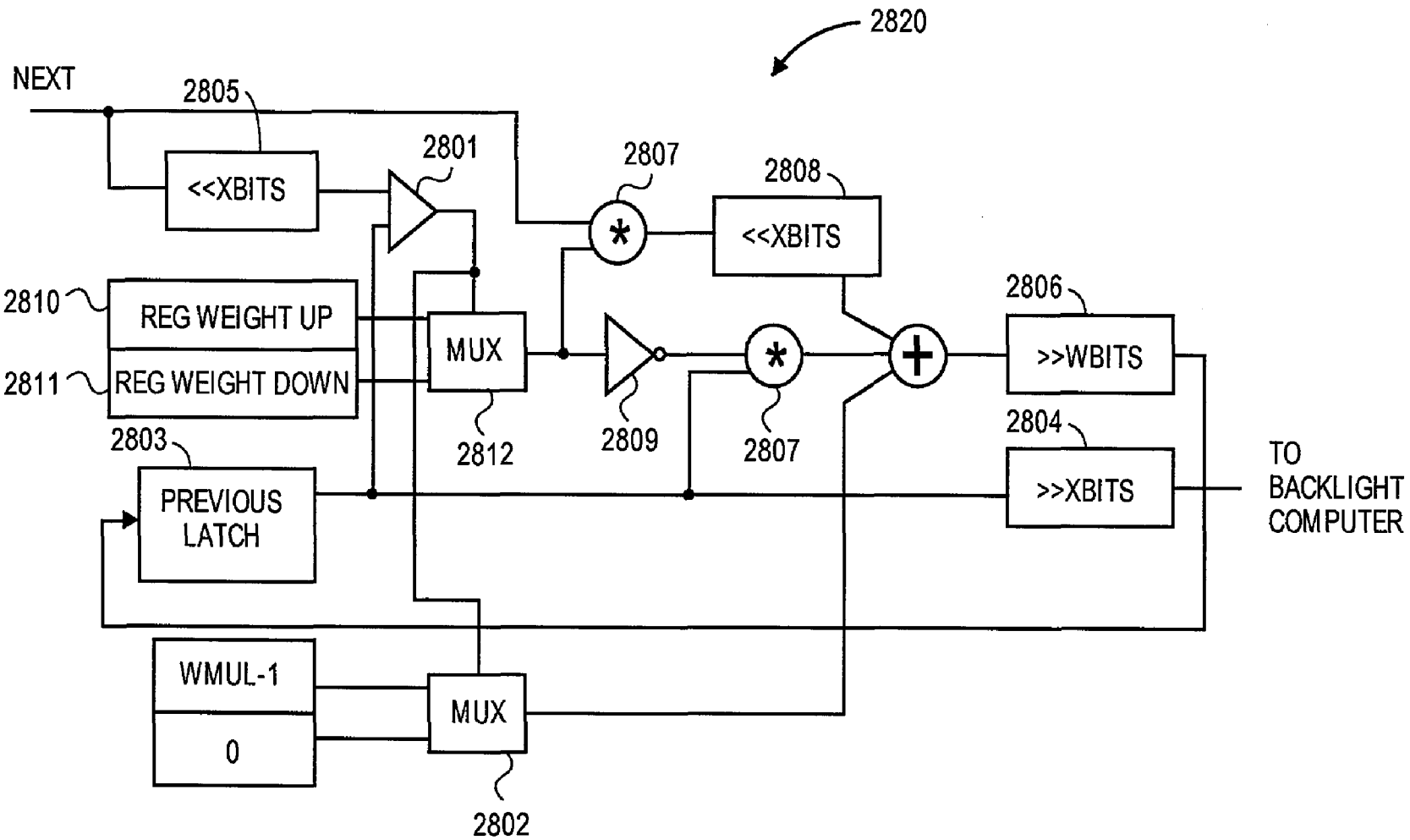
FIG. 28 depicts one embodiment of a decay module that may tend to minimize the visual effects of a system, as depicted and described in reference to FIGS. 21, 22, 23A and 23B.

Because LCD shutters converge to a new value at different rates when going up than when going down, it is possible in one embodiment to have two separate registers to contain the decay rate for increasing separate from decreasing. Since the round value may be already being calculated based on the direction of the change, the weight value may be selected from two different registers based on the same test result. FIG. 28 shows one possible implementation of such a decay module 2800.

Figure 29:
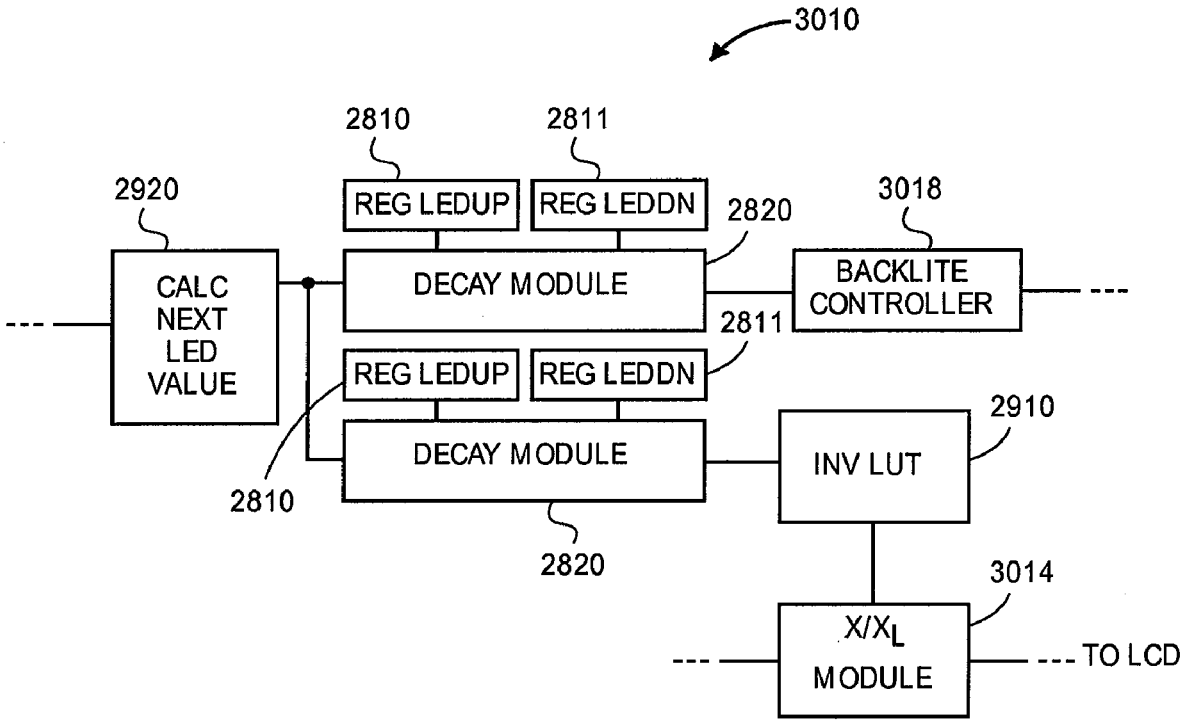
FIG. 29 depicts another embodiment of a system employing two decay modules.

To implement separate decays for the LCD and the backlight (e.g. LED backlight), FIG. 29 shows one embodiment having two separate decay modules, each of which could be implemented in the fashion of FIG. 28. Both modules could receive the same next LED value. Each decay module may have its own settable registers for the up and down decay. The output from one of the decay modules may go to the backlight controller and the other may go to the X/Xl calculation and the rest of the LCD path of the system.

It should be appreciated that the dynamic settings could be set for going lower than 50% backlight level. It could be set to go as low as 25% under normal control. However, it may be desirable to have a special case for setting the backlight to zero (0%) percent in the event of the screen going completely black to save even further on power.

As individual display system's response may be dependent upon the particular LCD response and particular backlight response, it may be desirable to tune such a system experimentally or even heuristically. Such values that work well for a system could be register settings in hardware. For example, some visual artifacts may be caused by a slow LC response. If a sudden change in the backlight value XL were to occur in response to a change in the peak color value, the LCD transmissivity change may lag. For example, when the backlight value XL goes up, the LCD drive value for a fixed input value color may go down. If the LCD is slow, the transmissivity is momentarily too high, it may cause a "flash". When the backlight value XL goes down, the LCD drive value goes up, but with a slow LC response, the transmissivity may be momentarily too dark, causing a "dark flash". If the backlight oscillates (without damping from decay), the lagging LCD may allow the backlight changes to be visible.

Thus, slowing down the XL value change may tend to reduce the artifact by reducing the change per frame, and thus the magnitude of the lag error. However, if the system can use two different XL values, one for the backlight and one for the X/XL calculation, then it may use slightly different logarithmic decay time constants so that the backlight follows the real LC response to further reduce the artifact. It may also be desirable to have different decay constants in each direction since the LC response is different in each direction.

Example System and Simulation Pseudo-Code:

Table 4 below is one possible example system made in accordance with the present invention by describing a hardware implementation in conjunction with a computer simulation. This is written in the language Lua (see www.lua.org) which serves as a simulation language and also as pseudo-code description and implementation of one embodiment of the current invention. This embodiment is based on the design shown in FIG. 30 and portions of the code in Table 4 are implementations of modules from that figure.

In this simulation, the backlight (in this case, an LED backlight—but other backlights may be possible) is designed to normally come on at the minimum power level (e.g. above 25%) necessary for the image being displayed. The LCD values are scaled in a manner that results in power levels above 50% only when colors are out-of-gamut, (OOG). There are switches that cause only yellow OOG pixels to be counted and causes the OOG values to be scaled by a smaller amount when there are fewer pixels OOG. However, if an image has a sufficient number of bright saturated colors going out-of-gamut, (OOG) then the LED power is increased and the LCD values are decreased.

The simulation has several parameters that will probably be fixed numbers in any given design. It has a variable, GAMBITS, indicating how many bits in the gamma pipeline. If this value changes then the input and output gamma tables may be changed to match. Since the number of bits in the LED backlight controller may not always be the same there is a variable, LEDBITS, that holds this number. There are several constants based on this, LEDMAX which is the maximum LED value, LEDhalf which is the half-LED power level, and LEDquart which is the cutoff point below which the LED power will not go. There is one exception, if the image is completely black the LED power is lowered to zero.

Figure 30:
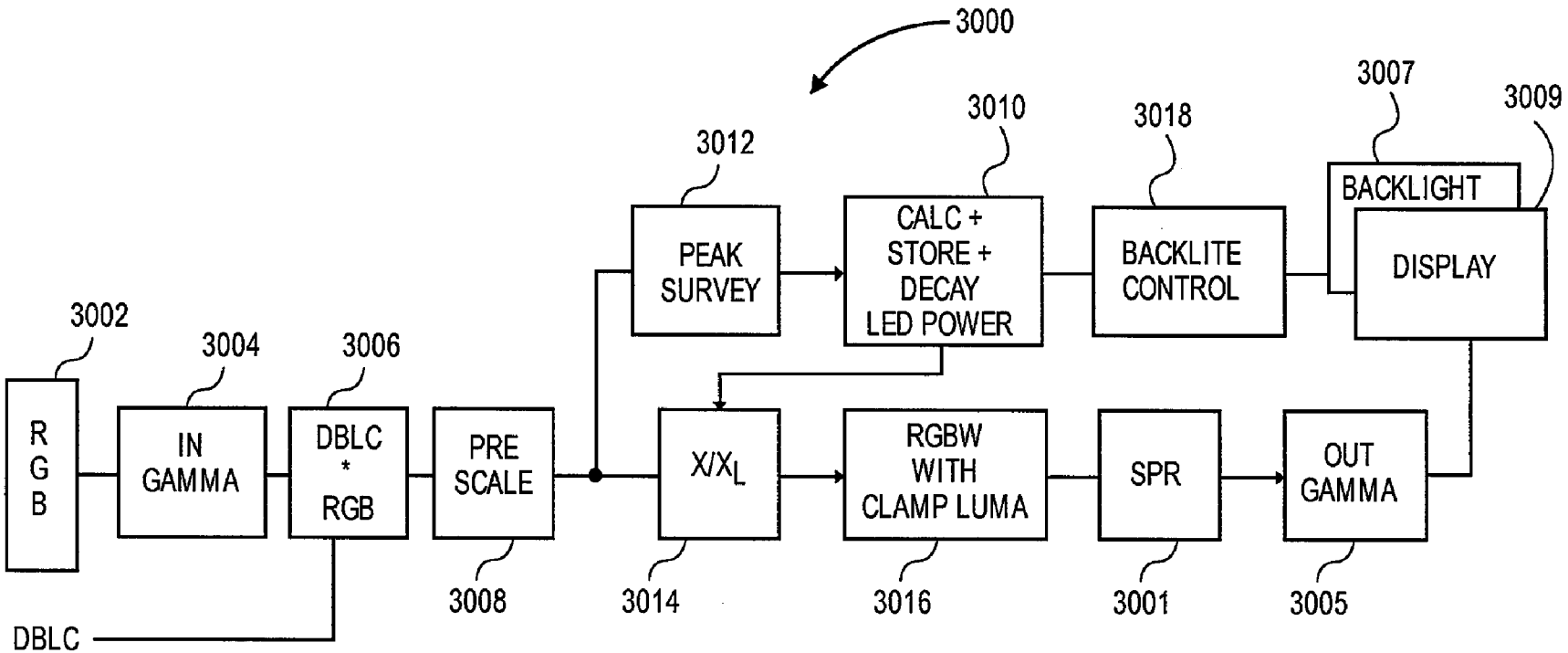
FIG. 30 depicts another embodiment of a system employing many of the possible modules disclosed here.

In FIG. 30, RGB values 3002 are converted to the linear domain by IN GAMMA Table 4004. The system in FIG. 30 may handle the situation in which the system of FIG. 30 is part of a larger implementation in which the larger implementation may have had a previous Dynamic Back Light Control (DBLC) module. This might be desirable if the system of FIG. 30 was an additive module on a third party's display module. Therefore, optional DBLC*RGB module 3006 may un-do any changes made by a previous backlight control module, if any exist. This simple operation should simply be a multiplication of each primary by the backlight power value (the DBLC signal). The correct formula for red with such a system would be:

```
r=math.floor(r*(DBLC+LEDhalf+1)/LEDMAX)
```

However, this involves dividing by LEDMAX which is a power-of-two-minus-one. Since the range of LED values tends to be small, this division may be replaced with a table that has each divisor inverted to a multiplier. The table may be build with the following loop:

```
for i=0,31 do
  DLUT[i]=math.floor(2^8*(i+LEDhalf+1)/LEDMAX)
end
```

This produces a table of 8 bit values and the formula for red above becomes:

```
r=math.floor(r*DLUT[DBLC]/(2^8))
```

With a similar formula for green and blue multiplied by the same number. After DBLC correction the input values may be optionally modified in PRE_SCALE module 3008. This module performs the operations described above and is not necessary for the understanding of this embodiment of the Dynamic Gamut Mapping system 3000.

Peak Survey

The peak survey module 3012 keeps statistics needed to calculate how far bright saturated colors go out of gamut. This operation is simulated in the doscan function in Table 4. The doscan function is called once for every input pixel in an entire frame. In this design the peak survey module requires un-scaled RGBW values which are not available. For this reason the peak survey module may do a separate GMA calculation to find the maximum OOG values. Fortunately, a complete RGBW GMA may not be required to calculate the maximum values. The simulation in Table 4 calls a version of the GMA (not shown) that only calculates the maximum primary (maxp) value. In addition the peak module has the following parameters, many of which will be registers in a hardware version:

yellow_only

A single bit indicating that only yellow OOG colors are counted.

weighted_oog

A single bit indicating that weighted average statistics are used.

cutoff

A 16 bit mask that limits the count of how many pixels go out of gamut. This value is calculated from the percentage of OOG pixels found in the image before boosting the LED power. Cutoff may be a mask register that may be initialized with a power-of-two-minus-one, or it could be calculated from a related variable "cutpow" in which case cutoff=(2^cutpow)−1

The peak survey module collects the following statistics as it looks at every pixel in an image. These may be initialized to zero before surveying an image.

Peakval

The highest value of any primary in any color in the image. This value has one more bit than values in the gamma pipeline. So it ranges from 0 to MAXCOL*2+1. Peakval is modified, if yellow_only is enabled, to count only yellow OOG colors in the survey.

Numoog

The number of pixels that were OOG, clamped to cutoff. This value never becomes larger than cutoff, which is typically limited to 16 bits.

Calc, store, & decay LED power module:

During vertical retrace, once all the pixels in an image have been surveyed, the LED backlight power may be calculated. First, the peakval may be scaled based on the number of pixels OOG if the weight_oog flag is set.

```
if (weighted_oog == 1) and (numoog>0) then
  peakval = math.floor((peakval−MAXCOL−1)*numoog/(cutoff+1))+
  MAXCOL+1
end
```

Next the LED power level may be calculated by scaling the peakval to the range of the LED controller, preventing it from dropping below 25% except in the case of a black image:

```
LEDy = math.floor((peakval*LEDMAX+MAXOOG)/(MAXOOG+1))
LEDy = math.max(LEDquart+1,LEDy)   --clamp it at 25%
if (peakval==0) then
  LEDy = 0                  --allow it to go to zero if the image is black
end
```

The LEDy value may be inverted to produce a multiplier for every pixel in the next image. Calculating the inverse requires doing a division, and there may be time in the vertical retrace to do this using an iterative algorithm for the divide. However, the number of possible LED values is small and building a table allows presetting special values in different ranges. Table 4 includes pseudo-code that generates a version of this table.

There may be an extra power of two in the denominators of the formula for that table. This may result in OOG values that range from 0 to 2*MAXCOL being scaled down by 50% to always be in gamut. This may also result in the overXL table having one less bit of precision and fewer gates. This table may typically be 9 bits wide (values between 0 and 511) when LED power is limited to 25% or higher and INVBITS=8 (INVMUL=256). With this table, inverting the LEDy value is a table lookup:

```
INVy=overXl[LEDy]
```

The resulting INVy value, when multiplied by input pixel values and divided by INVMUL, may scale images with OOG values down into gamut, scale all-in-gamut images by 1.0 and scale dim images up.

Weighted Logarithmic Decay:

Another function that Calc+Store+Decay module 3010 may do is prevent sudden changes in the LED power from being sent directly to backlight controller 3018. FIG. 28 shows some of the detail of a decay module 2820. A logarithmic decay algorithm may take a weighted average of the previous and the next value and replaces the previous value with the result. The simplest form of this is previous=(previous+next)/2 which will converge on a new value in a maximum of 8 steps when the difference between the previous and next is an 8 bit number. This is the "binary decay" formula because it moves half of the remaining distance at every step. A more general form might be a weighted logarithmic decay: previous=(previous*(1−weight)+next*weight). If the weight value is one half, this is exactly the same as the previous formula. In an integer (hardware) environment, it is possible to represent the weight as a fixed point binary number. If the number of bits in the weight register is WBITS and WMUL=2WBITS then the formula would be:

$$\text{previous}=(\text{previous}*(WMUL-\text{weight})+\text{next}*\text{weight}+\text{round})/WMUL$$

Where weight is a value from 0 to WMUL-1. Weight=WMUL/2 is the binary decay case. The above formula may be less desirable to implement in integer arithmetic. If the round variable has the value of zero then the formula may never converge on a constant next value that is higher than the previous value. If the round variable is WMUL-1 then the formula may not converge on a constant next value that is lower than the previous value. One embodiment might be to set the round value based on the difference between the previous and next values:

```
if next > previous then
  round = WMUL−1
else
  round = 0
end
```

If this test is done beforehand, then the formula may converge in either direction. In FIG. 28, comparator 2801 compares the next value with the output from the previous latch 2803 and selects WMUL-1 when next is larger and zero when next is smaller. As written above the decay formula will not step in factions of an LED power level, so the slope of the decay may not become less than 1.0. One embodiment adds extra bits to the previous value that are stored from frame to frame but never sent to the LED backlight. If the number of extra bits is XBITS and XMUL=2XBITS then the formula becomes $$\text{previous}=(\text{previous}*(WMUL-\text{weight})+\text{next}*XMUL*\text{weight}+\text{round})/WMUL$$

Previous latch 2803 may now be large enough to store the XBITS extra bits. Since the next value input does not have these bits, it may be modified by barrel shifter 2805 before comparing it with the previous latch in comparator 2801. Also and the value output to the LED backlight controller is now:

$$\text{previous}>>\text{XBITS}$$

This operation may be performed by barrel shifter 2804.

In some cases, increasing XBITS by one may add about 5 frame times to a response to a large change with a small weight. When weight=2 WBITS=4, XBITS=0, then decaying from 0 to 127 takes around 26 frame times. If XBITS=4 then the decay takes 46 frame times.

Note that there are many optimizations in the above formula. Dividing by WMUL is a right shift, shown as barrel shifter 2806. The two multiplies 2807 need to be (LEDBITS+XBITS)*WBITS in size, but since the lower bits of next*XMUL may be zero, this multiplier could be only (LEDBITS)*WBITS in size followed by a left shift shown as barrel shifter. The value (WMUL-weight) can be easily calculated by inverting every bit in the weight value in inverter 2809.

If gate count is an issue, the number of bits in the weight value may be reduced. This may decrease the number of different decay rates to choose from. For example, if the weight value only has 4 bits, then there may be 16 weight values to choose from, the round value may be set to 15 for converging up, and the multipliers may have to multiply by 4 bit values and discard 4 bits afterwards. Note that this parameter may be independent of the effect of the XBITS parameter. Both WBITS and XBITS may be chosen as fixed values in the design stage of a display.

Because LCD shutters converge to a new value at different rates when going up than when going down, it may be advantageous to have two separate registers 2810 and 2811 to contain the decay rate for increasing separate from decreasing. Which of these two weight values to use can be selected in multiplexer 2812 using the results of comparator 2801.

As discussed above, there are two reasons for decaying any changes in the backlight value. One is to reduce flicker when the input image is changing rapidly. Another is to compensate for the slow response of LCD shutters when they are changed by large amounts. To implement both, FIG. 29 shows a Calc+store+decay module 3010 that contains two separate decay modules 2820, each identical to the one described above. The LED power level is calculated in CALC module 2920 and sent to both decay modules 2820. Each decay module may have its own settable registers 2810 and 2811 for the up and down decay. The output from one of the decay modules may go to Backlight Control 3018. The output from the second decay module, after being inverted by INV LUT 2910, may go to the X/Xl module 3014 to effect the rest of the LCD path of the system. Note that both of the decay modules are decaying LED power values, which tend to have fewer bits than the INVy LUT values described above or the values in the gamma pipeline. It is possible to invert the output of the second decay module for use in the X/Xl module.

X/Xl:

Returning to FIG. 30, the INV LUT value from the previous frame may be used to scale the values in the next frame in X/Xl module 3014. Each red green and blue value may be multiplied by the INVy value in this module. This is performed in function doxxl in TABLE 4. The value of INVy ranges from 0 to 2*(INVMUL−1) which may be between 0 and 511. After the multiplication, the results are divided by INVMUL which may be a power of 2, typically 2^8, so the divide may be a fixed right shift.

After leaving X/Xl module 3014 the values may be piped to RGBW GMA module 3016 that may contain a gamut clamping to luminance algorithm. The resulting RGBW values may be filtered in Sub Pixel Rendering module 3001, corrected for output in Out Gamma module 3005 and sent to LCD array 3009.

TABLE 4

```
-- Adjusts backlight only when Yellow values go OOG, based on weighted
statistics
-- also does power savings on peakvalues less than ½
-- Clamp diagonal if colors are still OOG
--images are prescaled only enough to prevent OOG in yellow, then
--LED backlight power is increased to compensate.
GAMBITS=11        --number of bits in the gamma pipeline
LEDBITS=8         --number of bits in LED power level
LEDMAX=2^LEDBITS−1        --maximum LED power level, 100%
LEDhalf=2^(LEDBITS−1)−1 --closest thing to 50% LED power
LEDquart=2^(LEDBITS−2)−1          --25% power
M2 = M2 or 1.0                --M2 value for GMA initialization
clamp_diag = clamp_diag or 64 --Clamp diagonal (128 = 100%)
weighted_oog = weighted_oog or 1     --if 1, uses a weighted average of number
of values OOG
yellow_only = yellow_only or 1        --if 0, all saturated colors are included
INVBITS=8                    --number of bits below the binary point in the X/Xl
inversion table
INVMUL=2^INVBITS      --multiply or divide by this, a shift operation
require ("common.txt")          --load common routines
require("sRGB0811.txt")         --load the 8bit to 11bit sRGB input gamma table
require("srgb1108.txt")         --and the 11 bit to 8bit output gamma table
require("GMArgbwo.txt")         --load the RGBW GMA simple dumb version
rgbwREGS(GAMBITS,M2)      --initialize the GMA directly for L6w
spr.edgevals(1)   --edge pixels are duplicated
                                --statistics used to decide what to do
peakval=0         --peak value after GMA (can be 2*MAXCOL)
numoog=0          --number of values OOG
```

TABLE 4-continued

```
MAXOOG=MAXCOL*2+1 --twice MAXCOL, sort of
cutoff=1023              --maximum number of OOG pixels considered
function doscan(x,y)  -- scan one pixel and accumulate statistics
   local r,g,b=spr.fetch("ingam",x,y)                    --fetch the linear data
   local maxp = maxpRGBW(r,g,b)          --minimal RGBW GMA to calculate max
primary
                    --keep statistics on how often yellow goes OOG
   local oog=false
   if maxp>MAXCOL then                  --if it goes OOG
      local isyellow = b<math.min(r,g)                    --true if this color is
yellow
      oog = (yellow_only==0) or isyellow        --only record if is yellow in
yellow only mode
      if oog then                                --if still OOG after priority yellow test
         peakval = math.max(peakval,maxp)         --record this one if maximum
         numoog = math.min(cutoff,numoog+1)     --count how many of them
      end
   else
      peakval=math.max(peakval,maxp)              --still need peakval for powersave
mode
   end --if OOG
end
function doxxl(x,y)           --perform X/Xl calculation on one pixel
   local r,g,b=spr.fetch("ingam",x,y)           --fetch the values after input
gamma again
   r=math.floor(r*INVy/INVMUL) --perform the X/XL calculation when 1/Xl is >2
   g=math.floor(g*INVy/INVMUL)
   b=math.floor(b*INVy/INVMUL)
   local Rw,Gw,Bw,Ww,Lw=rgbwo(r,g,b)     --convert to RGBW
   Rw,Gw,Bw,Ww = gclamp(Rw,Gw,Bw,Ww) --GAMUT CLAMP
   spr.store("gma",x,y,Rw,Gw,Bw,Ww,Lw,0)                --store them in output
end    --function doxxl
*****************************************************************************
                -- START OF MAIN section OF DESCRIPTOR
xsiz,ysiz = spr.bufinfo("input")        -- find out how big the input buffer is
--*********************************************************
--build a table to do the 1/Xl inversion calculation for LED Yellow Boost and
power saving
--It should contain fixed point values with INVBITs below the binary point
--The table is built in four sections:
--the zero entry is a special case
--LED power settings between 0 and 25% are a fixed value
--between 25% and 50%, 'plain X/Xl' power reduction is done
--Power levels above 50% are used to bring OOG colors back into gamut
overXl={ }
for i=0,LEDMAX do
   overXl[i]=0                    --set the unused ones to zero
   if i>0 and i<=LEDquart then
      overXl[i] = math.floor(LEDMAX*INVMUL/((LEDquart+1)*2))
   end
   if i>LEDquart and i<=LEDhalf then
      overXl[i] = math.floor(LEDMAX*INVMUL/(i*2))
   end
   if i>LEDhalf then
      overXl[i] = math.floor(LEDMAX*INVMUL/(i*2)) --same formula as below 50%
here
   end
end
                --*********************************************
                --Do input gamma as a separate step
spr.create("ingam",xsiz,ysiz,3,2)
spr.loop(xsiz,ysiz,1,1,function(x,y)
   local bi,gi,ri = spr.fetch("input",x,y) --Windows BMP files have BGR order,
sad but true.
   ri,gi,bi = math.floor(ri),math.floor(gi),math.floor(bi)              --truncate input
to 6 bits
   local r,g,b = ingamma[ri],ingamma[gi],ingamma[bi]    --do input gamma out
here
   spr.store("ingam",x,y,r,g,b)                          --store linear data
end)
                --*********************************************
                --Peak Value Scan
spr.create("oog",xsiz,ysiz,3,1)
spr.loop(xsiz,ysiz,1,1,doscan)                  --scan for out of gamut numbers
         --*****************************************************
          --LED power calculated from number of OOG (optionally)yellow values in
the image
if (weighted_oog == 1) and (numoog>0) then                    --if doing weighted
average and some OOG
                        --scale the peak value down byt the percentage
```

TABLE 4-continued

```
oog
   peakval = math.floor((peakval−MAXCOL−1)*numoog/(cutoff+1))+MAXCOL+1
end
                                        --convert peak value into LED power
level
LEDy = math.floor((peakval*LEDMAX+MAXOOG)/(MAXOOG+1))
  LEDy = math.max(LEDquart+1,LEDy)      --clamp it at the quarter power level
if (peakval==0) then
   LEDy = 0                  --but allow it to go to zero if the image is
black
end
INVy = overXl[LEDy]   --invert the LED power into a multiplier for
intput values
power = math.floor(10000*LEDy/LEDMAX)/100 --convert to a display value for
debugging
                --*****************************************************
                --Perform the GMA, X/XL calculation and clamp diagonal
spr.create("gma",xsiz,ysiz,6,2)
spr.loop(xsiz,ysiz,1,1,doxxl)
                --Perform sub-pixel rendering
spr.create("spr",xsiz,ysiz,2,2)
spr.loop(xsiz,ysiz,1,1,dospr)
```

The invention claimed is:

1. A display system comprising:

a display panel comprising a subpixel group having a plurality of subpixels;

a backlight providing a light to the subpixels of the display panel;

a backlight controller providing backlight signals to the backlight to modulate the amount of the light provided by the backlight to the display panel;

a surveying module surveying image data and generating a peak value signal, the surveying module storing a peak value that pertains to a frame, the surveying module comparing the peak value with at least one color value to determine a maximum luminance value;

a last frame peak module calculating a color gain and intermediate backlight signals based on the peak value signal and providing the intermediate backlight signals to the backlight controller, the last frame peak module inverting the peak value signal and storing the inverted peak value signal in a normal value register, calculating the intermediate backlight signals from the inverted peak value signal and eliminating a quantization error from the intermediate backlight signals; and a circuit modulating the image data according to the intermediate backlight signals and providing the modulated image data to the display panel.

2. The display system of claim 1, wherein the subpixel comprises substantially wide spectrum band pass color and substantially wide spectrum band pass color is one of a group comprising: white, gray, cyan, yellow, and magenta.

3. The display system of claim 1, wherein the surveying module further comprises surveying image data over an entire frame and extracting the maximum luminance value over a set of color values.

4. The display system of claim 3, the wherein the display system further comprises a last frame peak module extracting the maximum luminance value from the previous frame of image data.

5. The display system of claim 1, wherein the display system further comprises a pre-reduction module reducing the image data by a desired amount to reduce the number of out-of-gamut image data values in the image data.

6. The display system of claim 1, wherein the display system further comprises a subpixel rendering module detecting the saturation of pixels near a target pixel and, depending upon the saturation, selecting one of a group of appropriate subpixel rendering techniques.

7. The display system of claim 6, wherein the group of appropriate subpixel rendering techniques comprises: meta-luma sharpening, area resampling, and same color sharpening.

8. The display system of claim 1, wherein the display system further comprises a chromatic filtering module.

9. The display system of claim 1, wherein the display system further comprises a selector selecting a group of modes wherein each mode is selectable according to a number of operating conditions.

10. The display system of claim 9, wherein the group of modes further comprises at least one of a group, the group comprises a normal mode, a normal mode with dimmed backlight power and a reduced simultaneous contrast mode.

11. The display system of claim 9, wherein the number of operating conditions comprises at least one of a group, the group comprising: user selection, application dependent selection, and ambient light conditions.

12. The display system of claim 9, wherein the modes operate by reduction of the luminance of the subpixels.

13. The display system of claim 9, wherein the modes operate by reduction of the illumination of the light provided by the backlight.

14. The display system of claim 1, wherein the display system further comprises a decay module decreasing illumination by the backlight as a curve comprising a series of steps with a decreasing amplitude.

15. The display system of claim 1, wherein the surveying module compares the peak value with at least four color values to determine the maximum luminance value.

16. The display system of claim 1, wherein the surveying module compares the peak value with a maximum of a plurality of color values to determine the maximum luminance value.

17. The display system of claim 16, wherein the plurality of color values is associated with at least four colors.

18. The display system of claim 1, wherein the peak value is set as zero at a start of the frame.

19. The display system of claim 1, wherein the surveying module selects a greater one of the peak value and the at least one color value to be the maximum luminance value.

* * * * *